US008226109B2

(12) United States Patent
Ritter

(10) Patent No.: US 8,226,109 B2
(45) Date of Patent: Jul. 24, 2012

(54) SPLITBOARD BINDINGS

(76) Inventor: William J Ritter, Bozeman, MT (US)

( * ) Notice: Subject to any disclaimer, the term of this patent is extended or adjusted under 35 U.S.C. 154(b) by 239 days.

(21) Appl. No.: 12/483,152

(22) Filed: Jun. 11, 2009

(65) Prior Publication Data

US 2009/0250906 A1 Oct. 8, 2009

Related U.S. Application Data

(63) Continuation-in-part of application No. 11/409,860, filed on Apr. 24, 2006, now Pat. No. 7,823,905.

(60) Provisional application No. 60/792,231, filed on Apr. 14, 2006, provisional application No. 60/783,327, filed on Mar. 17, 2006.

(51) Int. Cl.
*A63C 9/00* (2006.01)

(52) U.S. Cl. ..... 280/618; 280/603; 280/14.26

(58) Field of Classification Search ..... 280/601, 280/603, 614, 618, 623, 624, 633, 14.22, 280/14.21, 14.26
See application file for complete search history.

(56) References Cited

U.S. PATENT DOCUMENTS

| | | | | |
|---|---|---|---|---|
| 3,061,325 | A | 10/1962 | Glass | |
| 5,035,443 | A | 7/1991 | Kincheloe | |
| 5,297,812 | A * | 3/1994 | Dogat et al. | 280/633 |
| 5,520,406 | A | 5/1996 | Anderson et al. | |
| 5,558,354 | A | 9/1996 | Lion | |
| 5,649,722 | A | 7/1997 | Champlin | |
| 5,660,416 | A | 8/1997 | Schiele | |
| 5,697,631 | A | 12/1997 | Ratzek | |
| 5,741,023 | A | 4/1998 | Schiele | |
| 5,918,897 | A | 7/1999 | Hansen | |
| 5,971,419 | A * | 10/1999 | Knapschafer | 280/607 |
| 5,984,324 | A | 11/1999 | Wariakois | |
| 6,173,510 | B1 | 1/2001 | Zanco | |

(Continued)

FOREIGN PATENT DOCUMENTS

| | | |
|---|---|---|
| DE | 9108618 | 1/1992 |
| EP | 0362782 B1 | 8/1992 |
| EP | 0787512 B1 | 1/1997 |

(Continued)

OTHER PUBLICATIONS

Shoeboard Commercial Product—1 page description purportedly circa 2005, mini-ski binding with apparent adjustable toepiece and pivotable heel piece. Pivot located inferior to metatarsals at ball of foot. (As attested by B Kunzler Esq).

(Continued)

*Primary Examiner* — Frank Vanaman
(74) *Attorney, Agent, or Firm* — K. Karel Lambert; Lambert Patent Services LLC

(57) ABSTRACT

Splitboard boot bindings for backcountry splitboarding. Each of a pair of soft-boot bindings is provided with an integral boot binding lower that conjoins the two halves of a splitboard without the additional weight or height of an adaptor mounting plate, upper binding baseplate or "tray", and extra fasteners of the prior art. The boot binding lower is formed as a modified sandwich box girder or modified monolithic box girder and provides improved torsional stiffness for splitboard riding. When subjected to a torque applied by the rider, the bottom mediolateral flanges of the box girders are configured to contactingly engage the top face of the splitboard, thereby dynamically coupling the rider's boot sole and the board via a single rigid structure. In a preferred embodiment, the web or "spacer" members are characterized by an aspect ratio or contour height that is varied from heel to toe.

16 Claims, 32 Drawing Sheets

U.S. PATENT DOCUMENTS

| | | | | |
|---|---|---|---|---|
| 6,257,613 | B1 * | 7/2001 | Porte | 280/617 |
| 6,523,851 | B1 | 2/2003 | Maravetz | |
| 6,557,866 | B2 | 5/2003 | Jones | |
| 6,685,213 | B2 | 2/2004 | Hauglin | |
| 7,097,195 | B2 * | 8/2006 | Orr et al. | 280/628 |
| 2002/0089150 | A1 | 7/2002 | Musho | |
| 2004/0070176 | A1 | 4/2004 | Miller | |
| 2005/0115116 | A1 | 6/2005 | Pedersen | |

FOREIGN PATENT DOCUMENTS

| | | | |
|---|---|---|---|
| WO | WO 93/14835 | A1 | 8/1993 |
| WO | WO 98/17355 | A1 | 4/1998 |

OTHER PUBLICATIONS

Shoeboard_BackPacking Light—1 page description dated 2006 from Back Packing Light On-Line product review.

Commercial Product Description-NITRO—Early splitboard distributed circa 1991-1993 by Nitro USA of Seattle WA; with Fritschi AT bindings and interface. Annotated photographs 1-10. Author: K Karel Lambert.

Voile Backcountry Ski and Snowboard Equipment 97-98. (Voile, Salt Lake City UT). (2 pages) paragraphs 4,5: "The slider tracks slide onto . . . ", (1997-1998).

Nitro USA Snowboards Boardline 1993-1994 (Nitro USA, Seattle WA) (4 pages) p. 2 see photo, splitboard with ski-mode and snowboard-mode mounting assemblies, including slidably engageable conjoining bindings (see "Instructions for Use").

NitroUSA "Instructions for Use" (undated) p. 3 Riding position (Illustration [d]) ". . . slide the binding forward . . . ". Full text and illustrations, (document known as early as May 2010).

* cited by examiner

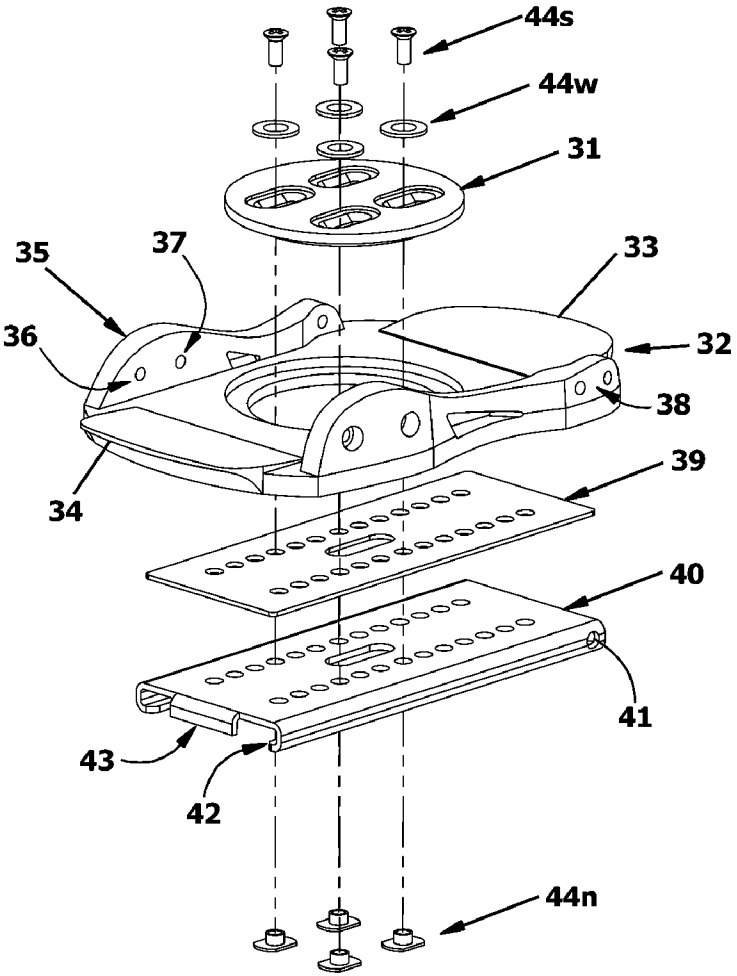
Fig. 4B (Prior Art)
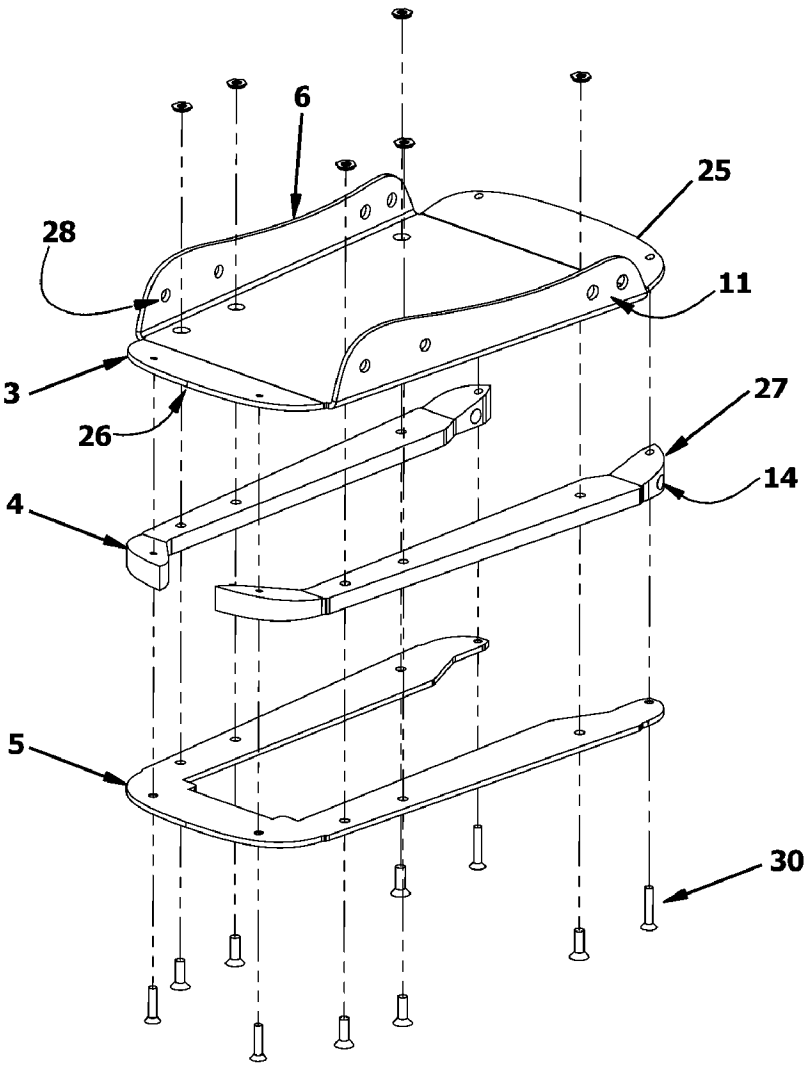
Fig. 4A (Example 1)

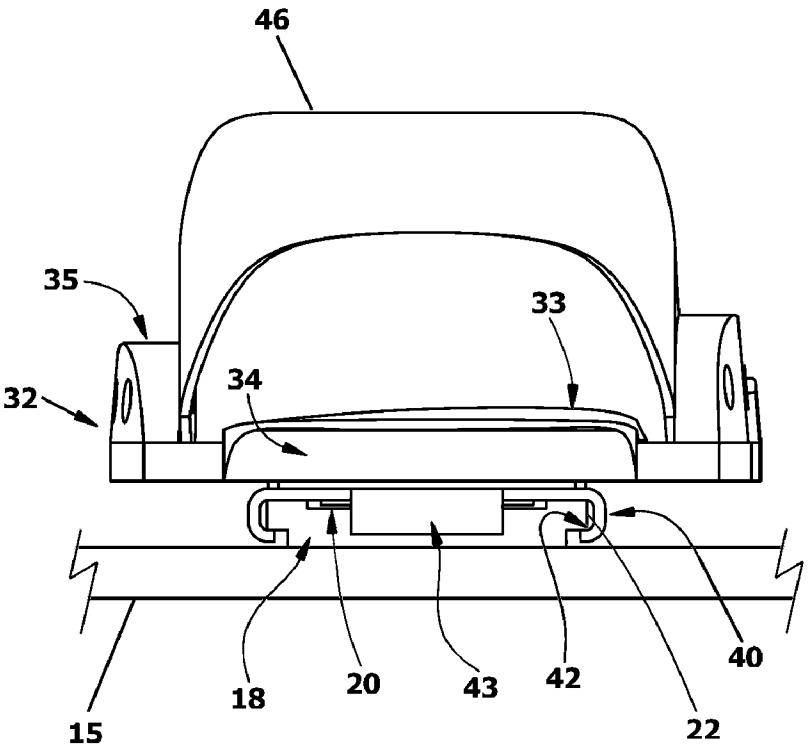
Fig. 5B (Prior Art)
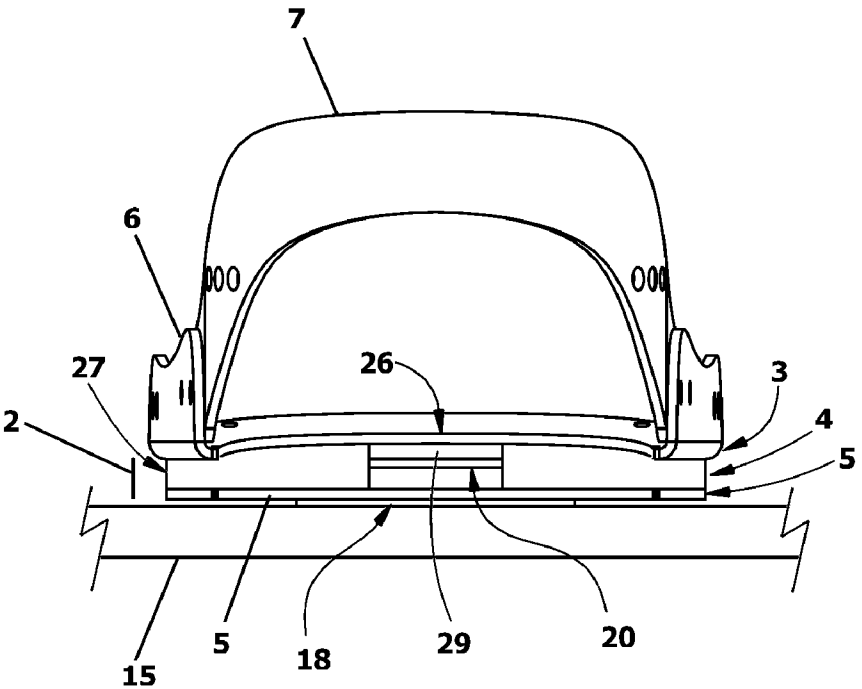
Fig. 5A (Example 1)

Fig. 38A
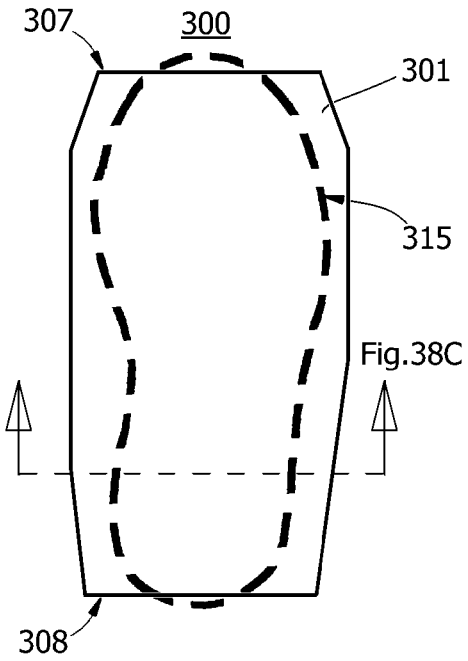
Fig. 38B
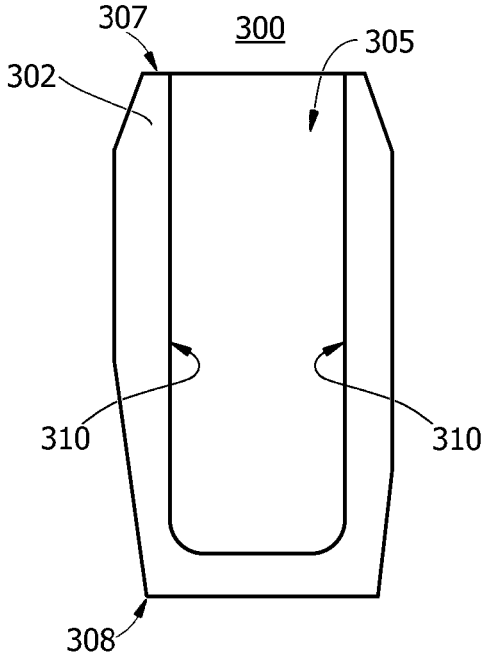
Fig. 38C
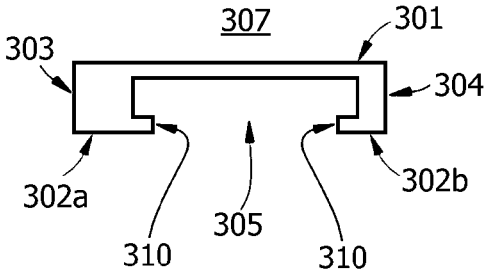
Fig. 38D
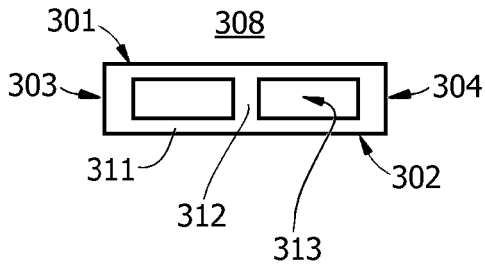
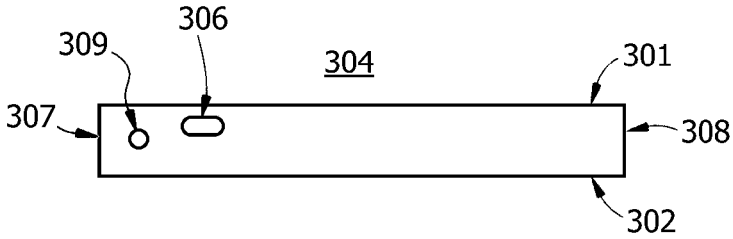
Fig. 38E

Table II. Torsional Spring Constants K

| | K (in-lb/degree) |
|---|---|
| (501) PRIOR ART | 145 |
| (502) ARTICLE OF FIG. 33 | 218 |

SPLITBOARD BINDINGS

RELATED APPLICATIONS

This application is a Continuation-in-Part and claims the benefit under 35 U.S.C. §120 of co-pending U.S. patent application Ser. No. 11/409,860 filed on Apr. 24, 2006, which is a non-provisional application claiming priority under 35 U.S.C. §119(e) from U.S. Provisional Patent Application No. 60/792,231 filed Apr. 14, 2006 and U.S. Provisional Patent Application No. 60/783,327 filed Mar. 17, 2006; all said priority documents are incorporated herein in entirety by reference.

BACKGROUND OF THE INVENTION

Backcountry snowboarding appeals to riders who wish to ride untracked snow, avoid the crowds of commercial resorts, and spurn limitations on what and where they can ride. There are no ski-lifts in the backcountry, so the snowboarder must climb the slopes by physical effort. Some snowboarders simply carry their board and hike up, but progress can be almost impossible if the hiker sinks deep in soft snow. Travel efficiency can be improved with snowshoes, but the rider must still find a way to carry their board up the slope.

Saving effort is the name of the game in the backcountry; it determines how many runs a rider is going to make in a day. If riders are exhausted by the time they reach the top of the run, they aren't going to snowboard to the best of their ability, or enjoy themselves as much as they could.

Splitboards are a recent improvement. When assembled, a splitboard looks like a snowboard, but can be taken apart to form a pair of skis. The right and left "skis" of a splitboard are asymmetrical; i.e., they are the mirror halves of a snowboard—longitudinally cut (or "split"), and typically have the sidecut (i.e. nonlinear long edges) and camber of snowboards.

When touring cross-country and uphill to reach the slopes, the skis are worn separately. Cross-country travel on skis requires less effort than hiking or snowshoeing. Since the rider is wearing the skis instead of carrying a snowboard, the effort is less tiring—the rider can glide along, and there is no extra weight to carry up the slope. The wider track of the splitboard skis reduces sinking in soft powder snow.

"Free heel" ski bindings and adaptors, such as telemark, randonee or Alpine Trekkers, make ski touring easier. In addition, the skis may be adapted for climbing by applying climbing skins to the lower surface of the skis. The use of climbing bars propped under the boot heels aids in climbing steeper slopes and crampons may be used in icy conditions to decrease the risk of slipping. Free heel bindings, climbing skins, climbing bars and crampons are used by touring splitboarders as well.

In the occasional descent in ski touring mode, the heels of the boot bindings are optionally "locked down" to the skis, with descent using conventional alpine techniques, or more commonly left free with the toe attached by a pivot, with descent using telemark ski techniques.

The splitboard reveals its true utility on the downhill rides. The rider first joins the two skis of the split board pair to form a snowboard-like combination. The rider's stance in the snowboard riding configuration is sideways on the board, with legs spread for balance. Ideally, the rider descends the slope as if riding a snowboard, with heels and toes locked in place.

Some boards, known as "swallowtails", are designed for deep powder snow. These boards have forked tails that allow the tail of the board to carve more deeply in the snow while keeping the nose of the board high.

Another version of splitboards, recently innovated in Europe, is formed with two narrow skis and a third fitted plank between the skis. When ski touring, the extra plank must be carried. It remains to be seen whether this will catch on in backcountry snowboarding elsewhere.

It should be noted that downhill skiing and snowboard riding require very different styles and skills. With skis, the body points in the same direction as the skis, and the skier uses hips and knees to change direction. Knee injuries are common because the legs move separately. On a snowboard, the body is essentially crossways on the board, and both heels are firmly attached to the board so that the feet, ankles, hips, and upper body can be used to set the board on an edge and make a turn. Knees are more protected because both legs are firmly secured to the board.

Backcountry splitboarding, which combines ski touring and snowboarding, thus requires boot bindings adaptable for both ski configuration (i.e. one to a ski) and for snowboard configuration, (i.e. joining the skis as a snowboard).

In one widely used configuration of the prior art, mounting block assemblies are attached in pairs crosswise on the opposing ski member halves of the splitboard, one pair for the forward leg and one pair for the back leg. These mounting blocks, disclosed in U.S. Pat. No. 5,984,324 to Wariakois (hereby incorporated in full by reference) include a toe mounting block and a heel mounting block, which are designed to slidingly receive an adaptor mounting plate (see the C-channel, item 74 of FIG. 6 of U.S. Pat. No. 5,984,324, also termed "slider plate") and attached upper binding baseplate (item 72 of FIG. 6 of U.S. Pat. No. 5,984,324, also termed the "boot mounting assembly"), thereby conjoining the two ski members to form a snowboard. The mounting blocks, made of filled (fiber reinforced) nylon, are inherently compliant, and no means for dampening the compliance of the mounting blocks and associated stack of parts of the bindings is suggested. The adaptor mounting plate is also narrowed relative to the width of the boot support plate as shown in FIG. 5 of U.S. Pat. No. 5,984,324. The narrowness of the C-channel saves weight, but reduces stability. Nonetheless, the adaptor mounting plate alone adds about 7 oz (or 200 g) of weight to each boot, and the total weight of an adaptor mounting plate with attached upper binding baseplate and bindings can be 1.5 kg or more per foot, dramatically increasing the rider's burden. A rear stop tab on the adaptor mounting plate prevents the plates from sliding forward over the heel mounting block and a clevis pin is used to lock the toe of the adaptor mounting plate on the toe mounting block.

This same clevis pin is used as a pivot pin when the adaptor mounting plate is relocated to a ski mounting bracket. But experience has shown that the forces on the pivot pin are such that the pivot pin cradle and adaptor mounting plate of the prior art rapidly fatigue and are ovally deformed, leading to heel "fishtailing" in free heel mode, which destabilizes the rider and which must be repaired by replacement of the worn parts.

A second system for grippingly conjoining the ski member halves of a splitboard is disclosed in U.S. Pat. No. 6,523,851 to Maravetz, hereby incorporated in full by reference. This system employs a recessed ring with raised flanges that mate with a clamshell adaptor plate to secure the upper boot assembly to the board. The preset angle of the foot relative to the board can be changed by use of a locking pin in the rotatable lower half of the lower adaptor plate. The clamshell is hinged at the toe, but conversion from touring mode to snowboard mode can be difficult with this system because snow often gets inside the clamshell works during touring, and consequently this system has proved less than satisfactory in field experience by snowboard riders.

Both of the above prior art splitboard systems employ stacked mechanical members, including interposed adaptors, to secure the boot bindings to the board interchangeably between ski and snowboard configurations. In addition to the ski member conjoining function, these approaches teach the utility of a universal mounting system and upper binding baseplate for the industry-standard (3- or 4-hole) disk used in most strap-type or step-in snowboard and ski boot mounting systems, including for hard, hybrid, or soft boots. An even more complex example of an adaptor plate is shown in US 20040070176 to Miller. These teachings point to the continued need for improvement in this field.

Splitboarding is no longer a crossover sport. The majority of board riders have developed a preference for soft boots, which many find to be lighter, more comfortable, and better adapted to the style of riding they prefer. Only a minority of riders use hard boots. Board riders typically require a greater range of motion at the ankle than hard boots provide. Flexibility at the ankle (also known as "foot roll") enhances the rider's ability to shift his or her weight and body position around the board for balance and control by allowing for a wider range of angles the legs can make with the board. For example in riding over a mogul, the rider shifts weight to the back of the board as the angle of the slope changes, or in carving a turn in hard snow, the rider will lean forward on the board. Flexibility may also improve the overall ride by allowing bumps to be more readily absorbed by the ankles and knees. Thus, the freedom of the foot to "roll", and allow the angle of the leg to change relative to the board provides a performance and feel that many riders find desirable. Soft boots have emerged as a clear preference among splitboarders.

Boot bindings for use with soft boots are of two basic types: "strap bindings" and "step-in bindings". A strap binding, which has been the traditional type of binding for a soft boot, includes one or more straps that are tightened across various portions of the boot, securing the boot in a boot pocket formed by the binding upper. For example, an ankle strap may be provided to hold down a rider's heel in the heel cup and a toe strap may be provided to hold the front portion of the rider's foot.

Step-in snowboard bindings, both toe-and-heel and sole side-grip bindings, have also been developed for use with soft snowboard boots. Most of these require specially fabricated boots matched to the bindings. "Bails" may be used at the heel or toe to secure the boots, as with mountaineering boots. Newer innovations include highbacks with click locking mechanisms.

However, while innovation continues, the prior art has not produced a boot binding optimized for splitboarding. Components of the prior art—including 4-hole disk bindings, adaptor mounting plates, slider tracks, rubber gaskets, and filled-nylon upper binding baseplates, for example—increase overall wobble experienced by the rider (due to additive stacked tolerances and compliances), add weight, and put more height between the rider's heel and the board itself: all undesirable characteristics. The lack of firm broad contact between the most commonly sold adaptor mounting plate and the board surface also adds to the rider's instability.

The added "flex" or "play" in the mechanics of the prior art adaptor mounting plates, and associated mechanical stack members, which float above the surface of the board (see Example 2), results paradoxically in dampening of the rider's movements with respect to the board and loss of control. The apparent paradox arises because although freedom of movement of the ankle in the boot binding is essential to good riding, there must also be torsional stiffness—the rider's motions must be resisted by an optimal level of stiffness in the binding so that the legs cannot simply flop back and forth, but rather the binding resists this torsional motion (in the engineering sense) with a spring-like stiffness, allowing the rider to apply pressure at the desired segment along the length of the board.

The board is controlled by the bite of its edges in the snow. The rider steers by relocating pressure from one side of the board to the other as well as from nose to tail. Toeside and heelside turns on a snowboard involve a complex combination of dorsiflexion and plantar flexion, plus the roll of the calcaneus, talus, and subtalar joint, nosewise and tailwise on the board. While these motions would seem to be favored by a completely loose binding, in fact, an optimal torsional binding stiffness is required. Torsional stiffness is the spring force in the bindings that opposes the rider's motion. This opposing force translates the rider's motion into pressure on the desired section of the board. When the rider bends downslope, for example, the boot bindings transmit pressure onto the nose of the board. When the rider bends upslope, the boot bindings transmit pressure onto the tail of the board. Similar forces come into play as the rider leans toeside or heelside. If the bindings lack torsional stiffness, the ability to apply control pressure to the intended segment of the board is decreased. Torsional looseness is felt as "play", "slop" and instability. Conversely, if the bindings are too stiff, the legs cannot pivot, and the rider loses balance and control. Therefore, there is an optimal stiffness, providing an optimal mix of freedom of motion and board control.

While hard ski boot bindings are too stiff to allow the range of motion most snowboarders prefer, the splitboard systems of the prior art incorporate a soft boot binding with an adaptor mounting plate that is not stiff enough and has excess play. Although the rider can readily bend at the ankle, the lack of stiffness prevents the rider from precisely transmitting that force as a directed pressure at the desired segment of the board.

A problem first recognized and addressed by this invention is thus one of enhancing the torsional stiffness of snowboard boot bindings for use with splitboards in "snowboard riding mode", and simultaneously improving performance and comfort of the equipment in free-heel "ski touring mode". There is an unmet need for splitboard soft boot bindings with the stiffness, weight, and heel height for today's splitboard riding styles. This need necessitates a mechanical reinvention of the boot bindings from the board up.

SUMMARY OF THE INVENTION

Disclosed here are improved boot bindings for splitboarding. Contrary to the teachings presented herein, the teachings of the prior art disclose a boot binding with one or more adaptor mounting plates—so that boots and boot bindings designed for snowboarding can be adapted for crossover use with splitboards. This approach is problematic, adding weight, instability, and decreasing the torsional stiffness (or spring constant) of the boot bindings. No solution has been offered in the prior art that eliminates the weight and height of the essentially ubiquitous "adaptor mounting plate" and, as recognized herein, supplies the right amount of stiffness in the boot binding on the ankle to optimize rider control, while remaining comfortable and responsive for the soft boot rider. The lack of a prior art solution is not surprising because the problem has not previously been recognized in these terms.

Any solution to the problem must also allow the rider to easily reposition the boots when switching from snowboard riding to ski touring configuration, and the performance in ski touring configuration also must be improved.

The prior art adaptor mounting plate, which serves the function of adapting both snowboard-type soft-boot bindings and hard boot bindings to the snowboard mounting blocks and also to the ski touring mounting brackets of the prior art, can be advantageously eliminated. The adaptor mounting plate can be replaced with a box girder in which the top plate and "upper surface" of the box girder, on which the rider's boot is supported, and bottom plate with channel and inside flanges that grips the board, are joined by medial and lateral web spacer members having an aspect ratio different or modified from the aspect ratios of the top and bottom plate members. The aspect ratio of the web spacers may be varied from heel to toe, so that the box girder is shaped, proportioned and contoured to better support and secure the rider's boot. Stiffer torsional spring constants are obtained with the wider boot bindings of this construction, and interestingly, because of the integrated design, the overall height of the raised platform nonetheless places the rider in a position that is lower than possible with the devices of the prior art. While not being bound by theory, these teachings are a new solution to the problem of boot binding structural mechanics, and are shown here to have unexpected advantages that improve the split-board ride.

The modified box girder serves dual functions in securing the boot on top and gripping the board with its lower aspect, while remaining itself structurally rigid. By limiting play and compliance between the girder and the board surface, the overall spring constant becomes relatively constant over the required flexural range, and approximates the spring constant of the boot itself, as modified by reinforcing structures such as boot pocket, upper side rails, heel cup, and highback, all of which increase stiffness adjustably.

By eliminating the adaptor mounting plate, and subsuming its functions as part of an integral boot binding lower, multiple improvements in form and function are achieved. Unneeded weight is eliminated. Reduction in heel height relative to the board surface results in a lower center of gravity on the board, for better balance and control. Recognizing the inherent plasticity of the mounting blocks, clearance spaces between the bottom surface of the box girder and the upper face of the board are reduced or eliminated, dramatically firming the spring constant for the bindings. Removal of the narrow adaptor mounting plate also increases the firmness of the foot and ankle contact with the board surface, and eliminates the looseness, flex, or "play" between the multiple mechanical components of the prior art that dampen the board's responsiveness to the rider's movements. This has proved an elegant solution to what was an unrecognized problem.

Happily, free heel ski performance is also improved. For one, by replacing the pivot pin used with the prior art adaptor mounting plate with a longer pivot pin mounted through the thick webs or spacers of the structural girder at the toe of the integral boot binding lower, wear on the parts is dramatically reduced. In the embodiment of Example 1, the pivot pin is lubricated and reinforced by ultrahigh molecular weight polyethylene (UHMWPE) used as a spacer material in the toe of the integral boot binding lower. This eliminates oval mounting-hole deformation characteristic of prior art pivot pin mounting cradles. Again, broader and more firm toe contact with the board is obtained, improving performance in free heel skiing. Snow, which invariably can pack up under the boots and mounting blocks during skiing and snowboarding, is vented out under the heel, easing the switch from ski touring to snowboard riding configuration, and vice versa.

The use of variform box girder construction, where the web aspect ratio is varied independently of the aspect ratios of the top and bottom plate members of the girder, permits shaping, proportioning and contouring the top surface of the binding to the sole of the rider's boot, while preserving the fixed dimensions of the channel and inside flanges of the bottom plate. As demonstrated here, control of the board is improved by eliminating cumulative elastic and inelastic deformation that is readily observable in boot bindings of the prior art (see Examples 2 and 4). The binding is configured so that bottom medial and lateral flanges touch down on the board face during maneuvers. Comparative field studies performed with embodiments of this invention show that torsional stiffness is increased to a efficacious level, resulting in improved control and comfort for the splitboard rider.

BRIEF DESCRIPTION OF THE DRAWINGS

The teachings of the invention can be readily understood by considering the following detailed description in conjunction with the accompanying drawings and claims, in which:

FIG. 4A is an exploded view of a sandwich box girder-type of boot binding of Example 1, with heel perspective. For comparison, FIG. 4B shows a boot binding of the prior art (per U.S. Pat. No. 5,984,324, as commercially available).

FIG. 5A is an elevation view of the heel of an integral boot binding lower, with heel cup, of Example 1 in snowboard riding configuration. For comparison, FIG. 5B presents the same view of the heel of a boot binding of the prior art (per U.S. Pat. No. 5,984,324).

FIGS. 38A through 38E are schematic views of a variform box girder as used in an integrated boot binding lower.

DETAILED DESCRIPTION OF THE INVENTION

Figure 1:
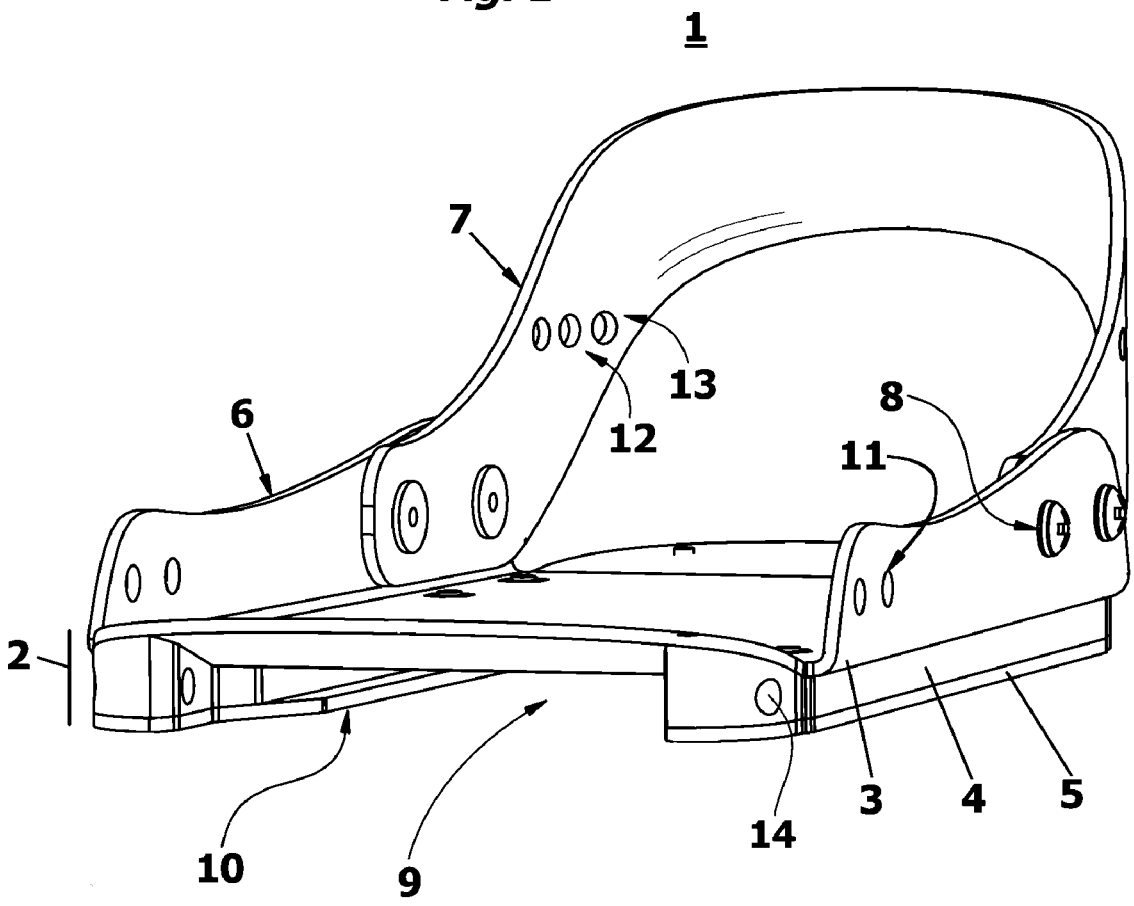
FIG. 1 is a perspective view of a sandwich box girder-type of boot binding lower with heel cup, the construction of which is described in Example 1.

Certain meanings are defined here as intended by the inventor, i.e., they are intrinsic meanings. Other words and phrases used here take their meaning as consistent with usage as would be apparent to one skilled in the relevant arts. When cited works are incorporated by reference, any meaning or definition of a word in the reference that conflicts with or narrows the meaning as used here shall be considered idiosyncratic to said reference and shall not supersede the meaning of the word as used in the disclosure herein.

1. Definitions

Board: a low-friction, generally elongate and generally planar surface intended for supporting a standing person while sliding over snow or ice; typically a "splitboard" as used here.

Splitboard: a combination consisting of two separable ski members, each generally having one nonlinear longitudinal edge, that can be joined at opposing lateral edges to form a snowboard. The ski members are typically shaped so as to approximate the right and left halves of a snowboard respectively. The tips of the ski members are generally secured together in the snowboard configuration by use of hooks and pins, or other conjoining apparatus, but the relative stiffness of the coupling is largely the result of the mechanics of the transverse union formed by the boot bindings and associated hardware straddling the separate ski members.

Boots: are of three general types, i.e., hard boots, soft boots and hybrid boots (for example "plastic mountaineering boots" which combine various attributes of both hard and soft boots). Hard boots are exemplified by alpine and telemark ski boots and typically employ a moderately stiff or very stiff molded plastic shell for encasing a rider's foot and lower leg with minimal foot movement allowed by the boot. Hard boots and mountaineering boots conventionally are secured to the board using plate bindings that include front and rear bails or clips that engage the toe and heel portions of the boot.

Soft boots, as the name suggests, typically are comprised of softer materials that are more flexible than the plastic shell of a hard boot. Soft boots are generally more comfortable and easier to walk in than hard boots, and are generally favored by riders that engage in recreational, "freestyle" or trick-oriented snowboarding, or alpine riding involving both carving and jumping. Soft boots are conventionally secured to the board with either a strap binding, a step-in binding with lateral clamp (such as US Patent Application 20020089150), or with the flow-in bindings, clickers, or cinches of hybrid bindings known in the art (such as U.S. Pat. Nos. 5,918,897 to Hansen and 6,173,510 to Zanco).

"Ride" or riding: a noun or verb used by snowboarders to indicate the distinctive downhill slide experienced by a rider on a snowboard (or on a splitboard in snowboard mode). Snowboarders ride; skiers ski.

Ski tour or touring: When used as a noun, indicates: a trip through areas typically away from ski resorts, referred to as the backcountry, which may include traversing flat areas, ascending inclined slopes and descending slopes using one or several of the following pieces of equipment: skis, poles, snowshoes, snowboards, or splitboards. When used as a verb, indicates: to enter the backcountry, typically away from a ski resort, and perform one or more of the following: traverse flat areas, ascend inclined slopes, and descend slopes using one or more of the following pieces of equipment: skis, poles, snowshoes, snowboards, or splitboards.

Ski touring configuration or mode: indicates a configuration in which the two ski members are separate and are attached one to a leg, typically with a free heel binding to facilitate traversing terrain and ascending slopes. When used to describe a splitboard configuration, indicates that the ski halves have been separated and the rider is ski touring on the separate ski members attached to each foot.

Ski mounting assembly: refers to hardware, brackets, pins or blocks secured on the surface of each ski, generally centrally placed, so that boot bindings can be fastened to them, one boot to a ski, in the ski touring mode or position. In the most common conventional device, a ski touring pin cradle is used with a pivot pin or pins with the pivot axis extending through the toe of an adaptor mounting plate, the purpose of which is to provide a hinged coupling between the boot and its counterpart ski member, as in telemark skiing and "free heel" skiing. A ski mounting block may take the place of the pin cradle and may be used with boot mounting tongues, cables, or other pivoting means. Bushings may be used to extend the life of the wearing surfaces. Incorporated herein by reference with respect to pivoting means are U.S. Pat. Nos. 5,649,722 to Champlin, 6,685,213 to Hauglin, 5,741,023 to Schiele, US Pat. Appl. 20050115116 to Pedersen, and their cited references. As described herein, a webbed girder construction of the boot binding beam permits use of a longer pivot pin with less wear.

Snowboard riding configuration or mode: indicates a configuration in which the right and left ski members are joined at opposing lateral edges to form a snowboard and the rider mounts the board with both feet spaced and secured in the mounting block assemblies.

Snowboard mounting block assembly or "mounting block assembly": refers to a pair of flanged mounting block elements (also termed "slider blocks" in the prior art or simply "mounting blocks" here) secured to the ski members of a splitboard so that they can be conjoinedly and flangedly interlocked in the snowboard configuration. For example, the mounting block assemblies (17,18,19,20,21—FIG. 2 and FIG. 6), as illustrated here, are derived from the prior art (See U.S. Pat. No. 5,984,324), but are not limited to such. In practice, paired mounting blocks are proximately positioned on the opposing ski members, forming a "slider track" to receive a boot binding traversing the two ski members. The mounting block assembly elements are thus positioned to extend the boot bindings from one ski member to the other, conjoining the ski members of the splitboard in the form of a snowboard.

Variform box girder: is a rigid girder formed as a box with top plate member with an "upper" or "top" surface (for supporting the sole of the rider's boot), a bottom plate member with bottom surface and bottom mediolateral flanges, and with lateral and medial webs for structural rigidity. Also included is a bottom channel with parallel interior flanges formed in the bottom plate for attaching the boot binding to a mounting block assembly on a splitboard. A variform box girder is further characterized as having a shape which varies from toe to heel so as be proportioned and contoured for fitting and contactingly supporting the sole of a rider's boot, and is widened at the bottom flanges, relative to the mounting blocks, for better distributing torsional forces onto the face of the splitboard. The web members of the variform box girder typically have a variable aspect ratio that is modified and different from the aspect ratio of the plate members; i.e., the aspect ratio of the web members may be varied independently of the aspect ratio of the plate members. A variform box girder may be formed as a modified sandwich box girder or as a modified monolithic box girder.

While the top and bottom plates of a box girder are conventionally termed "flanges", the word flange is reserved here for a) inside flanged edges formed facing a box-ended channel between the webs on the bottom of the box girder and b) mediolateral flanges of the bottom plate. The modified box girder may be monolithic, that is "fabricated as a single piece", or fabricated by forming or fusing of the basic girder elements (top plate, bottom plate, lateral web, and medial web) into a single structural and functional unit.

Sandwich box girder: is a rigid girder formed as a box with top plate member with upper surface (for supporting the sole of the rider's boot), bottom plate member with bottom surface, lateral web and medial web. Sandwich box girders have three layers, but two of the layers may be consolidated, for example by web elements consolidated as projections of the top plate. Bottom plate members may be single-piece or two-piece, as for example where a separate flange member is joined to the base of each of the web members in the manner of a "pi-girder". Sandwich box girder includes two-piece, three-piece and four-piece compositions. Similarly, web members may be assembled as a single piece or subassembly with right and left aspects, or as two pieces or subassemblies with right and left members of a pair. The modified sandwich box girder may be formed with webs or plates having an aspect ratio or contour height that varies from heel to toe. Furthermore, the material properties of the spacer members may differ from the material properties of the plate members in a modified sandwich box girder. In a preferred embodiment of a sandwich box girder, the spacer members are honeycombed to reduce weight.

Web: is a generally vertical element of a girder for joining a top plate or surface and a bottom plate or surface of the girder. A typical box girder has two webs, a medial web and a lateral web, although double box girders are also conceived. The webs may be side webs or recessed webs. Web elements resist both compressive and tensile loads, including torque and bending when a load is applied to a box girder. The aspect ratio of the web element is varied independently of the aspect ratio of the top plate member or the bottom plate member.

Integral boot binding lower: refers to a modified box girder constructed with a top plate forming a raised platform surface and a bottom plate with lower aspect for engaging a snowboard mounting block assembly of a splitboard in snowboard riding configuration. The box girders also have girder webbing (where the web is either made of a structural spacer material, "honeycomb" or "core", laminated, molded, glued, solvent-welded, or otherwise affixed between the top and bottom plates—or is an integral part of the material of the top or bottom plate, as by molding, extrusion, sheet folding, welding, solvent welding, riveting, thermal fusion, casting or machining). In other words, the modified girder may be a monolithic single piece or may be a sandwich construct, three-layer sandwich constructions having individual top plate, bottom plate, and webs, or a two-layer sandwich of top plate with integral webs and bottom plate, or bottom plate with integral webs and top plate. The box girder is modified with a box-ended channel and inside flanges on the bottom surface, with transverse pivot hole at the toe end, optionally with endstop or crosspiece at the heel end, and with projections, top side rails, or perforations peripherally disposed for aiding in the attachment of straps or fasteners for securing the boot to the top surface. The ends of the girder are typically modified for heel and toe. Thus an integral boot binding lower is a modified box girder with adaptive modifications made for performing functions not performed by the elements separately. These functions include: a) supporting a boot on the top surface or aspect, with means for securing the boot to the boot binding; b) reversibly receiving and grippingly conjoining a snowboard mounting block assembly in snowboard riding mode; c) providing a means for pivoting at the toe in ski touring mode; d) serving as a rigid platform with bottom surface configured for contactingly engaging the top face of the splitboard when subjected in splitboard riding mode to bending stress by the rider; thereby providing an efficacious torsional stiffness.

Integral boot binding lowers are used in pairs (one for each foot), one anteriorly placed (front of center) and one posteriorly placed (back of center) on the board in snowboard riding configuration. In the snowboard riding mode, the boot heels are generally secured to the board. Provision is also made in the integral boot binding lower for the "free heel" ski touring mode by providing a means for pivoting at the toe and attaching the boot binding to the ski mounting assembly.

Integral boot binding lowers may be fabricated from metal, such as aluminum or aluminum alloys, titanium, or steel, and so forth, or from plastic or reinforced plastic, either molded, machined, cast, or extruded. In sandwich construction, spacer materials used for the webs include UHMWPE because of its toughness, resistance to wear, and lightness, but other thermoplastics such as nylon, polypropylene, fluoroplastics, and polyamides or reinforced composites such as polyester fiber, carbon fiber, polyamide fiber, filled nylon, or aramid fiber thermosets may also be suitable. Some webs have truss elements. Webs may also be made of metal by forming arts such as casting, extruding, folding, pressing and machining operations and may include honeycombing, truss elements, or standoffs designed to reduce the weight of a solid web core.

In monolithic construction, the entire box girder with upper surface, bottom surface and bilateral webs is made of a single material, such as a plastic or a metal. In two-piece sandwich construction, where the web layer is formed as a consolidated projection of either the upper surface or bottom surface of the box girder, the materials of the top and bottom layers may be different. For example a top plate and web made of fiber-reinforced plastic and a bottom plate made of a metal may be sandwiched together, or vice versa, to form the box girder. A modified monolithic box girder may be formed with web/spacer members or plate members having an aspect ratio or contour height that varies from heel to toe. In a preferred embodiment of a monolithic box girder, the spacer members are honeycombed to reduce weight.

"Upper boot binding" or "boot binding uppers", generally refers to optional elements of a boot binding attached to an integral boot binding lower with fasteners, but may include elements that are molded or otherwise formed in place, and generally includes shaped supports that contact and secure the boot, for example a highback which may be foldable, a heel cup, side rails, and one or more straps, most commonly a heel strap and a toe strap, while not limited thereto. Bails may also be used. The uppers may also include a toe riser formed to the boot, shell, cushioning, and components that are engaged when the boot is inserted. These elements are generally formed of assemblies separable and distinct from the integral boot binding lower, for example aluminum, titanium, and steel (used in hardware, ratchets, heelcups, cables, baseplates, highbacks, etc), neoprene rubber, silicon rubber, low density polyethylene, polypropylene, fiberglass, nylon, filled nylon, leather, fabrics, stitching, EVA foam padded cores, and the like, with associated hardware for fastening. The boot binding uppers provide adjustable stiffness to the boot binding when attached to a rigid integral boot binding lower and thus contribute to the torsional stiffness of the boot binding as a whole. Selected upper elements are typically adjustable, for example the heel cup, allowing fitting for boot size and personal adjustment within the underlying limits of the design. The boot binding uppers are not the upper binding baseplate or "tray" of the prior art (compare elements 7, 60, 61 and 62 of FIG. 19 with item 32 of FIG. 4B.

Optionally, several sizes of boot binding lowers are made available for riders of various size or age, and these are further personalized by the selection of elements of the boot binding uppers. All boot binding lowers have identical bottom plate channel dimensions.

Receiving and grippedly conjoining: refers here to the action of slidingly and reversibly engaging a mounting block assembly or "slider track" with the adaptor mounting plate of the prior art or by a box girder with box-ended channel and internal flanges so as to conjoin two ski members in snowboard riding configuration. In the inventive device of Example 1, for example, the box-ended channel formed in the box girder of the integral boot binding lower flangedly interlocks with flanged surfaces of the mounting block assembly. In a preferred embodiment, the box end of the box-ended channel prevents the integral boot binding lower from slipping over the mounting block elements from the heel. A transverse pin or other locking means may be used to secure the boot bindings at the open end of the box-ended channel at the toe. When this locking means is opened, the boot bindings may be slidingly removed from the mounting block assembly.

Adaptor mounting plate: refers to an intermediate mechanical device of the prior art for securing a 3- or 4-hole disk-mounted boot binding to the snowboard mounting blocks and ski touring tabs on a ski, snowboard, or splitboard. In its preferred configuration, the adaptor mounting plate, or "slider plate", consists of an anodized C-channel press folded from an aluminum alloy plate. In the prior art, the adaptor mounting plate (FIG. 4B, item 40) is part of a stack of mechanical elements and supports a separate mechanical member termed an "upper binding baseplate" or "tray" (FIG. 4B, item 32) which conventionally forms the boot contacting surface. The tray is generally an aluminum or plastic molded piece to which the boot binding uppers (heel cup, ankle strap, toestrap, highback, etc) are attached. Clamshell adaptor plates have also been used.

Four-hole disk: a component of a conventional snowboard binding that mechanically couples the body of the tray to the board. The four-hole disc is circular and can be rotatingly coupled to the binding, thus allowing the rider to select an angle of placement for each foot with respect the longitudinal axis of the board. Three-hole disks have also been used.

Highback: An element that extends from the heel up the calf in part, and serves as an ankle brace to control the heel and leaning on turns, and can be rigid, semirigid, or flexible. The highback can also used to secure the boot into the boot binding upper in some step-in boot bindings. Highbacks typically have a pivot that allows them to be laid flat, decreasing the amount of storage space needed for the boot bindings.

Aspect Ratio: defined conventionally as unit height (or thickness) per unit width (or length). The aspect ratio of a top or bottom plate member may be generally constant and the aspect ratio of a web member may be generally variable over the length or width of the binding, as results in contouring and tapering of the variform box girder. The aspect ratio of the web members may be modified or selected to be different from the aspect ratio of the plates as required. In some instances, the aspect ratio of the web member is a constant, in other instances the aspect ratio is variable, but the aspect ratios of the web members and the plate members are not uniform or equal because the dimensions of the web members are selected to serve functions distinct from those of the plates. For example, the aspect ratio of the web member may be varied to permit a tapered width of the binding (while maintaining a constant bottom channel width), whereas the plate members may have a thinner, more uniform aspect ratio. The aspect ratio of the web members may be varied independently of the aspect ratio of the plate members.

Material properties: refers to properties of materials that vary from material to material, for example hardness, density, modulus of elasticity, tensile strength, wear properties, fatigue resistance properties, and so forth. Material properties may be uniform from member to member, as in a monolithic article cut from a single block or an article folded from a single sheet, or may be different. The material properties of aluminum, for example are different from the properties of UHMWPE, or filled plastic, or steel, for example. Substituting one material for another results in a member having different material properties.

Torsional stiffness: in its simplest engineering analysis, torsional stiffness can be approximated by a form of Hooke's law relating torque to deformation:

$$T=K*\Delta\theta \qquad \text{(Equation 1)}$$

where T is torque, K is a spring constant reflecting the stiffness, and $\Delta\theta$ (theta) is the angular deformation or displacement relative to the heel pivot. A more complex model including elastic shear modulus, loss shear modulus, and dampening coefficients may also be formulated. Considering only the box girder, a preferred level of torsional stiffness is in the range of 150 to 300 in-lb/degree when taken as rotation of the box girder mounted on a pair of mounting blocks to a splitboard. A corresponding preferred level of torsional stiffness taken for the binding interface as a whole (i.e. with boot and boot binding upper) is in the range of about 50 to 150 in-lb/degree, most preferably in the range of 70-130 in-lb/degree. The composite stiffness of the boot with boot binding upper is typically less than the stiffness of the box girder so as to permit a greater range of ankle motion. An increase or decrease in torsional stiffness of 50% is highly significant and is readily perceptible to a rider.

Foot roll: is a term used in the art to denote the freedom of angular leg movement experienced by a board rider. The rider uses foot roll to shift the pressure or "bite" of the board on the underlying snow and to control the ride. Foot roll is essentially the "$\Delta\theta$" in the equation for torsional stiffness. Optimizing the stiffness factor K, optimizes the control of the ride achieved with foot roll.

"About" and "generally" are broadening expressions of inexactitude, describing a condition of being "more or less", "approximately", or "almost" in the sense of "just about", where variation would be insignificant, obvious, or of equivalent utility or function, and further indicating the existence of obvious minor exceptions to a norm, rule or limit. "Essentially" indicates a condition of close approximation to a limiting condition, wherein any departure from that limit is not significant.

Herein, where a "means for a function" is described, it should be understood that the scope of the invention is not limited to the mode or modes illustrated in the drawings alone, but also encompasses all means for performing the function that are described in this specification. A "prior art means" encompasses all means for performing the function as are known to one skilled in the art at the time of filing, including the cumulative knowledge in the art cited herein by reference to a few examples.

Unless the context requires otherwise, throughout the specification and claims which follow, the word "comprise" and variations thereof, such as, "comprises" and "comprising" are to be construed in an open, inclusive sense, that is as "including, but not limited to".

2. Detailed Description

Referring now to FIG. 1, this perspective view shows an integral boot binding lower (1) with box girder (2) construction based on the prototype of Example 1. This prototype employs sandwich box girder construction. The box girder consists of three material layers: a top plate (3), a bottom plate (5), and a center "spacer" or core that serves as the side webs (4) of the girder. The box girder may be tapered or untapered.

The top plate and bottom plate shown in this illustration are made of sheet metal as described in Example 1, but may also be made of reinforced plastic composites, either as molded or extruded sheets, or may be machined from metal stock. As shown in this embodiment, folded tabs of the top plate form side rails (6). An optional heel cup (7) may be fastened to the top plate rails. Provision for attachment of a toe strap (11), heel strap (12), and highback (13) are also illustrated. A single hole may be used for both the highback and heel strap.

In this embodiment, the spacer or core web material of the girder is a lightweight material, but carries both compression, tensile, and bearing loads. The aspect ratio of the web elements is varied from heel to toe. The material is characteristically tough and can be machined, drilled or molded. Honeycomb or truss webs are also contemplated. As will be described below, box girders with non-sandwich construction having integral or monolithic web elements may also be used.

Box-ended channel (9) and bottom plate parallel internal flanges (10) form a gripping means that joins the box girder to mated snowboard mounting blocks inserted in the box-ended channel. Structural elements of this embodiment include a means for pivoting the structure at the toe, here indicated by a transverse axial hole (14) for insertion of a toe pivot pin for pivoting as described in FIG. 9B. The toe pivot pin serves a dual function, also locking the snowboard mounting blocks in the box-ended channel as will be shown in FIG. 2.

The integral boot binding lower provides rigidity in joining the two ski members, but also must provide a rigid platform for the boot bindings that secure the boot to the board. Without adequate stiffness in the integral boot binding lower, the torsional stiffness of the upper boot bindings will be correspondingly insufficient.

Note that in the prototype of Example 1, the prior art adaptor mounting plate of FIG. 4B is absent, and there is an integration of the splitboard joining device (here a sandwich box girder with underside box-ended channel and inside flanges) with elements of a boot binding device (upper surface and fasteners).

Figure 2:
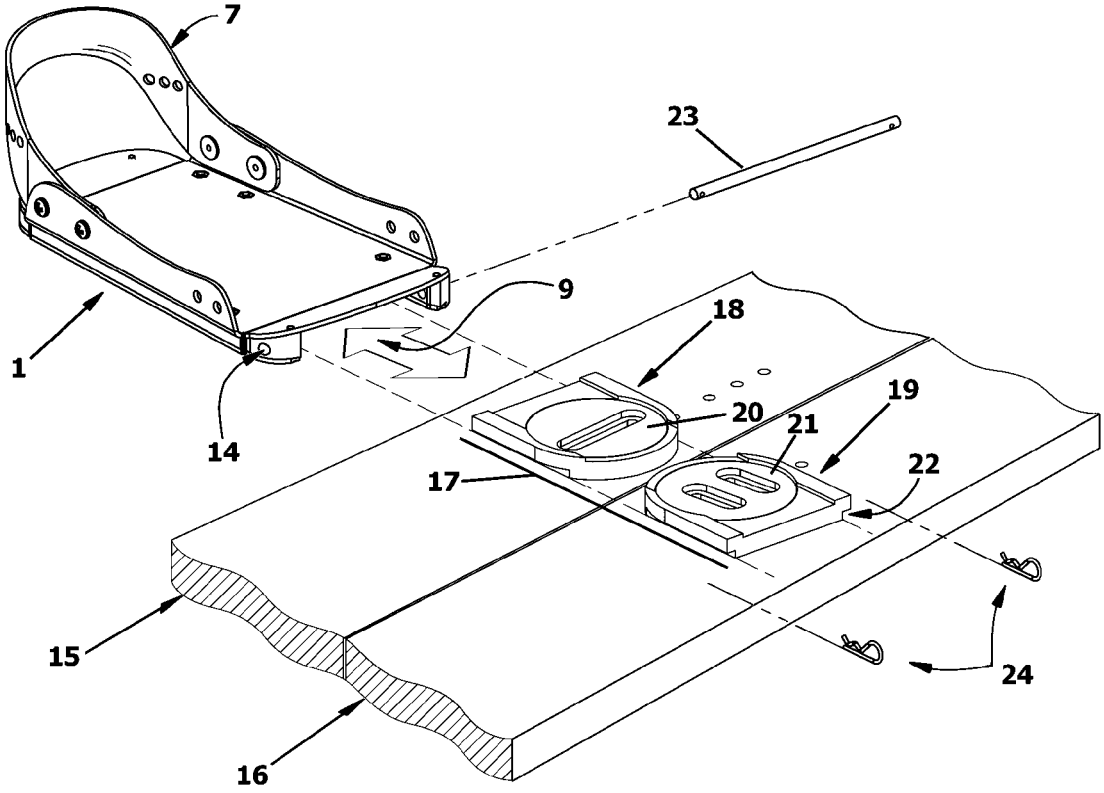
FIG. 2 is a perspective view of an integral boot binding lower with heel cup. The double arrow indicates direction of movement as the boot binding lower slides onto the snowboard mounting block assembly for use in snowboard riding configuration.

The bottom plate (5) of FIG. 1 is machined to form a channel (9) with internal flanges (10), and optionally is a "box-ended channel" as shown. The box-ended channel is open under the toe end of the box girder, but does not extend all the way to the heel, so as to capture a mounting block assembly (17) as shown in FIG. 2. The double arrow shows how box-ended channel (9) slidingly receives and engages mounting block assembly (17) so that the internal flanges of the integral boot binding lower grippingly conjoin the external flanges (22) of the mounting block elements (18, 19), the internal and external flanges becoming interlocked. Note that the external flanges (22) of the two mounting block elements that make up the mounting block assembly are parallel and aligned for engaging the internal flanges (10) of the box-ended channel.

By interlocking the boot binding flanges (10) and the mating external flanges (22) on the mounting blocks (18, 19), the two ski members (15, 16) are rigidly conjoined. The boot bindings and flanges of the box channel are provided with mechanical clearances so that the boot binding reversibly may be inserted onto the mounting block assembly. A toe locking pin (23) inserted at (14) prevents the assembly from slipping and is held in place with snaps (24). Thus in snowboard riding configuration, the sandwich box girder (1) traverses or "straddles" the pair of skis, and flangedly interlocks them in the form of a snowboard, also fixing the boot heel in place. Optional heel cup 7 is shown here for clarity.

A pair of internal pucks (20, 21) are supplied with fasteners for securing the pair of snowboard mounting blocks (18, 19) to the pair of ski members (15, 16), and permit adjustment and alignment for individual fit. The snowboard mounting block assembly (17) is adjusted to the preferred stance or angular orientation of the user and, in one embodiment, may be set up for the position of the user's feet in either a left-foot-forward or a right-foot-forward mode.

Figure 3:
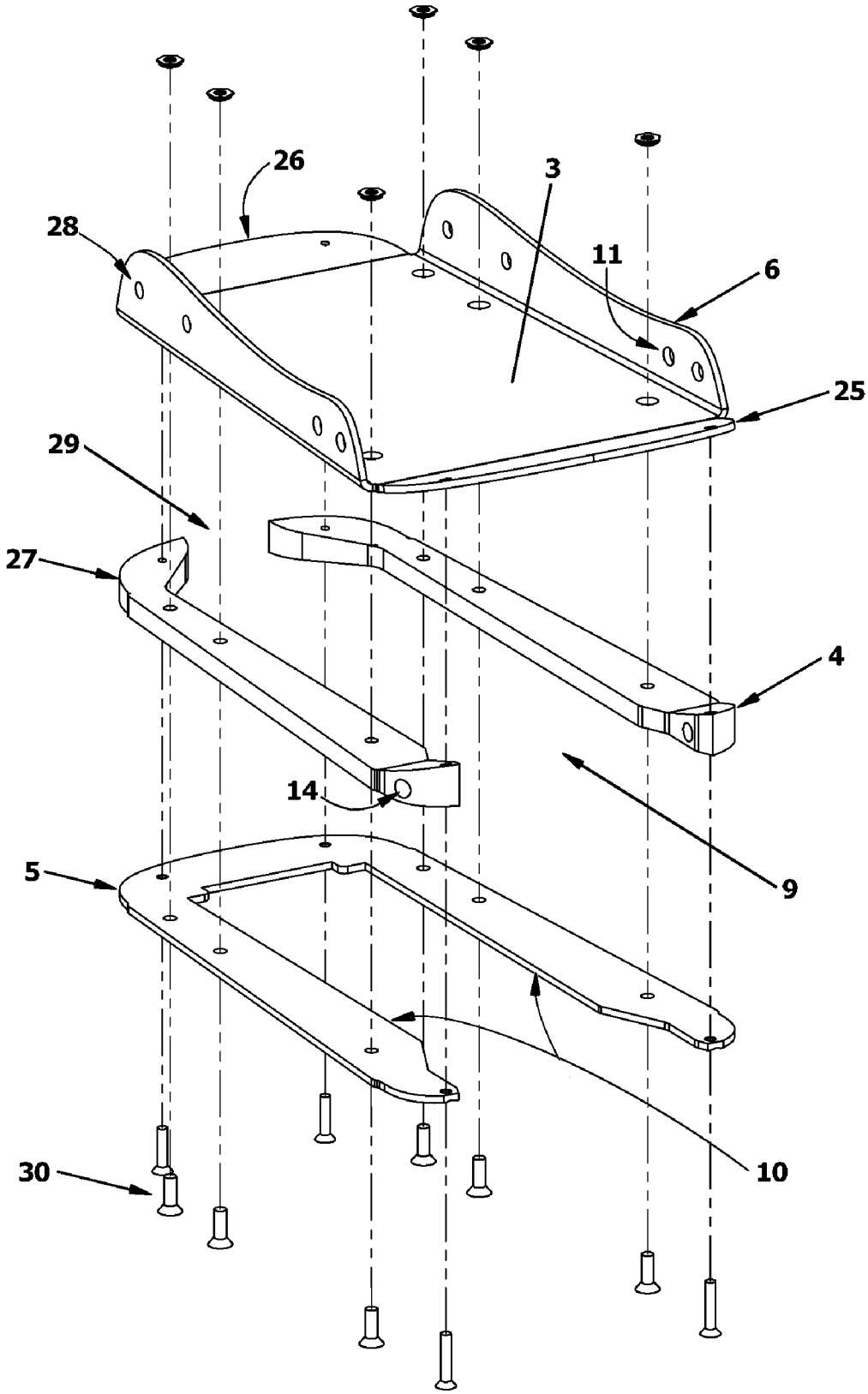
FIG. 3 is an exploded view of a sandwich box girder-type of boot binding lower, with frontal perspective.

FIG. 3 is a construction detail of the integral boot binding assembly of Example 1. Three mechanical elements, the top plate member (3), spacer webs (4, 27) and bottom plate member (5), are clearly shown as forming a sandwich box girder. In this view, the box-ended channel (9, directional arrow) is shown under the toe riser (25) and between the lateral and medial web (4, 27). Correspondingly, a snow vent (29) is formed under the heel riser (26) between the medial and lateral spacers (4, 27). As shown, the webs are provided with a variable aspect ratio, the aspect ratio of the plate members and the web members being clearly distinct and different. The web elements are also contoured to mate with folds in the undersurface of the top plate for forming a toe riser (25) and heel riser (26). By varying the aspect ratio and contour of the web elements from heel to toe, a variform girder adapted for supporting and securing a rider's boot is formed. The truss-like character of the box girder is strengthened by multiple fasteners (30) extending through the sandwich. Adhesives, lamination, metal extrusion or folding arts, or solvent welding may also be used to form the sandwich box girder, eliminating the need for fasteners.

Also adding to the truss character are the upward-folding side rails (6) of the top plate member. The top plate may also be used to make provision for attachment of elements of the boot binding upper with fasteners. Provision for attaching a toe strap is provided at 11, and for a heel cup at 28 on the optional top plate side tabs or rails (6).

FIGS. 4 and 5 provide comparative views of the embodiment of Example 1 with a boot binding of the prior art (referencing U.S. Pat. No. 5,984,324). FIG. 4A again shows the basic construction of the integral boot binding lower of Example 1, but from a heel view. Shown are the three elements of a sandwich box girder: top plate member (3) or surface, joining webs (4, 27), and bottom plate member (5), with fasteners (30).

For comparison, a prior art design is shown in the accompanying panel, FIG. 4B. In this side-by-side exploded view, differences are readily seen between the sandwich box girder integral boot binding lower of Example 1 and the prior art design of U.S. Pat. No. 5,984,324. An essential element of the most popular prior art design is the adaptor mounting plate (40), which is an anodized C-channel, typically formed by folding a perforated aluminum alloy sheet. This adaptor mounting plate has flanges (42) that grippingly conjoin the mounting block assembly (with flanges 22, as shown in elevation in FIG. 5B). The prior art assembly also dictates a 4-hole disk (31) used as a universal mount for the sort of soft boot upper binding baseplate illustrated here by 32. Provision is made for attaching boot straps (38, 37) and for a heel cup (36) on side rails (35). The boot binding upper is fitted individually per foot, shown here with a left toe riser (33) and a heel riser (34). By industry standard, the 4-hole disk fasteners (44*s*, 44*w*) are at 4 cm corners. Tee nuts (44*n*) are used to secure the boot binding to the adaptor mounting plate. A gasket (39) is used to fit the boot binding upper (32) to the adaptor mounting plate (40). Note the heel stop tab (43) and the toe pivot axis (41), two areas where the adaptor mounting plate is very prone to metal fatigue.

Comparing FIG. 4A with FIG. 4B), the adaptor mounting plate has been eliminated in the prototype of Example 1. An integral boot binding lower, here a modified sandwich box girder, takes its place. The box girder of the integral boot binding lower serves in snowboard configuration both to conjoin the two ski members and to provide a rigid platform for supporting the elements of the boot binding upper. However, the design has other advantages as well, as become apparent by comparison.

FIG. 5B is an elevation view of the heel of the prior art boot binding with adaptor mounting plate (40) mounted in snowboard riding configuration. The flanges (42) of the C-channel can be seen gripping mated flanges (22) on the filled nylon mounting block element (18). Also visible is a puck assembly (20), although the inner assemblies are obscured by the heel stop tab (43).

The soft boot binding upper baseplate (32), side rail (35) and an optional heel cup (46) can also be seen in this view. The heel riser (34) partially obscures the toe riser (33), which is higher for the left big toe. Boot bindings optionally may be designed to accept only a left or right foot, or may be interchangeable.

Note the height of the baseplate (32) above the upper board surface (15) and compare with FIG. 5A, which is an elevation view of the heel of the embodiment of Example 1. The play of mechanically stacked elements 18, 20, 22, 42, 40, 32 and 39 of FIG. 5B is eliminated in the design of FIG. 5A. In FIG. 5A, elements 18, 20, and 22 connect directly with the boot binding lower elements 5 and 10, and the rest of the structure is rigidly formed around those impinging flanges. Clearances are provided for insertion of the binding onto the flanges, but the bottom plate flanges of the box girder contact the upper surface of the board on application of foot roll, as necessary for efficacious torsional stiffness. Optionally, compliant shims or "pads" may be mounted on the bottom flange surfaces to take up excess clearance.

FIG. 5A again also shows a sandwich construction (2) of bottom plate (5), web (4) and top plate (3). Side rails (6) and heel cup (7) provide added stiffness. Visible under the heel riser (26) is an open space bounded on the left and right by the webs (4, 27). This gap is the snow vent (29), which keeps the mechanism free of impacted snow.

Figure 6:
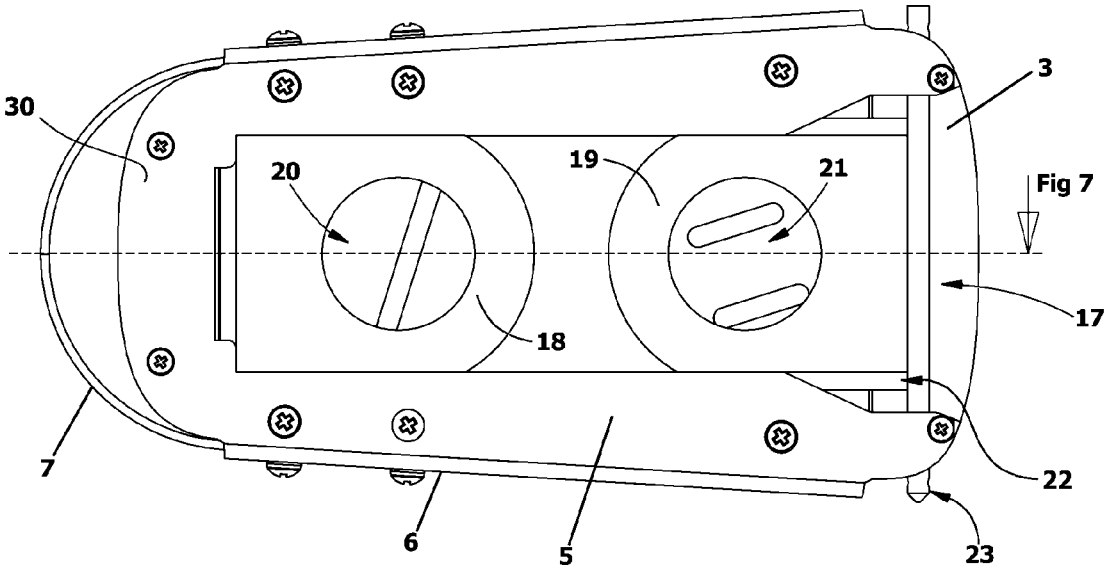
FIG. 6 is a plan view drawn from the underside of an integral boot binding lower.

FIG. 6 views the construction of the box girder from the underside. The bottom plate (5) is observed to overlap flanges (22) on the snowboard mounting block elements (18, 19) of the mounting block assembly (17). The pucks (20, 21) engage the top face of the board which attaches to the underside of the mounting blocks (hardware not shown). The side rail (6) of the top plate (3) is also visible, as is the band of metal forming the heel cup (7). The snowboard mounting blocks are chocked against the heel crosspiece (30) of the bottom plate, and are locked from forward motion by the toe pivot and locking pin 23.

Figure 7:
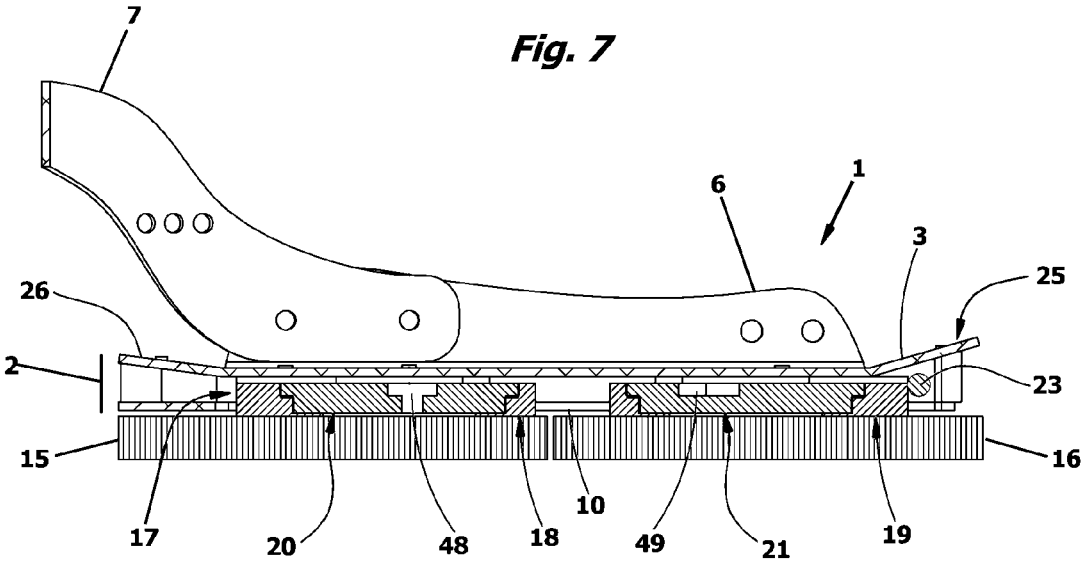
FIG. 7 is a longitudinal section, with elevation, taken as noted on FIG. 6.

Also shown in FIG. 6 is the plane of a longitudinal section taken for FIG. 7. FIG. 7 includes parts of the elevation view for clarity. In section, the box girder, consisting in this embodiment as a sandwich box girder (2), is seen extend across two ski members (15, 16) and is held in place on the snowboard mounting block assembly (17). Two mounting blocks (18,19), one on each ski, are locked between the heel of the box girder and toe pivot and locking pin (23) underneath the toe riser (25).

The adjustment of the pucks to position and align the mounting block elements is provided for by screws in slots 48 and 49 of the sectional view (not shown: the screws mate with threaded inserts embedded in the ski members).

Figure 8:
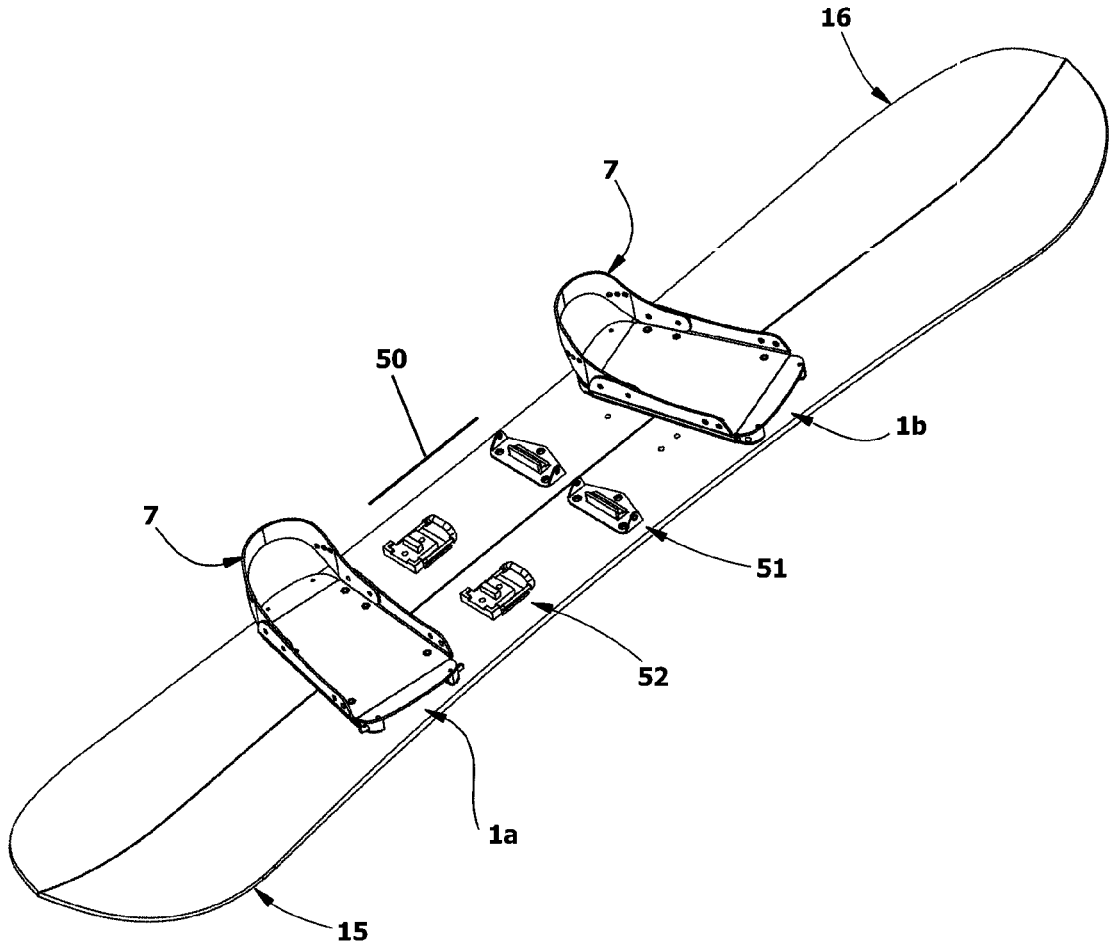
FIG. 8 is a sketch of a pair of integral boot binding lowers, with heel cup, straddling a splitboard in snowboard riding configuration. The toe pivot and climbing bar hardware used with the boot binding lowers in ski touring configuration are also shown.

FIG. 8 shows a fully assembled splitboard having integral boot binding lowers in the snowboard riding configuration. Two ski members (15, 16) are conjoined at a pair of mounting block assemblies by integral boot binding lowers of the invention. Heel cups (7) are shown for clarity.

Also shown are the hardware assemblies used in ski touring mode, which are more centrally placed on the ski members. Item 51 is a ski toe pivot assembly; item 52 a ski heel rest and climbing bar assembly. These two assemblies form the ski mounting assembly (50), which is used in ski touring configuration, as will be discussed next. The user may readily remove the boot bindings from the snowboard boot mounting block assemblies and reattach them to the ski mounting assembly. The binding assemblies of the invention permit rapid tool-free conversion from the ski mode to the snowboard mode, or vice versa.

Figure 9A:
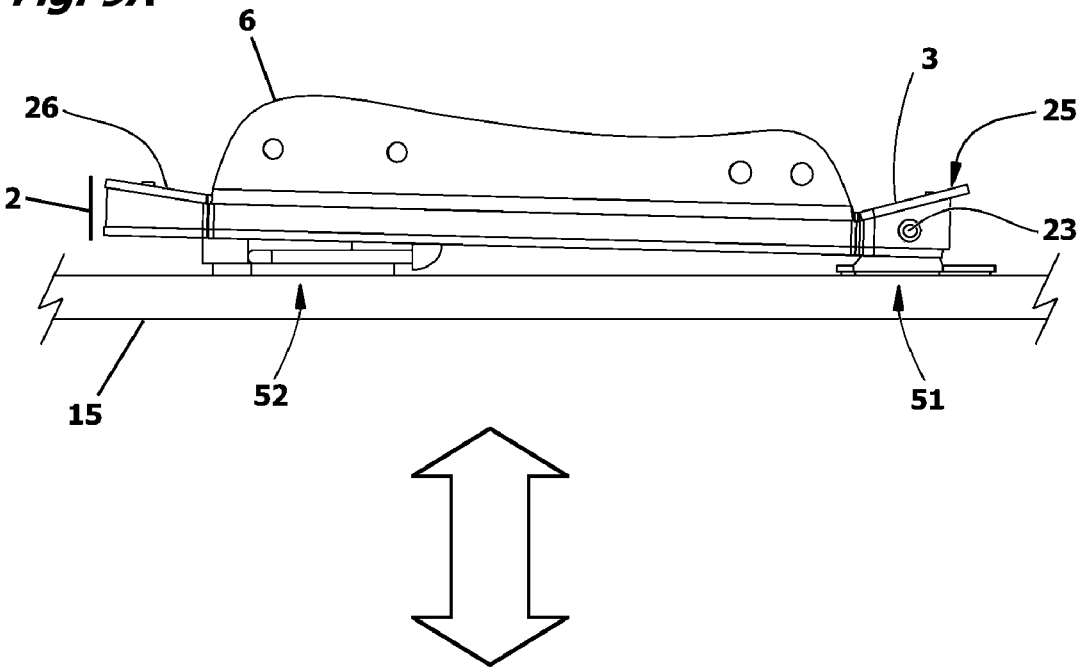
FIG. 9 is an elevation view of the free heel "telemark" pivot action of a boot binding lower of Example 1 attached to a toe pivot pin assembly.

FIGS. 9A and B are a combination of elevation and action views showing an integral boot binding lower of Example 1 at rest on a ski (15) in the ski mounting assembly introduced in FIG. 8. The toe of the sandwich box girder (2) is secured with a pin (23) through the webbing under the toe riser (25), which engages a toe pivot mounting cradle and block (53, 54) of the ski toe pivot assembly (51). Under the heel (26), a heel rest and climbing bar assembly (52) support the boot binding off the surface of the ski. The climbing bar assembly consists of a climbing bar (55), which is hinged, and a heel rest pad (56).

Figure 9B:
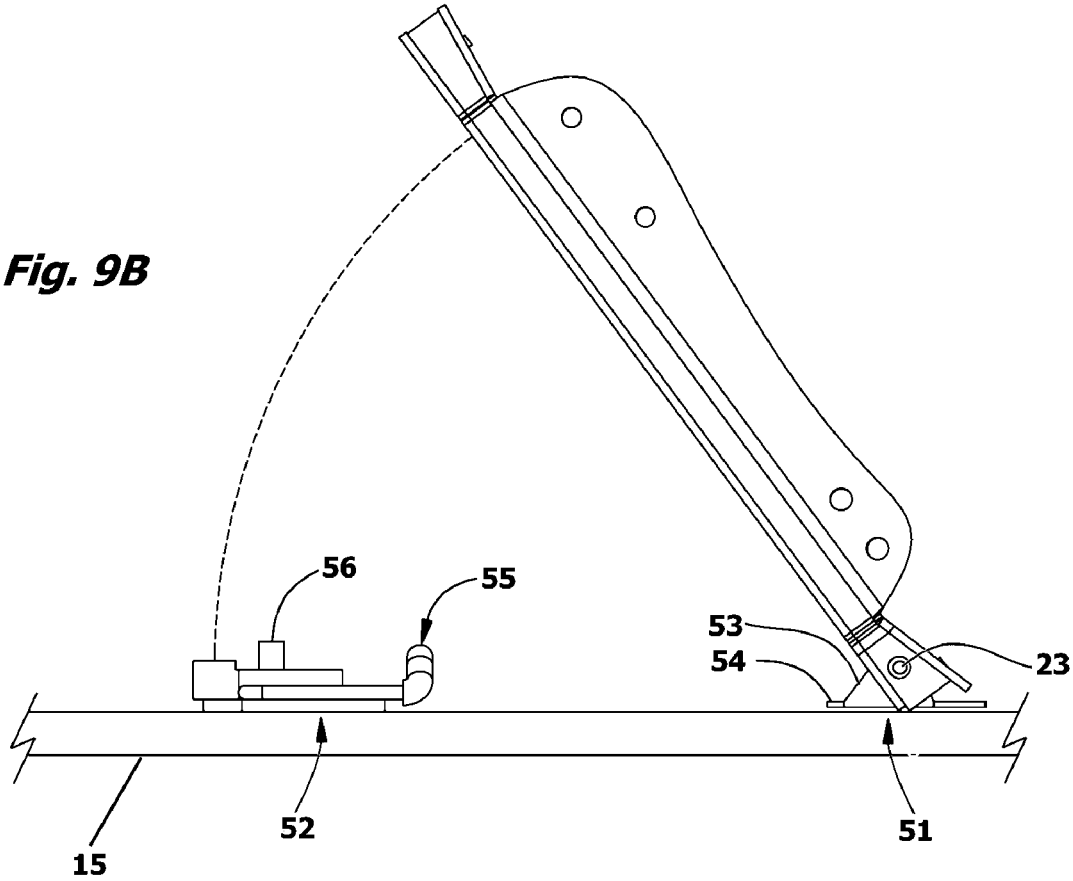

The functional mechanism is revealed in more detail in the lower panel (FIG. 9B). The skier can alternate (double arrow) from heel stance (as shown in the top panel) to telemark stance (as shown in the lower panel). In telemark stance, partial weight is resting on the toe pivot cradle and pin. The life and performance of this hardware is dramatically improved in the prototype of Example 1, through use of a longer pivot pin (23), the thick webs of UHMWPE to lubricate the pin, and a wider mounting area to distribute the weight. The thickness of the webs is typically greater than the thickness of the upper or bottom plates, providing an improved bearing surface for the pivot pin.

Figure 10:
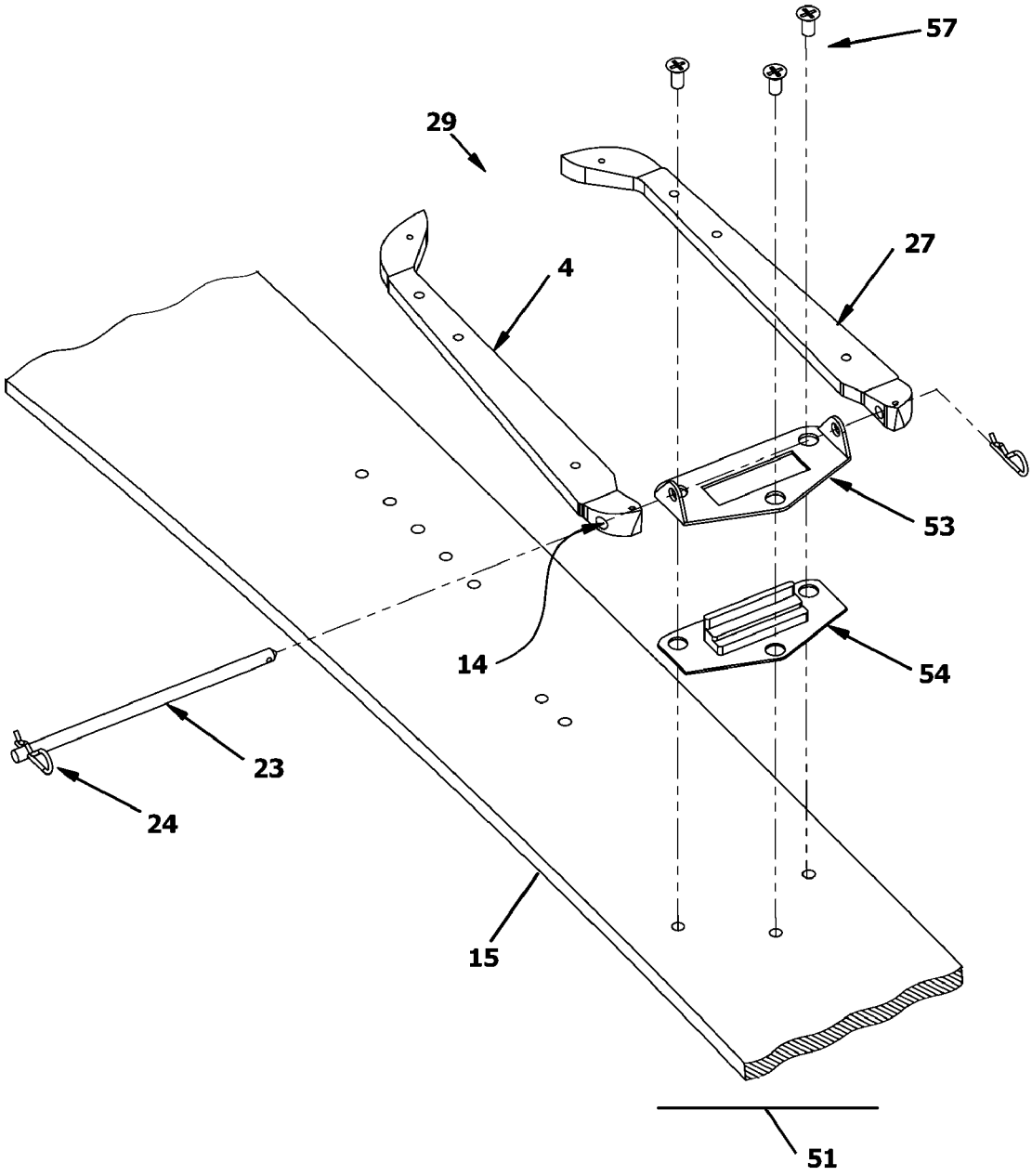
FIG. 10 is an exploded view showing a toe pivot mechanism.

In FIG. 10, an exploded view is used to better show an example of improvements in the toe pivot assembly (51). The two webs of the box girder (4, 27) pivot at 14 on pivot pin (23), which is clasped in place with cotter pins (24) or similar fasteners. The fulcrum of the pivot runs through toe pivot pin cradle (53), which is supported by a plastic molded block (54). The elements of the fulcrum are affixed to the ski (15) with 3 mounting fasteners (57).

Figure 11:
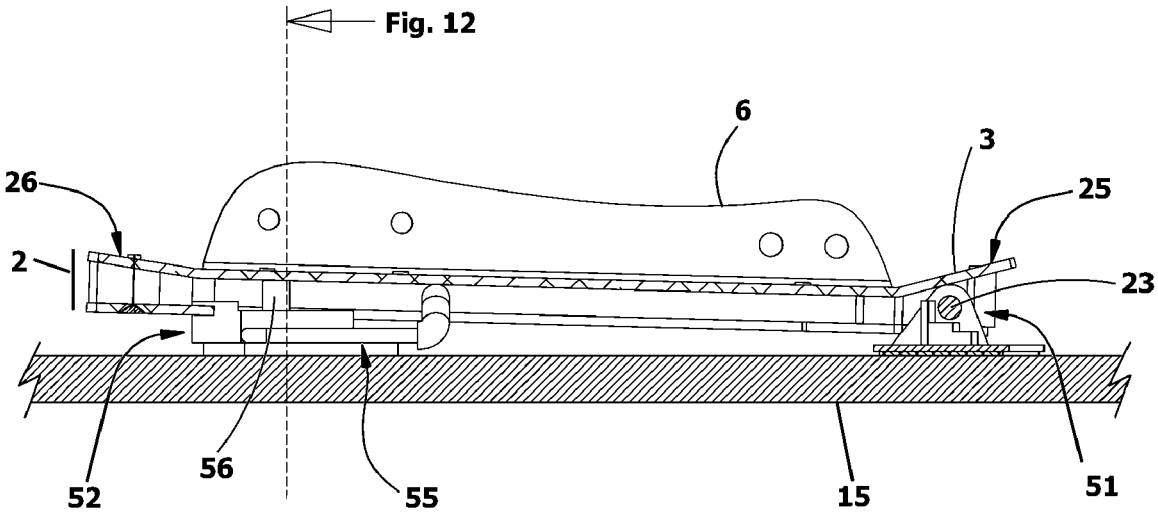
FIG. 11 shows a longitudinal section of an integral boot binding lower mounted in ski touring mode. Shown are mechanical details of a toe pivot and climbing bar assemblies with the climbing bar down. The location of the transverse section of FIG. 12 is also shown.
Figure 12:
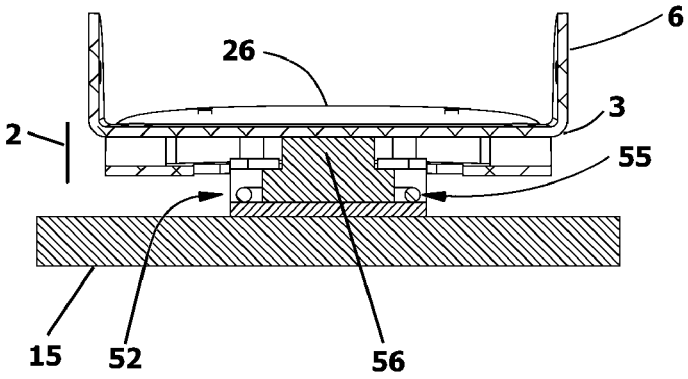
FIG. 12 shows a transverse section through the heel of a boot binding lower mounted in ski touring mode with the climbing bar down.

In FIG. 11, the elements of the ski mounting assembly are shown in longitudinal section. The location of the transverse section for FIG. 12 is also shown. The longitudinal slice cuts the ski (15) toe assembly (51) and heel assembly (52). The pivot pin or axle (23) is located in the web below toe riser (25), and is sandwiched between the bottom and top plates (3, 5).

At the heel (26), climbing pin assembly (52) consists of a heel rest pad (56) and climbing bar (55). In FIG. 12, the corresponding transverse section through the heel, contact is seen between the heel rest pad and the bottom surface of the top plate (3). The heel rest lies entirely within the box-ended channel (9) of the full assembly. An indication of the hinged nature of the climbing bar is suggested.

Figure 13:
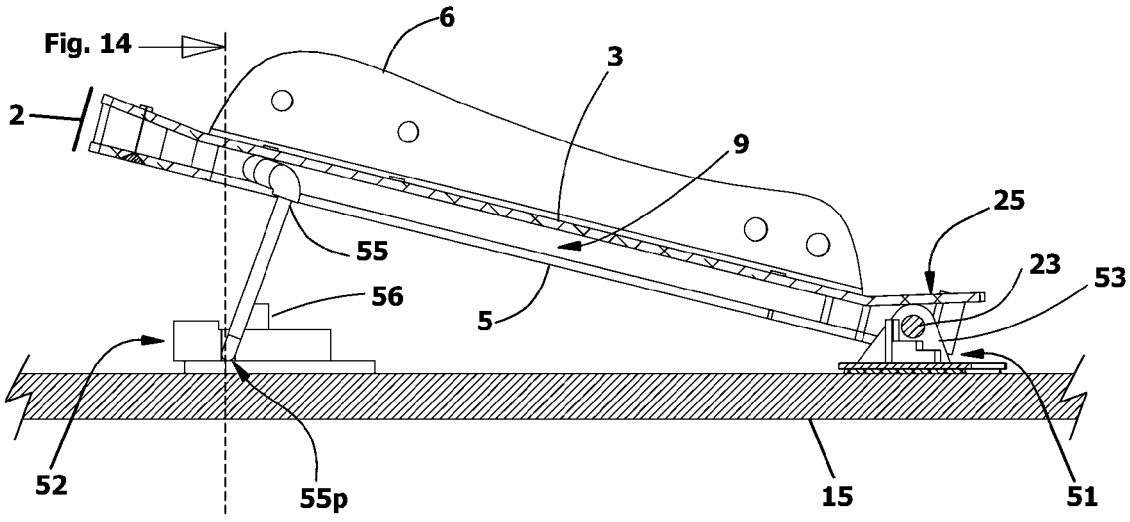
FIG. 13 shows a longitudinal section of an integral boot binding lower mounted in ski touring mode. Shown are mechanical details of a toe pivot and climbing bar assemblies with the climbing bar up. The location of the transverse section of FIG. 14 is also shown.
Figure 14:
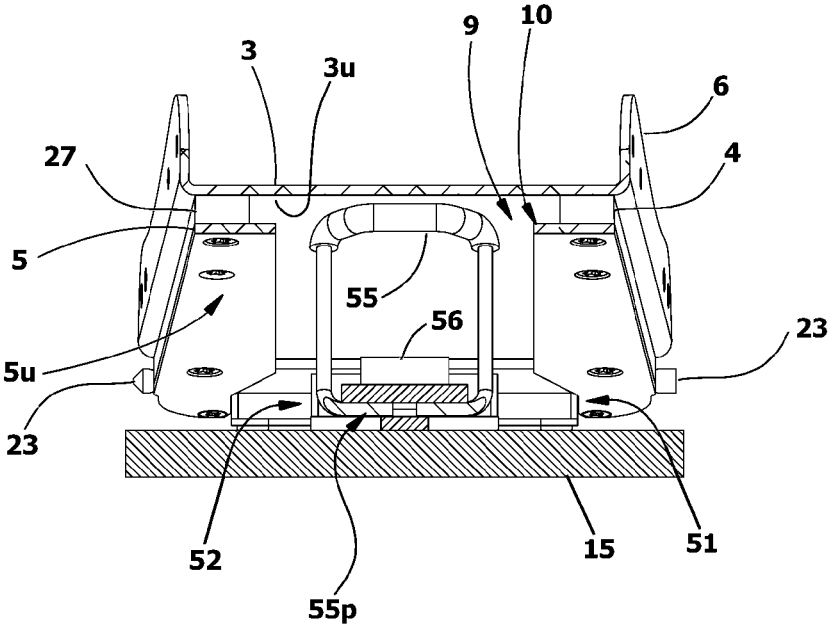
FIG. 14 shows a transverse section through the heel of a boot binding lower mounted with the climbing bar up for ski touring mode.
Figure 15:
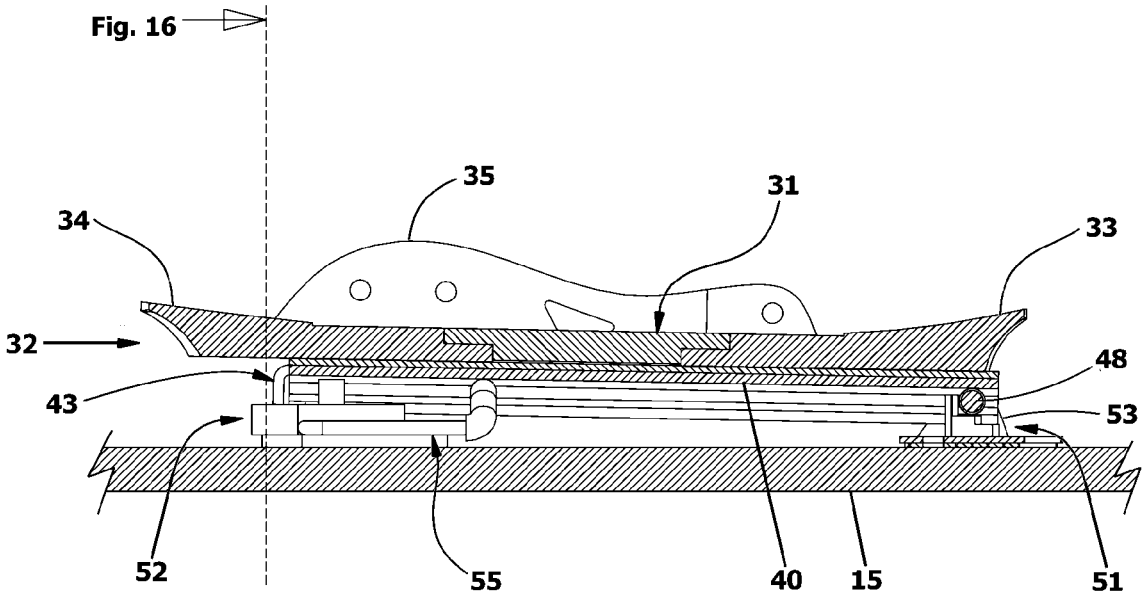
Fig. 15 (Prior Art)
FIG. 15 shows a longitudinal section of a boot binding of the prior art mounted in ski touring mode. Shown are mechanical details of the toe pivot and climbing bar assemblies with the climbing bar down. The location of the transverse section of FIG. 16 is also shown (per U.S. Pat. No. 5,984,324).
Figure 16:
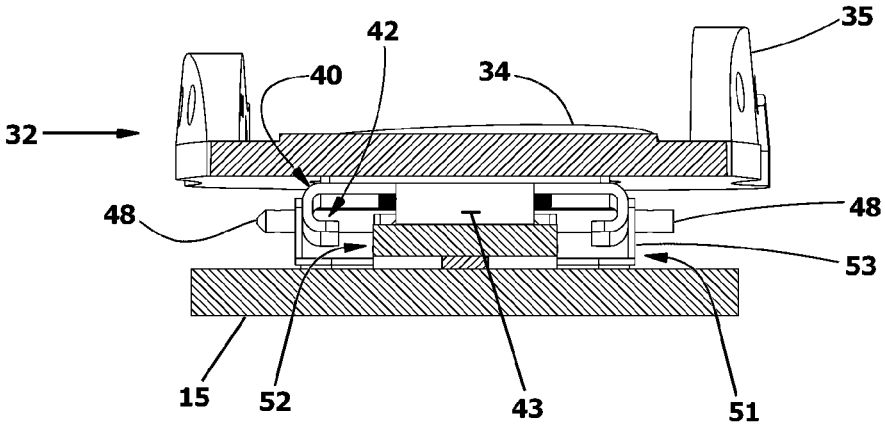
Fig. 16 (Prior Art)
FIG. 16 shows a transverse section through the heel of a boot binding of the prior art mounted in ski touring mode with the climbing bar down.
Figure 17:
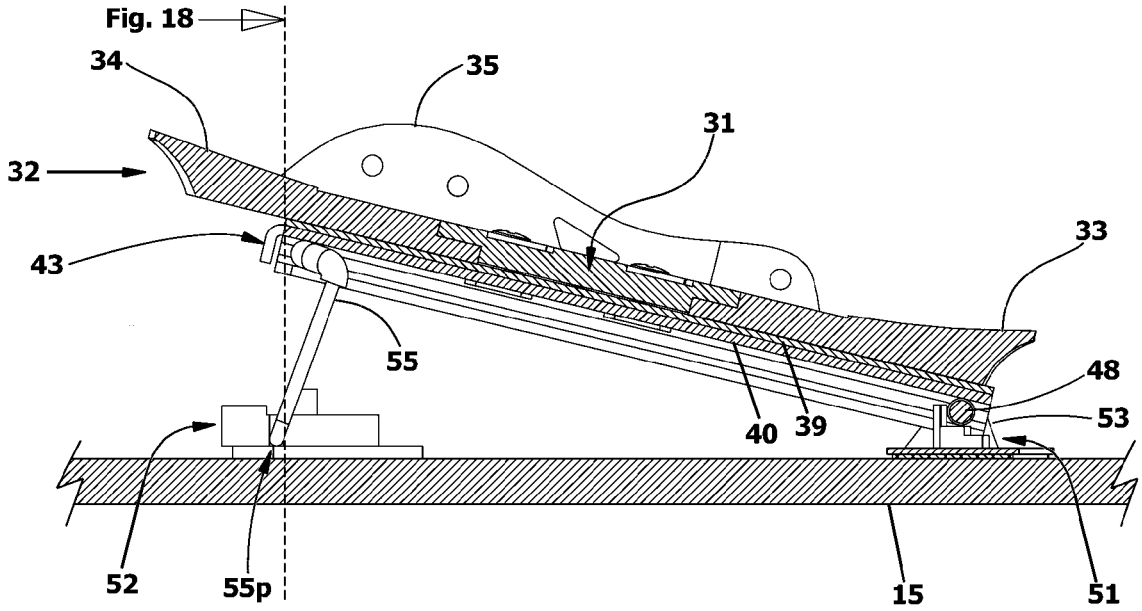
Fig. 17 (Prior Art)
FIG. 17 shows a longitudinal section of a boot binding of the prior art mounted in ski touring mode. Shown are mechanical details of the toe pivot and climbing bar assemblies with the climbing bar up. The location of the transverse section of FIG. 18 is also shown (per U.S. Pat. No. 5,984,324).

In FIGS. 13 and 14, the action of the climbing bar (55) is better illustrated. The hinge or pivot point of the climbing bar is formed by bending paired "ells" in the steel bar (55*p*) and clipping them into the base block of the climbing bar assembly, which also serves as the heel rest pad (56). Heel rest pad or 56 squarely contacts the underside of the top plate (3*b*). The underside of the bottom plate (5*b*) extends forward and behind the climbing bar assembly without interference. Medial and lateral webs (4, 27) and toe pivot pin (23) are also shown in this cutaway view.

Figure 18:
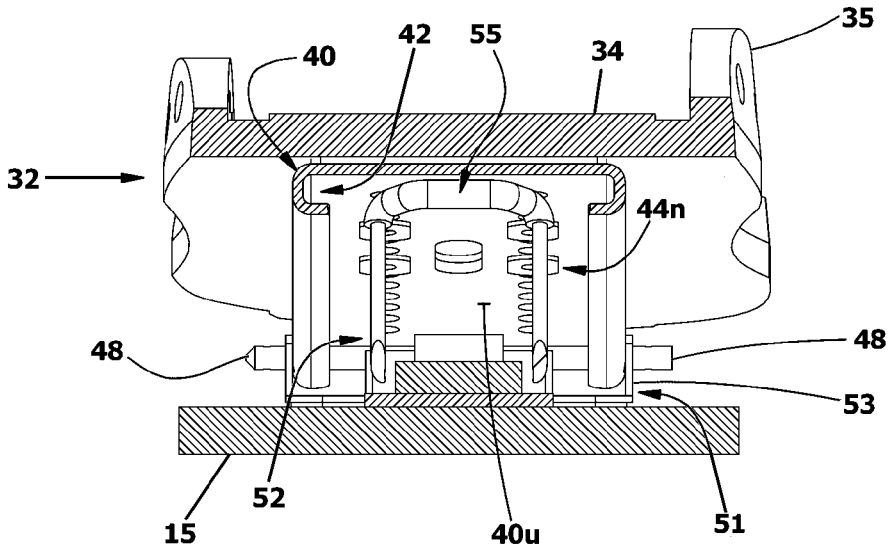
Fig. 18 (Prior Art)
FIG. 18 shows a transverse section through the heel of a boot binding of the prior art mounted with the climbing bar up for ski touring mode.

FIGS. 15 through 18 are comparative views of the ski mounting assembly of the prior art. Some elements are used in common. These include a toe pivot assembly (51) and a climbing bar assembly (52), but differences can be noted, for example by comparison of FIG. 18 with FIG. 14. Note the wider support base in FIG. 14 (Example 1) as compared to the prior art (FIG. 18). Pivot pin 48 is clearly shorter than pivot pin 23. Also note the rest point of the heel stop tab (43, FIG. 16) of the prior art (a folded tab of metal) on a facet of the climbing bar housing (52). No other contact point is provided. Interestingly, the metal tab is prone to soften adjacent to the fold where it is work hardened and has been observed to break off with continued use.

FIG. 18 is also instructive. When compared to FIG. 14, it is clear that the prior art boot binding, at toe stance on the climbing bar, is much higher off the board than in the mechanism of Example 1. The narrowness of the toe pivot fulcrum (51, 48) is also apparent.

Figure 19:
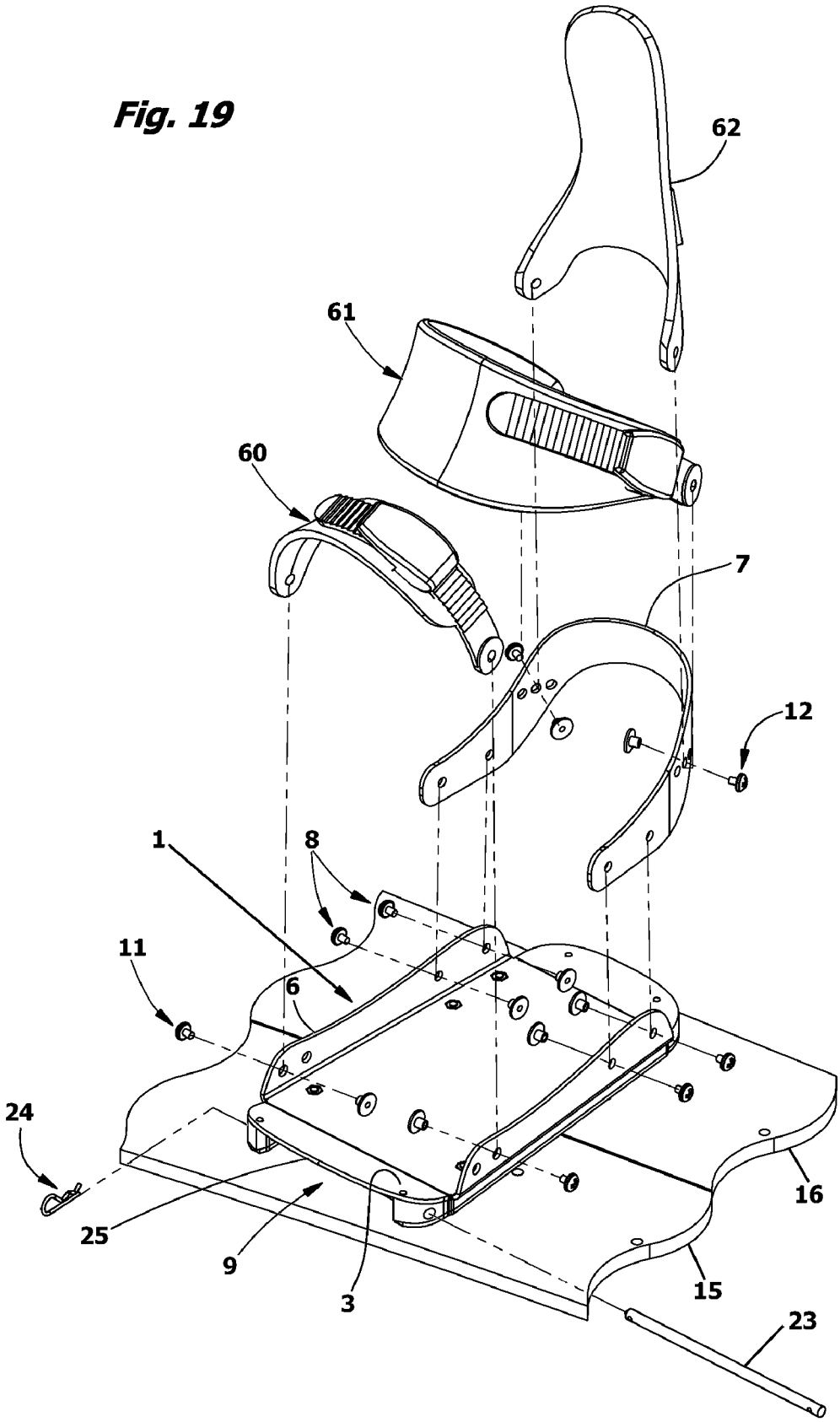
FIG. 19 is an assembly view of typical elements of a boot binding upper on the integral boot binding lower of FIG. 3.

FIG. 19 demonstrates how the completed boot binding of Example 1 was fabricated. The integral boot binding lower (1) is shown fully assembled, as in FIG. 3. Under it, inside box-ended channel 9, the two ski members (15, 16) are conjoined by its grip on the snowboard mounting block elements as shown in FIG. 2. The completed assembly is then locked in place with toe pivot and locking pin (23) running through the toe riser (25). In this example, the elements of a boot binding upper consist of: heel cup (7), toe strap (60), ankle strap (61), and highback (62). Fastener 12 secures the ankle strap and high back to the heel cup in any of the three placement holes shown. Fasteners (8) secure the heel cup to the side rails (6) of top plate (3). Fasteners (11) secure the toe strap to the side rails.

Figure 20:
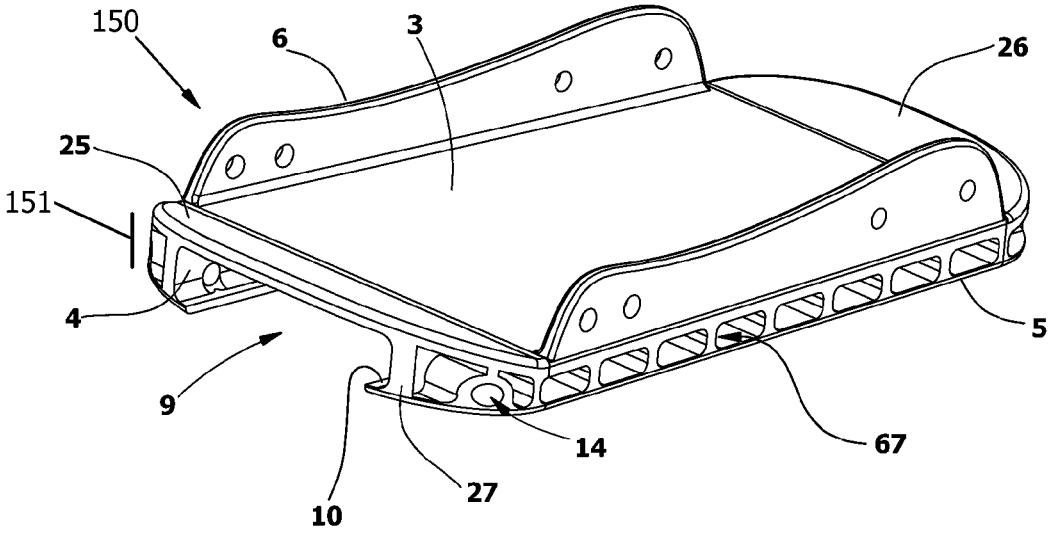
FIG. 20 is a view of the upper surface of a boot binding lower of the invention, but designed to be manufactured by injection molding as a single piece-monolithic unit. Note the optional honeycomb webbing.
Figure 21:
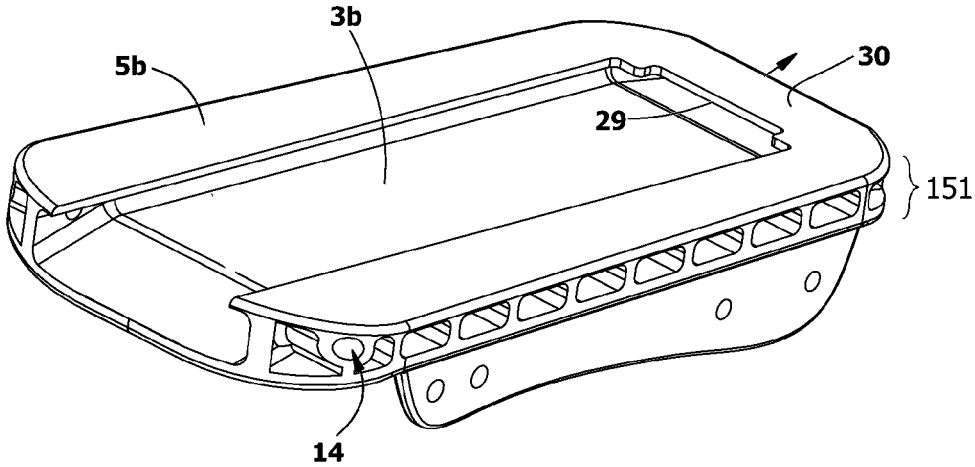
FIG. 21 is a view of the bottom surface of a monolithic boot binding lower of FIG. 20.

As first disclosed in U.S. Provisional Patent Application 60/792,231 (filed 14 Apr. 2006, this filing having priority thereto, and incorporated herein in full by reference), FIGS. 20 and 21 illustrate an alternate embodiment for the integral boot binding lower (150). While the key elements of the box girder (151) are present: top plate member (3) with upper surface, bottom plate member (5) with bottom surface, lateral web (4) and medial web (27), the webs are honeycombed (67) and are no longer made of sandwich materials. Channel internal flanges (10) perform the same function as in the embodiment of FIG. 1 (item 10), i.e., mating with the corresponding external flanges of the mounting blocks as shown in FIG. 2 (item 22). The underside view (FIG. 21) shows the correspondence of the features more clearly, and can be compared with FIG. 6 of the embodiment of Example 1. The bottom surface (5*b*) and underside (3*b*) of the upper surface are visible. The outside edges of the bottom flanges serve to contact the splitboard face. Also shown is the structure of the snow vent (29) with crosspiece (30) joining the flanges of the bottom surface, and toe pivot transverse mounting hole (14). The crosspiece forming the snow vent is the box-end of a box-ended channel used to secure the snowboard mounting blocks. When inserted, the toe pivot pin locks them in place as shown in FIG. 2.

Injection molding a unitary boot binding lower offers full integration of the dual functions of the rigid box girder with upper surface modifications for supporting and securing the rider's boot and lower surface modifications for gripping and conjoining the mounting blocks on the splitboard halves. With fiber-reinforced materials, for example nylons, significant weight savings is possible without sacrifice in strength. Wider, webbed beam/girder designs with reduced or zero freespace between girder and board upper surface reduce narrowly focused loads on the plastic external flanges of the mounting blocks, and on the collars of the ski pivot pin, thus realizing the first practical designs of splitboard boot bindings for injection molding. A molded plastic integral boot binding lower weighing less than 500 grams, more preferably less than 300 grams, is achieved.

As used herein, the terms "plastic" and "molded plastic material" include any thermoplastically processable resin. Examples of suitable thermoplastic resins include, but are not limited to, nylons such as 6,6-polyamide, 6,12-polyamide, 4,6-polyamide, 12,12-polyamide, 6,12-polyamide, and polyamides containing aromatic monomers, cyclic olefins, polybutylene terephthalate, polyethylene terephthalate, polyethylene napththalate, polybutylene napththalate, aromatic polyesters, liquid crystal polymers, polycyclohexane dimethylol terephthalate, copolyetheresters, polyphenylene sulfide, polyacylics, polypropylene, polyethylene, polyacetals, polymethylpentene, polyetherimides, polycarbonate, polysulfone, polyethersulfone, polyphenylene oxide, polystyrene, styrene copolymer, mixtures and graft copolymers of styrene and rubber, and glass reinforced or impact modified versions of such resins. Blends of these resins such as polyphenylene oxide and polyamide blends, and polycarbonate and polybutylene terephthalate, may also be used in this invention. The thermoplastic resins may also contain various types of reinforcements or fillers. Fiberglass or carbon fiber may be used for reinforcement of plastics. Various colored pigments may be added to the resin, such as titanium dioxide. Clays, calcium phosphate, calcium carbonate may be used as bulk fillers, and many other fillers such as talc and mica may be used to reinforce the material, to add strength or to modify other properties of the finished product such as stiffness. The resins may also contain plasticizers, and heat and light stabilizers. The amount of reinforcements or filler used may vary from about 1 to 70 weight percent based on the weight of the polymer and filler present. A preferred type reinforcement is fiberglass, and it is preferred that the fiberglass be present in the amount of about 15 to 55 weight percent based on the total weight of the polymer and filler present.

Composite constructs incorporating an insert in an injection molded part are also anticipated as a means of improving weight and strength of injection molded boot bindings, for example metal inserts or attachments forming the inside flanges of the boot binding beam lower aspect. These composites can be formed in the injection molding process or can be assembled separately with a molded subassembly. Similarly, lightweight foam cores embedded within plastic ribs can be used to decrease weight without sacrificing strength.

While the embodiment of FIGS. 20-21 is described as formed by injection molding, the process of designing and tooling-up for injection molding typically involves a machined prototype as a common and customary intermediate. The monolithic piece of FIGS. 20-21 may be formed by any process involving casting, molding, or machining if desired, or a combination thereof. The piece may be formed of a plastic or a metal, for example a thermoplastic, a fiber-reinforced thermoplastic, aluminum or an aluminum alloy, titanium or some other light and rigid material, or steel, while not limited thereto. Honeycombing the structures is optional in order to reduce weight.

Figure 22:
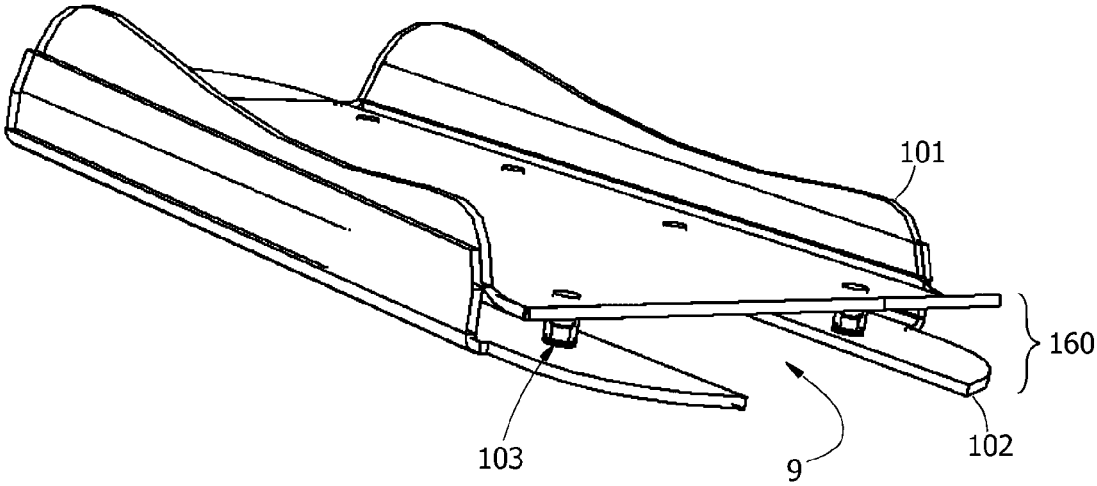
FIG. 22 is a CAD view of the upper surface of a boot binding lower made up of two nested channel elements so as to form a box girder with integrated raised upper platform or plate.
Figure 23:
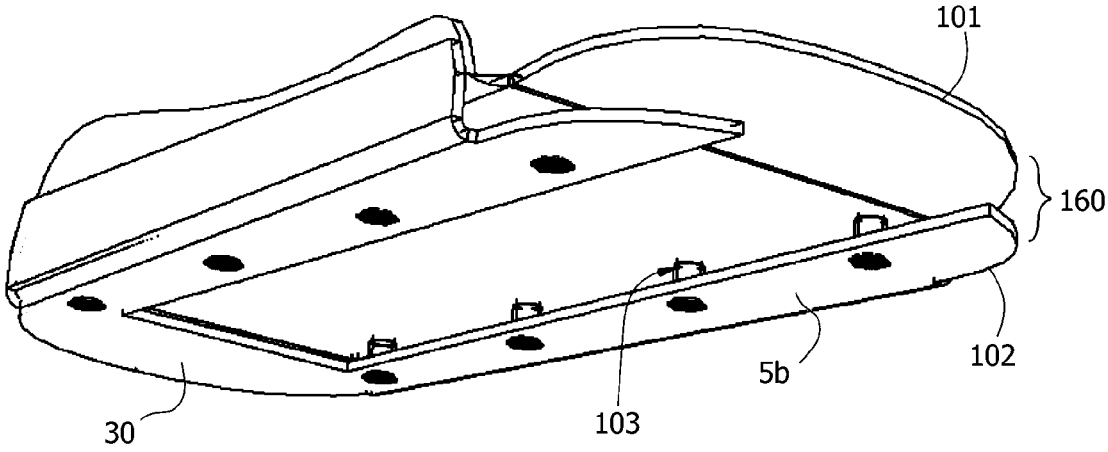
FIG. 23 is a CAD view of the bottom surface of the boot binding of FIG. 22 with box-ended channel formed between the nested plates.

FIGS. 22 and 23 are CAD-generated drawings of another alternate embodiment. Here the integral boot binding lower is shown as two nested U-channels (101,102) separated by a hollow interior corresponding to the box-ended channel of other embodiments. Plate 102 forms the bottom surface (5*b*). A regularly spaced series of lateral standoffs (103) stabilize the modified sandwich structure (160) and reinforce the internal flanges of the box-ended channel as is shown in the underside view of FIG. 23. A crosspiece (30) on the bottom surface forms box-ended channel (9).

Figure 24:
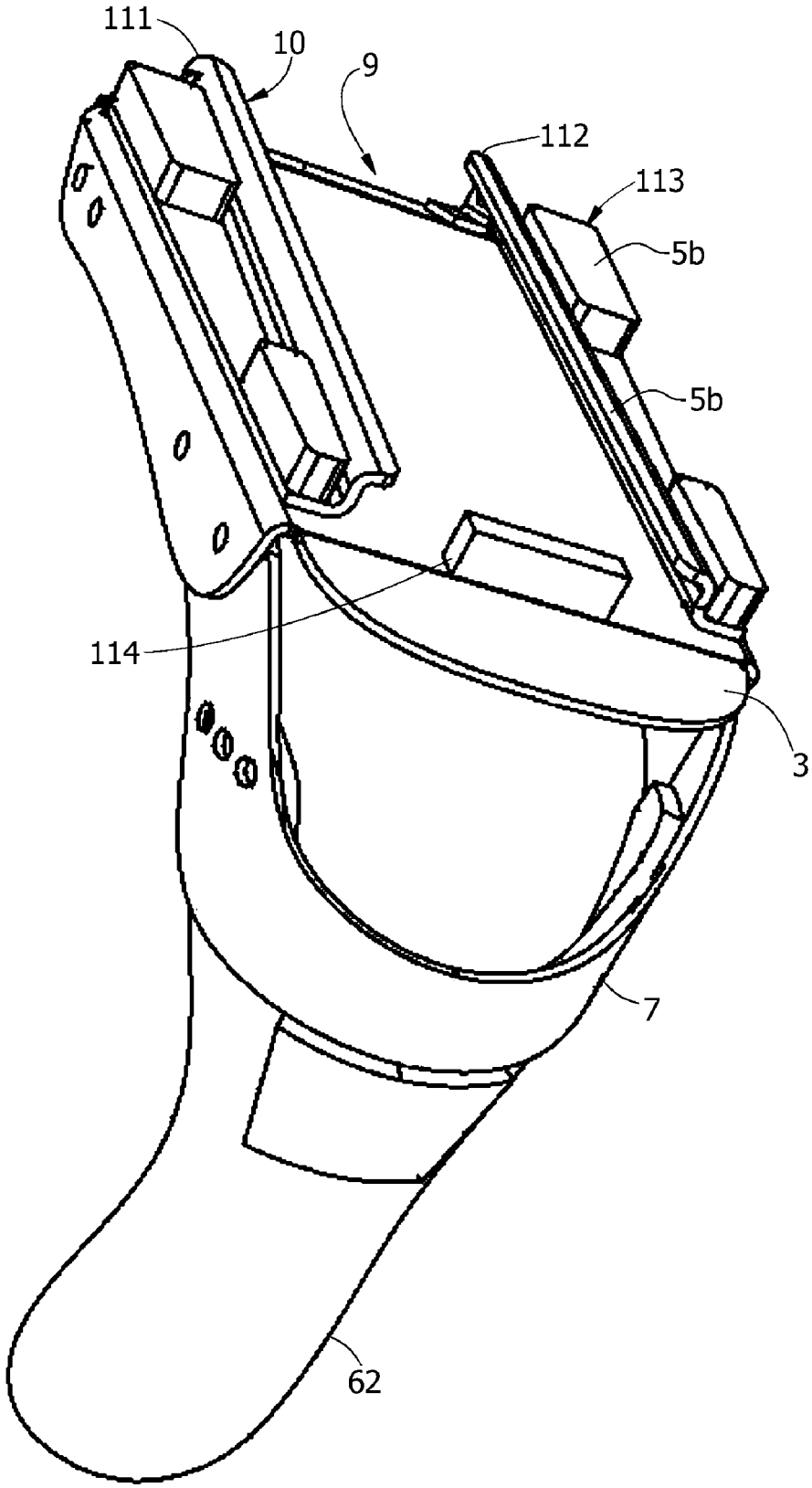
FIG. 24 is a CAD view of the bottom surface of another embodiment having bottom rails and an endstop.

FIG. 24 shows metal folding methods used to generate a pair of z-brackets (111,112) that form a lower aspect with "bottom surface" (5*b*) attached to a top plate with heel cup (7) and highback (62). Stiffening blocks (113) are used to adjust torsional stiffness and increase bottom surface (5*b*) contact area and width. The z-bracket elements may be spot welded onto the top plate. Endstop (114) and flanges (10) form box-ended channel (9).

Figure 25:
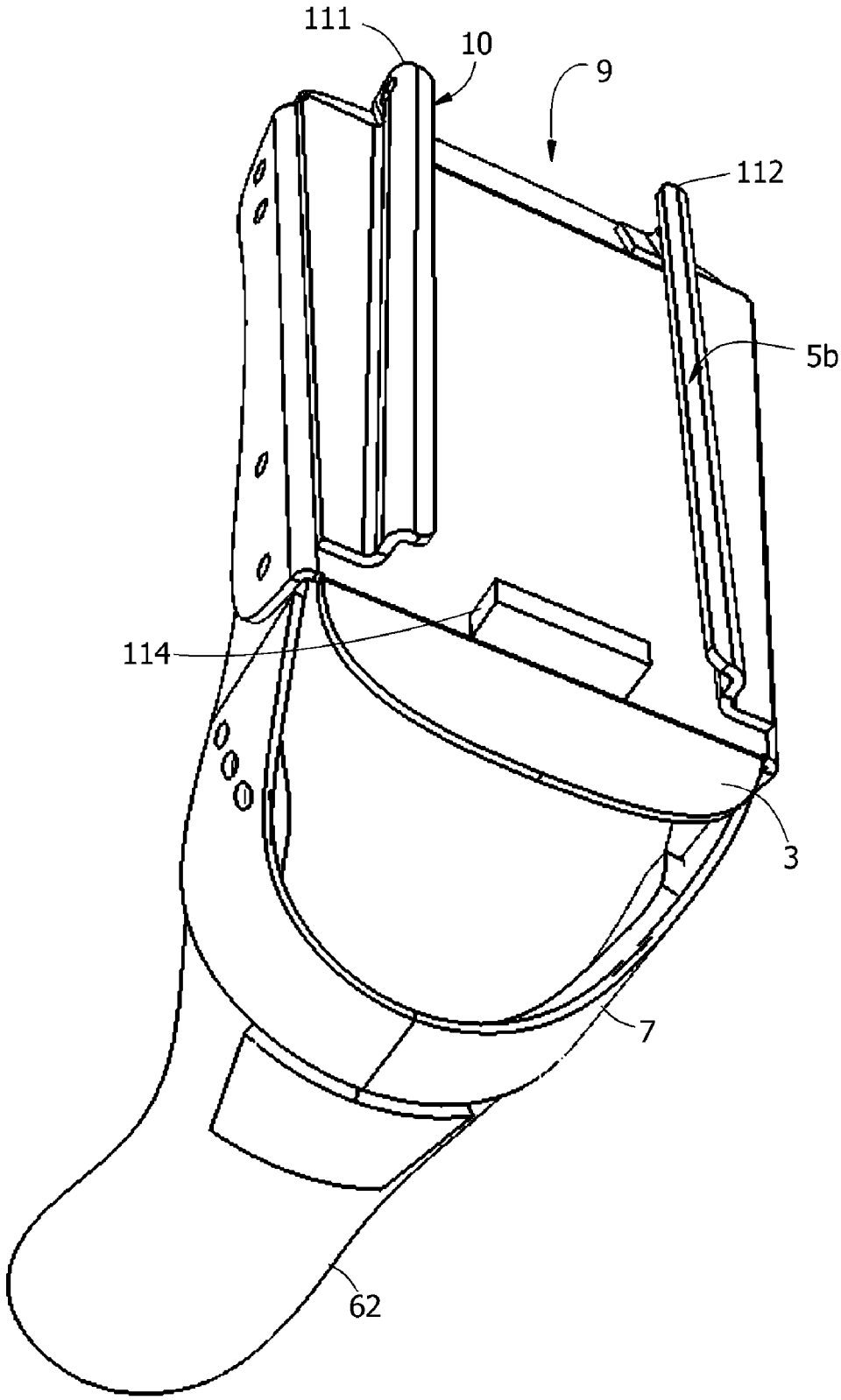
FIG. 25 is a CAD view of the bottom surface of another embodiment having welded rails, stabilizers and an endstop.

FIG. 25 shows the boot bindings of FIG. 24 without the stiffening blocks. Z-brackets (111,112) are as in the previous figure.

Figure 26:
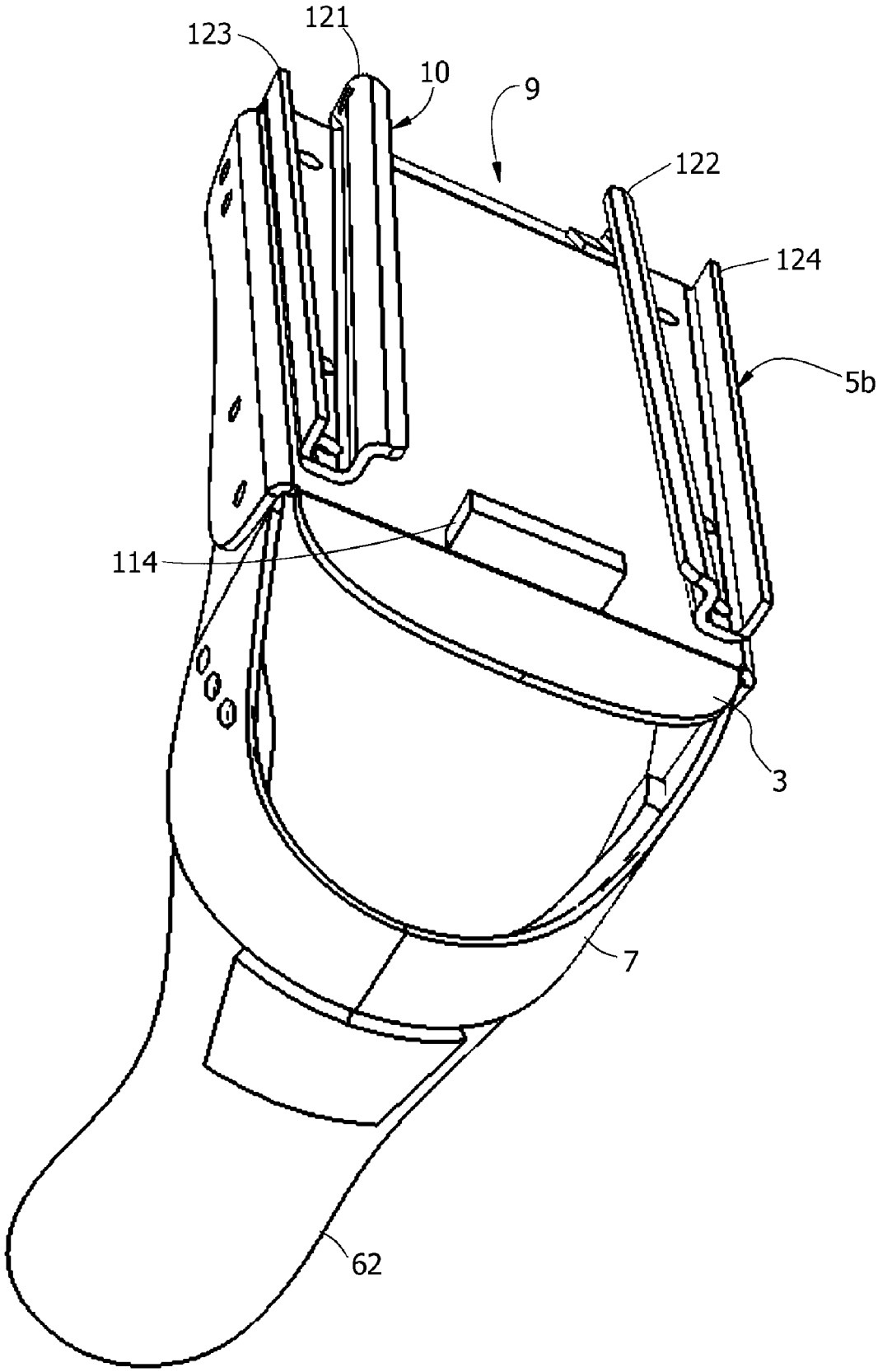
FIG. 26 is a CAD view of a bottom surface of another embodiment having dual folded bottom rails with inner flanges and an endstop.

FIG. 26 shows a variant of the z-brackets of FIG. 24, wherein side rails (123,124) are added to support lateral loads directly on the surface of the board. In this embodiment, the bottom surface (5*b*) encompasses both the flanged elements (121,122) and the side rails (123,124), which form mediolateral bottom edges of the bottom surface (5*b*). An endstop (114) that closes the heel end of box-ended channel (9) is again shown.

Figure 27:
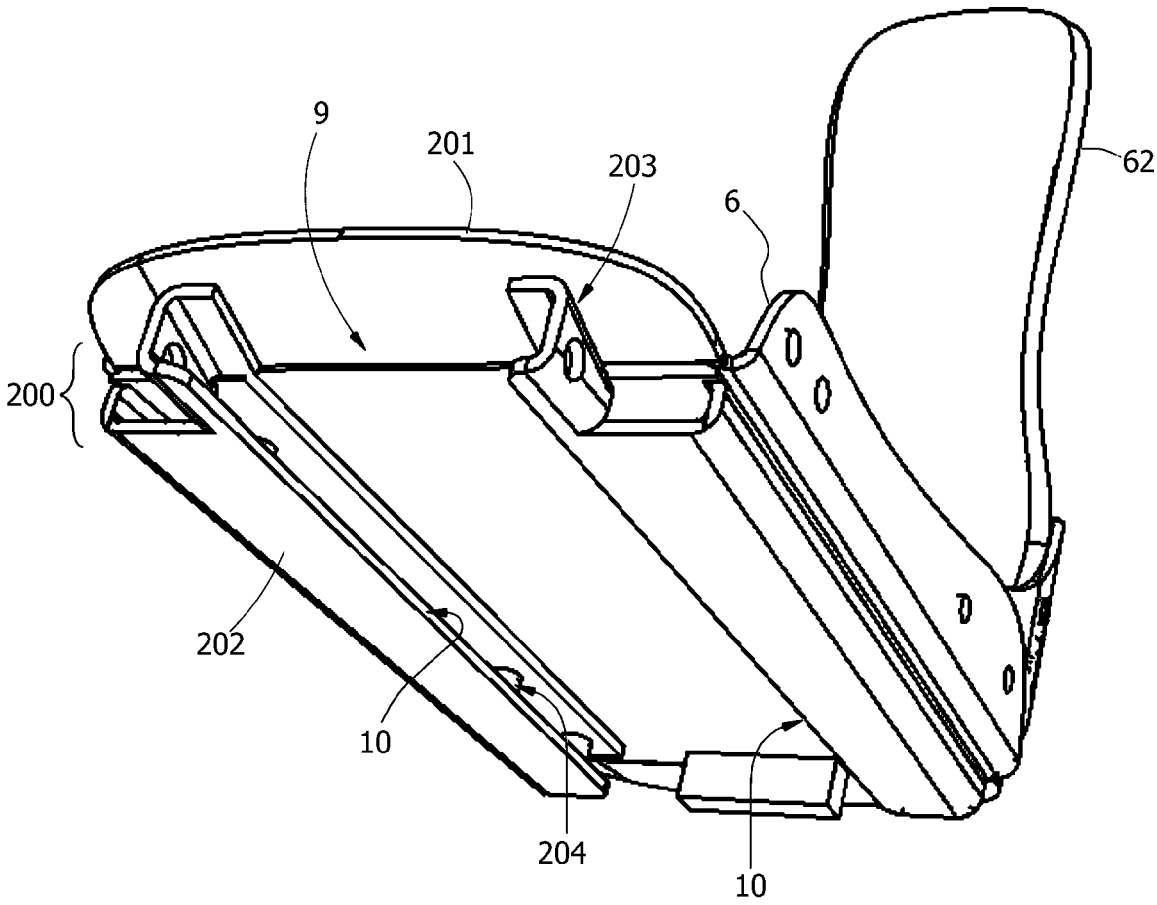
FIG. 27 shows how folded metal plate construction may be used to form a complex modified box girder with internal flanges and an endstop. Two plates are mated together.

In FIG. 27, the top plate (201) from which are formed side rails (6), lies flat on a folded lower plate (202) from which are formed internal flanges (10), and a toe pivot mounting bracket (203). A heelcup and highback (62) are bolted onto the side rails (6). Note the use of standoffs (204) in the web for additional support in the lower box-ended channel (9).

Figure 28A:
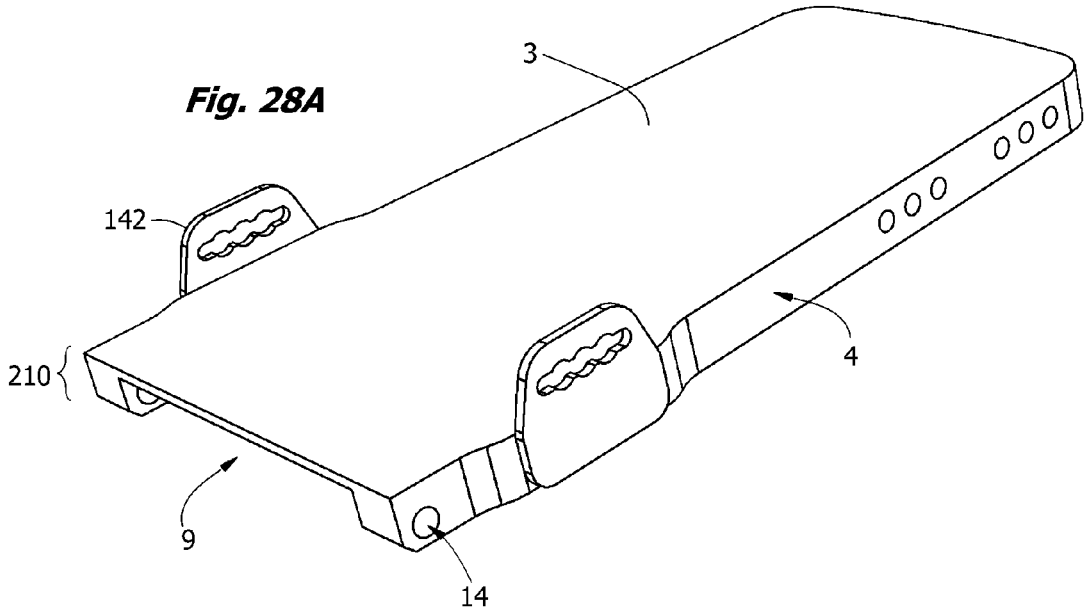
FIGS. 28A and 28B show top and bottom perspective views of a one-piece monolithic boot binding made by machining. The lateral clips for fastening a bootstrap are optionally detachable for replacement, but are shown here as formed with the boot binding from a single block of a metal or a plastic.
Figure 28B:
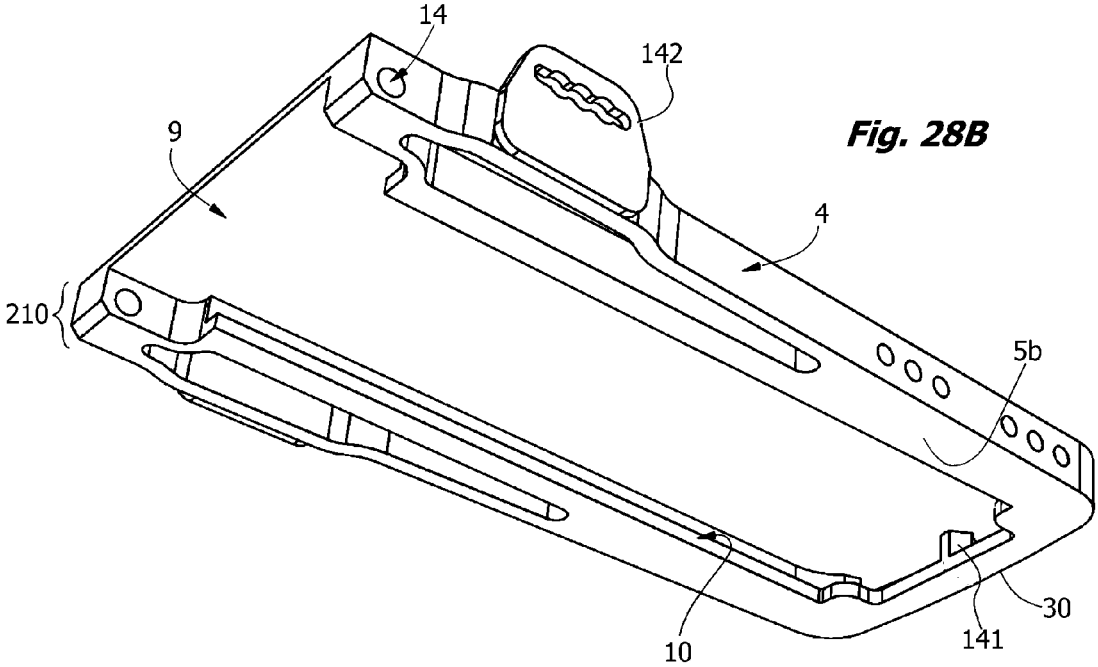

FIGS. 28A and 28B again demonstrates a non-sandwich construction. The embodiment of FIG. 28 is a variform box girder (210) formed by machining from a solid block of a metal or a plastic. Box girder (2) is formed with top plate member and top surface (3) and bottom surface (5*b*) with channel (9) and internal flanges (10). An end stop closing the box channel is formed by extending the flanges as a cross-piece (30), here shown with reinforcing central endpost or endstop (141). The endpost (141) also serves as a supporting heel rest in ski touring mode. Perforated upper boot binding mounting tabs (142), with provision for attaching boot-mounting hardware, are also formed from a solid core in this example, but optionally may be affixed as replaceable elements using threaded fasteners or the like. Other holes are placed around the periphery of the modified box girder for mounting heel cups and other elements of the upper boot binding. Also provided is transverse hole (14) for inserting a toe pivot pin, the pin having dual functions of a) locking the channel onto the snowboard mounting block assembly in snowboard riding mode and b) permitting pivot of the boot bindings at the toe in ski touring mode.

In FIGS. 28A and 28B, the aspect ratio of the web members is seen to vary from heel to toe. The aspect ratios of the bottom plate and the top plate may also be independently varied in machined or molded parts. This freedom to vary the aspect ratio, and the material properties, of the top plate and bottom plate and the spacer members forming the web elements allows the design of the top plate to be customized to the boot sole of the rider while the bottom plate is independently fitted to the boot mounting blocks. Independent control of the width of the boot binding and the width of the bottom channel is a feature which is made possible because the aspect ratios of the web members may be varied independently of the top and bottom plates. Happily, widening the box girder also improves the torsional stiffness of the boot binding on the splitboard as shown in Example 3 and in the discussion of FIG. 39.

Figure 29:
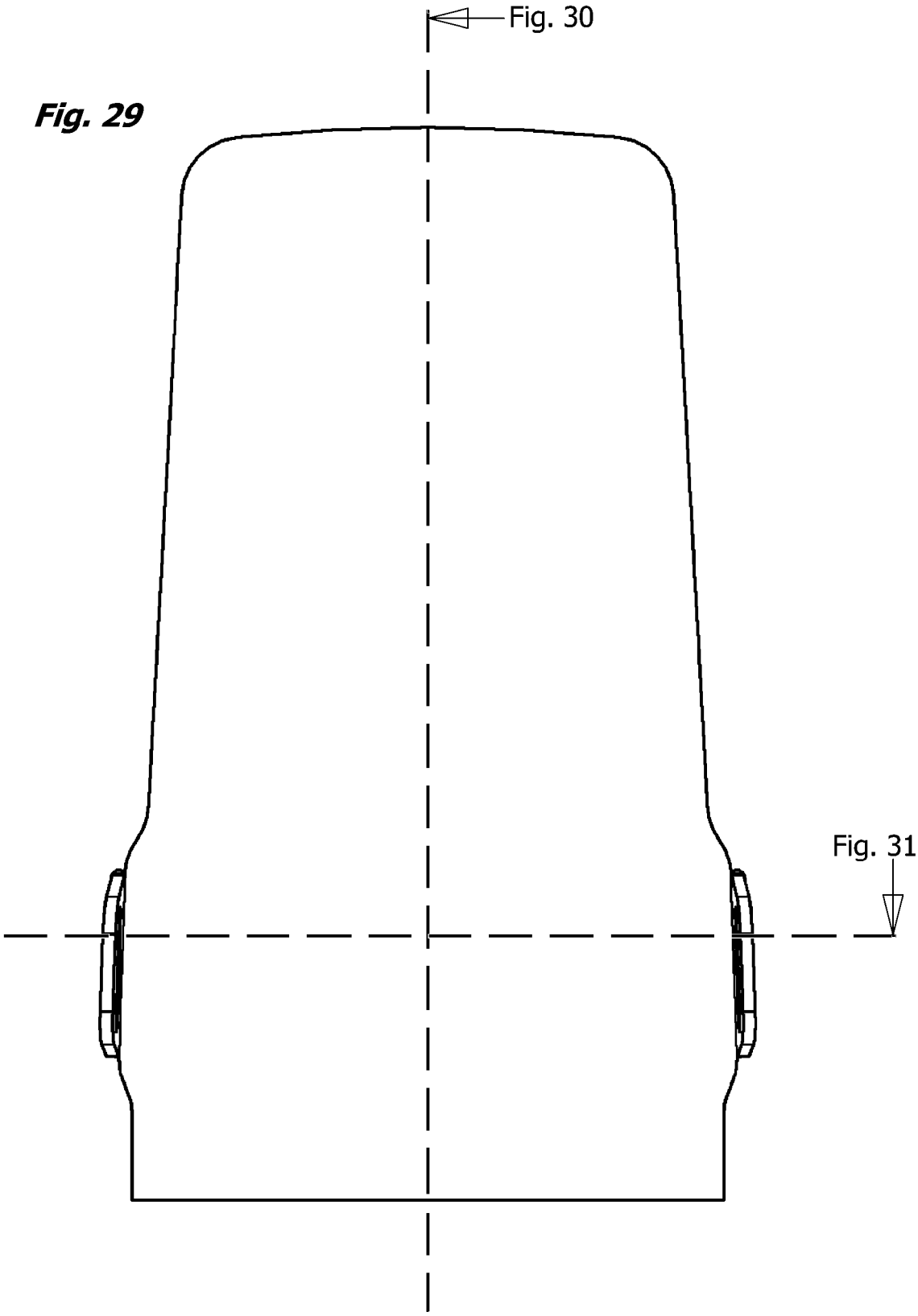
FIG. 29 shows a plan view of the boot binding of FIGS. 28A-B. Shown are sectional cutlines for the cross-sectional views of FIGS. 30 and 31.

FIG. 29 shows a plan view of the modified box girder of FIGS. 28A and 28B. Shown in plan view are the locations where elevational cross-sections of FIGS. 30 and 31 are taken.

Figure 30:
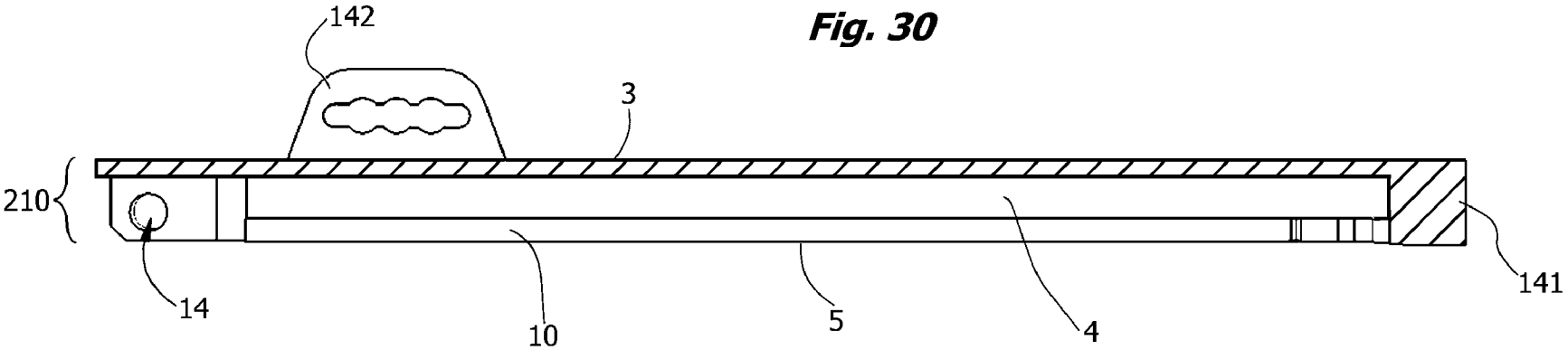
FIG. 30 is a long axis cross-section through the monolithic boot binding of FIG. 29.

FIG. 30 is a longitudinal cross-sectional view of the monolithic box girder (210) of FIGS. 28-31 and shows girder elements, including top plate member and top surface (3), bottom plate member and bottom surface (5), lateral web (4), endstop (141) forming a box-ended channel with internal flanges (10). Also shown is toe pivot transverse mounting hole (14).

Figure 31:
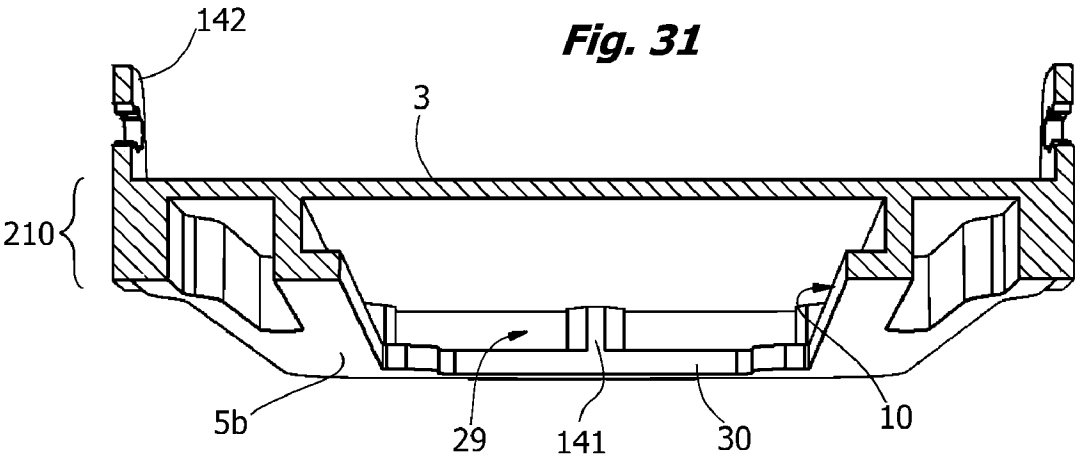
FIG. 31 is a transverse cross-section through the monolithic boot binding of FIG. 29.

FIG. 31 is a transverse cross-sectional view as indicated in FIG. 29, the cross-section taken through the perforated bilateral projections or upper boot binding mounting tabs (142). Shown are bottom surface (5*b*), top plate member or surface (3) and internal flanges (10) of the box-ended channel with endstop (141), crosspiece (30) and snow vents (29). Bottom surface 5*b* is broadened laterally to provide torsional stiffness by directly contacting the mated surface of a snowboard when foot roll is applied by a rider. While the upstanding tabs (142) for attaching a toe strap are shown milled from a solid block or casting, they may also be fabricated separately and attached with fasteners. In this sectional view, the box girder (210) is a double-webbed box girder having variable aspect ratio from toe to heel.

Figure 32A:
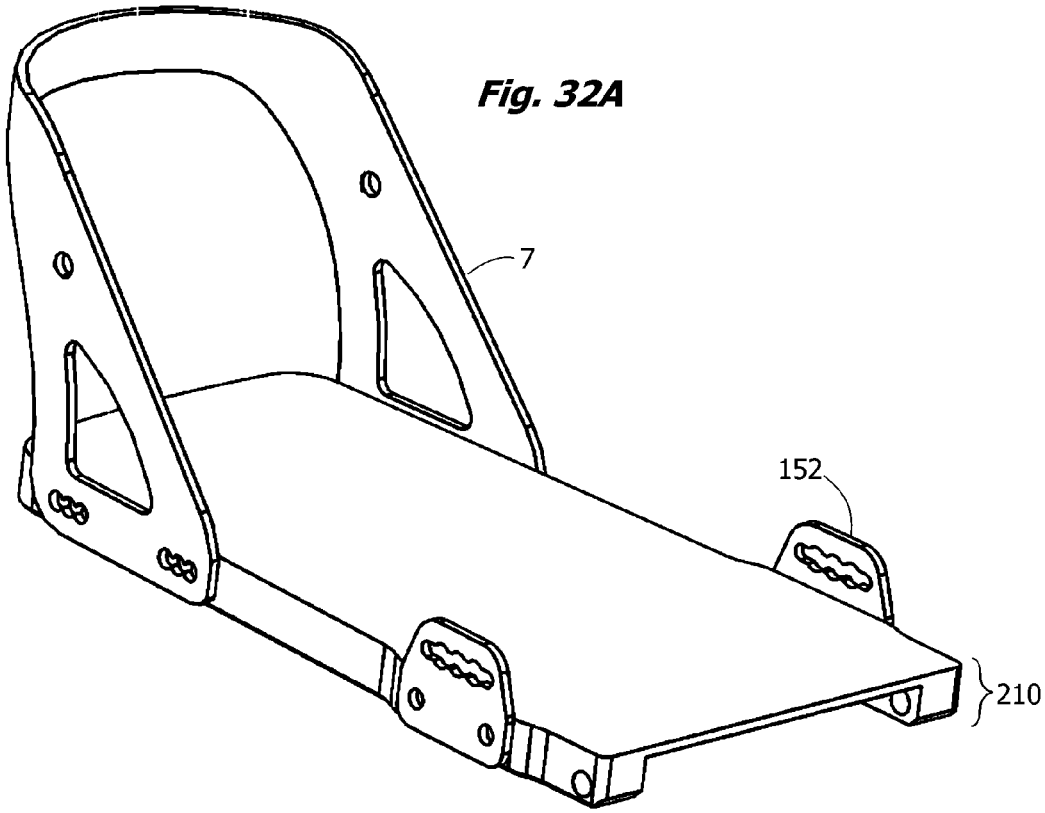
FIGS. 32A and 32B are top and bottom perspective views of a monolithic boot binding with detachable heel cup and bootstrap fastening clips.
Figure 32B:
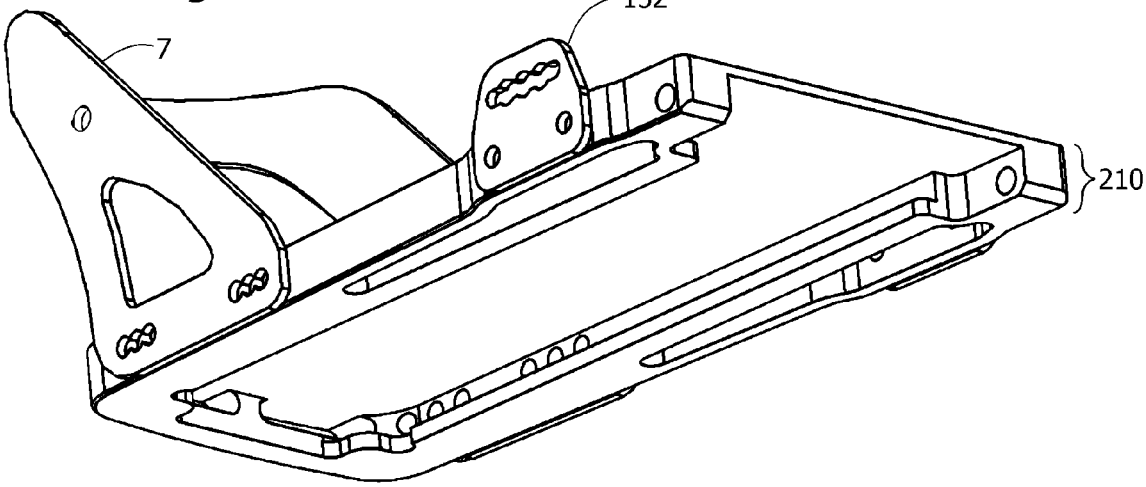

FIGS. 32A and 32B are views of a monolithic single-piece variform box girder (2) made as a machined part from a solid metal block with holes around the periphery for attaching various boot mounting hardware, as shown here including a pair of vertical tabs (152) for attaching bootstraps and a heel cup (7). Fasteners for attachment are not shown but could include screws, pins with circlips, and the like. As manufactured from aluminum alloy, this part was found to weigh about 330 grams. If machined from nylon, a similar part having the same functionality would have a weight of about half that; if made from UHMWPE, the part would have a weight of about 125 grams. In contrast, a combination of adaptor mounting plate and upper binding baseplate of the prior art, which lacks the integral boot binding lower construction of the present invention, was found to weigh over 500 grams—while also not having the performance gains found with the improved lightweight boot bindings of the present invention (see Examples 2 and 4).

Figure 33A:
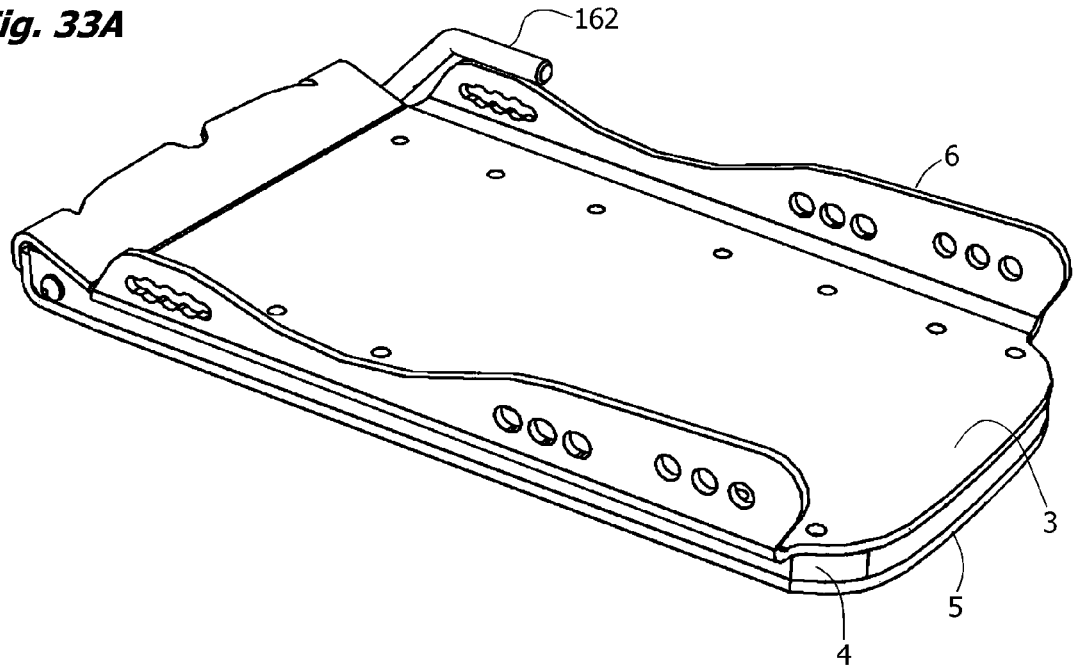
FIGS. 33A and 33B are top and bottom perspective views of a boot binding with three-piece sandwich box girder construction, side rails for securing a boot to the upper surface, and a lockable toe pivot pin.
Figure 33B:
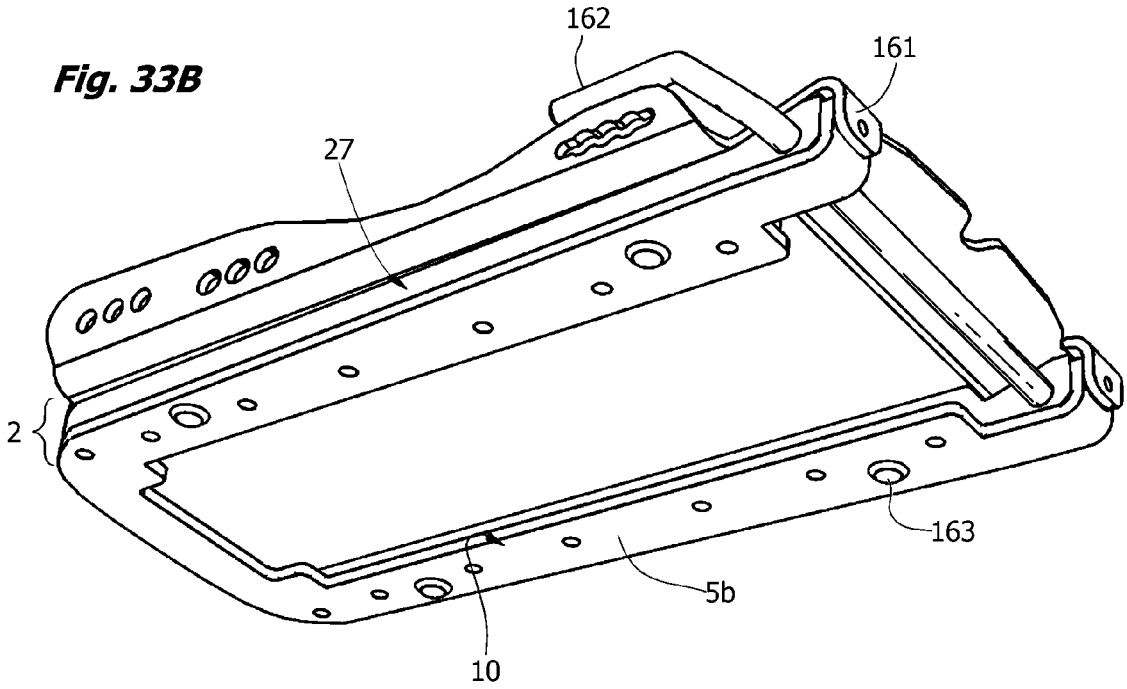

FIGS. 33A and 33B show perspective views of a variform box girder (2) with top plate member (3), bottom plate member (5), lateral and medial web spacer elements (4, 27), top side rails (6) with threaded holes for attaching upper boot binding elements. This embodiment again illustrates a sandwich construct, with the top plate, bottom plate and web elements joined as layers of a sandwich. Front tabs (161) reinforce the bearing strength of the UHMWPE spacers in this design. Also shown is a self-locking toe pivot pin (162). On the bottom surface (5*b*), plastic feet (163) are used to provide contact with a mated board surface while not scratching the board or interfering with the task of inserting the boots onto the snowboard mounting blocks.

Figure 34A:
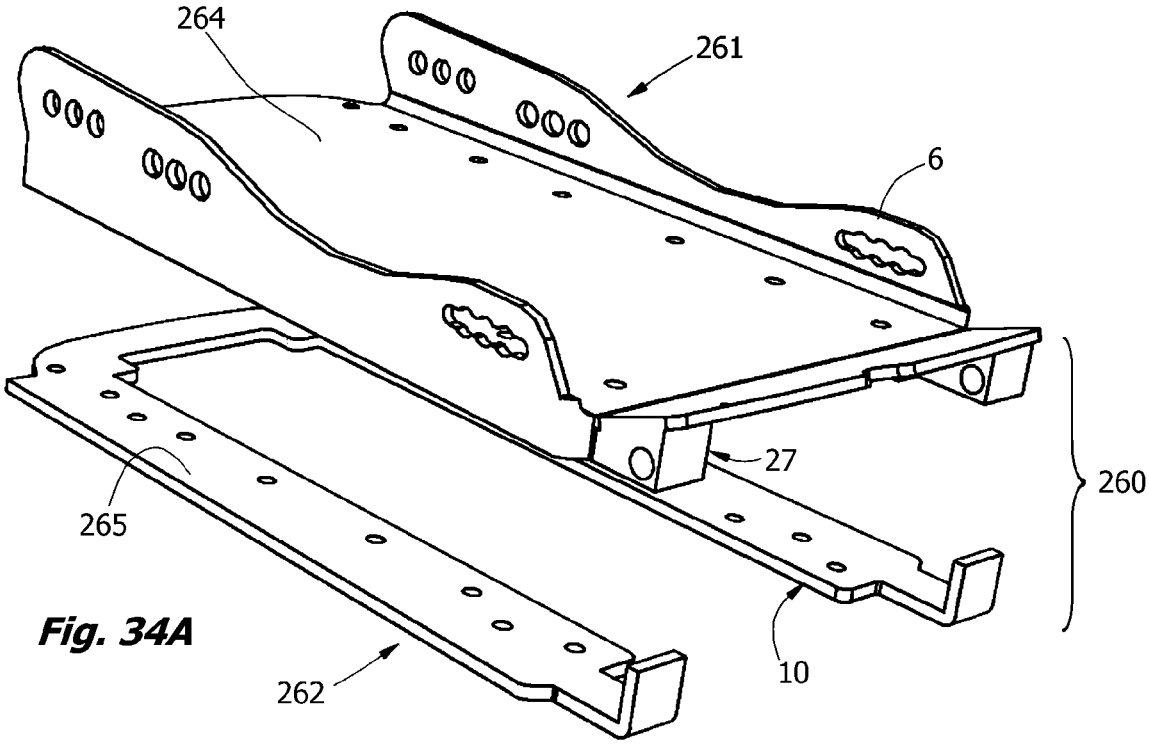
FIGS. 34A and 34B are illustrative of two-piece construction, here shown with a top plate having bilateral webs and a bottom plate.
Figure 34B:
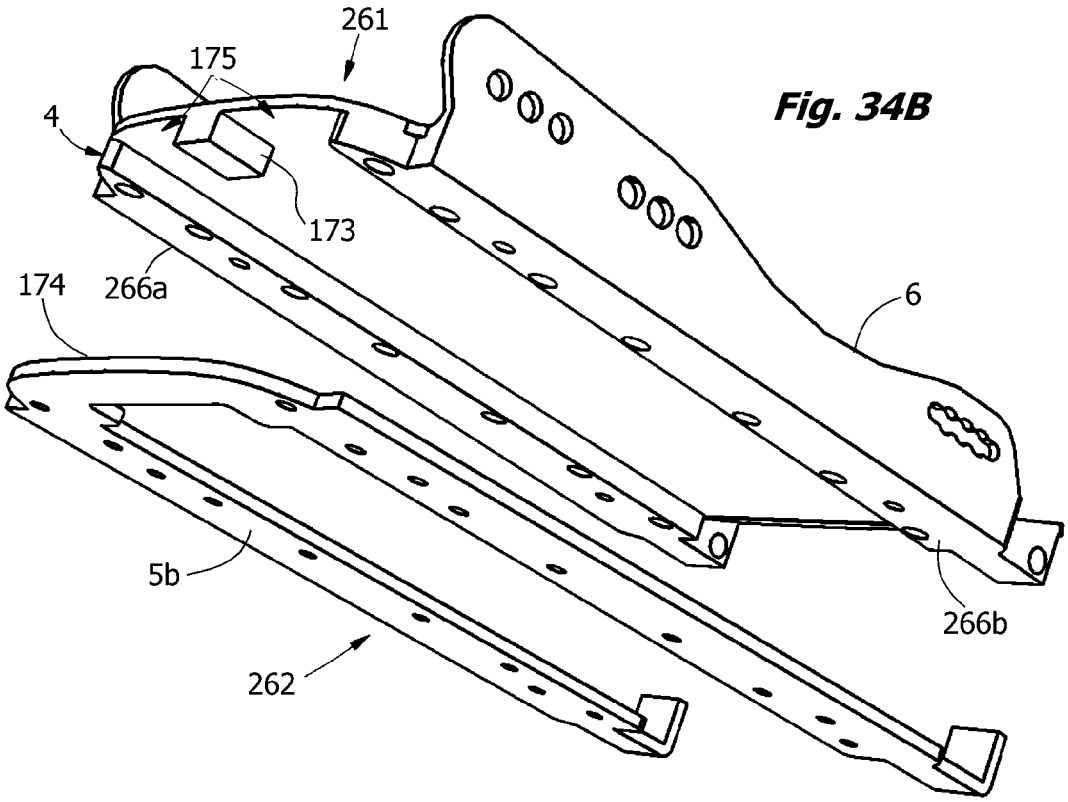

FIGS. 34 and 35 show perspective views of a box girder (260) formed of two mating parts or layers, a top part and a bottom part. In the first of this series, FIGS. 34A and 34B, a top plate and medial and lateral web elements are formed as a single-piece upper part (261) where the webs (266*a*, 266*b*) are consolidated as projections of the top plate member (264), generally having been formed by machining or by injection molding, although not limited thereto, and a bottom part (262) forming a bottom plate member (265) with internal flanges (10) is assembled together to the upper part to form a complete box girder (260) with the web elements in between. The two parts (261,262) may be joined together by welding, brazing, screwing, riveting, gluing, laminating, adhering, or otherwise fastening. Endstop (173) and heel rest (174) is formed as an integral part of the composite top plate/web sub-member. When joined together, the box channel between internal flanges (10) is closed by endstop (173) and cross-piece (174) with provision for a snow vent (175). Bottom surface 5*b* is generally planar and configured for close contact with a mating splitboard face in snowboard riding mode. Provision is made for fabricating these boot bindings from metal or plastic, or for combinations thereof.

Figure 35A:
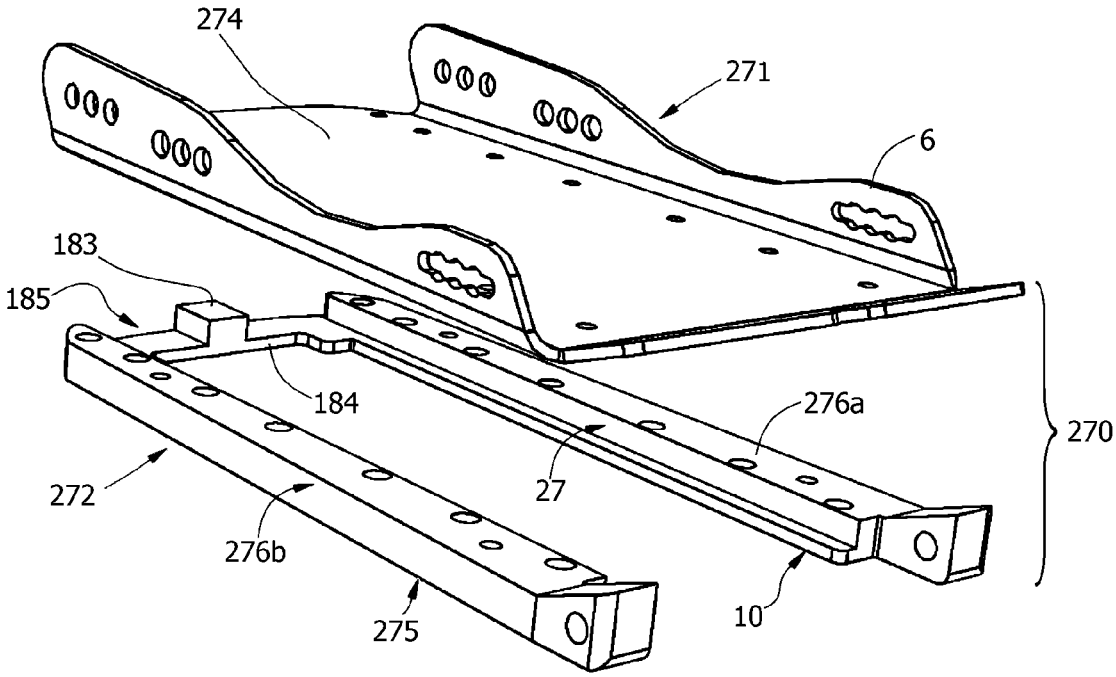
FIGS. 35A and 35B are illustrative of two-piece construction, here shown with a bottom plate having bilateral webs and a top plate.
Figure 35B:
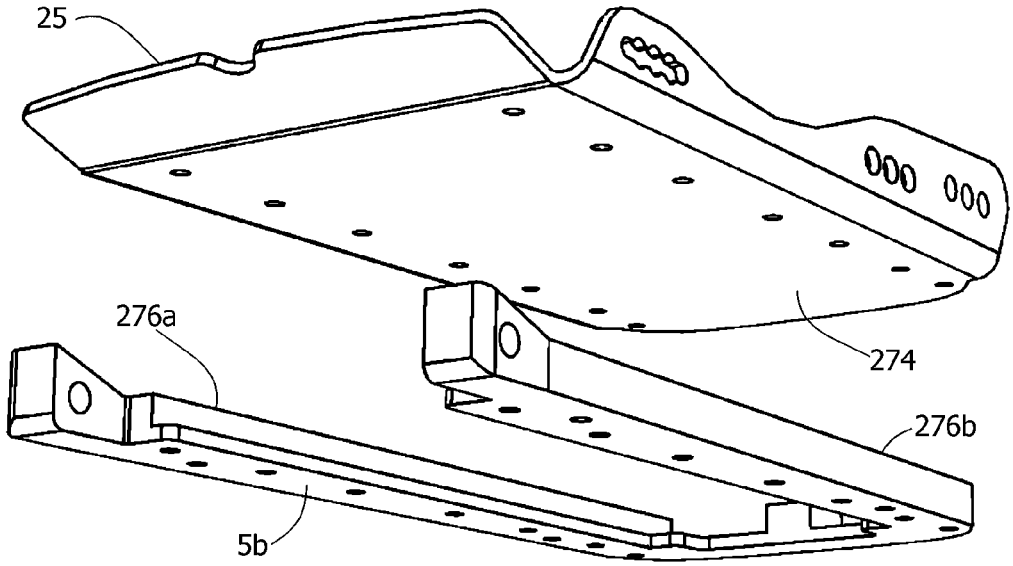
Figure 36A:
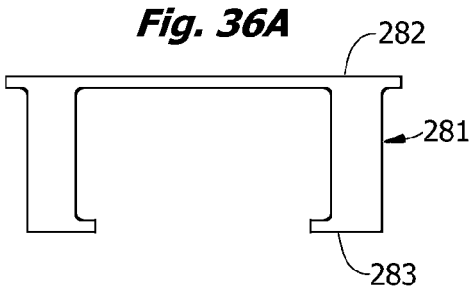
FIGS. 36A-H are representative cross-sectional views of box girders.
Figure 36B:
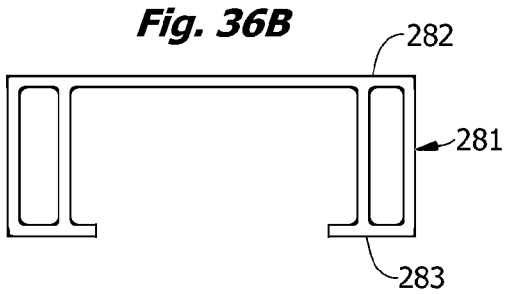
Figure 36C:
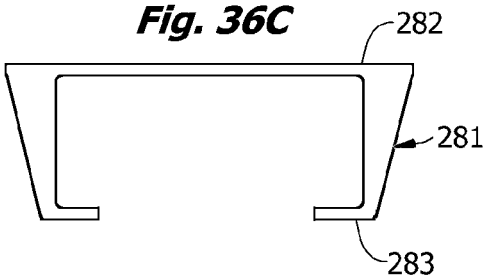
Figure 36D:
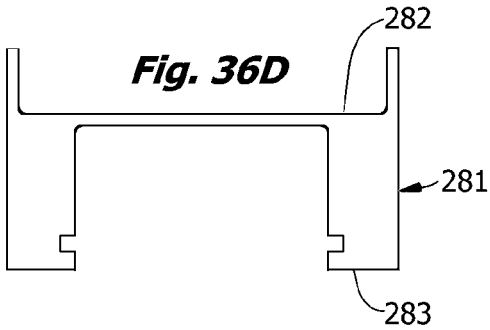
Figure 36E:
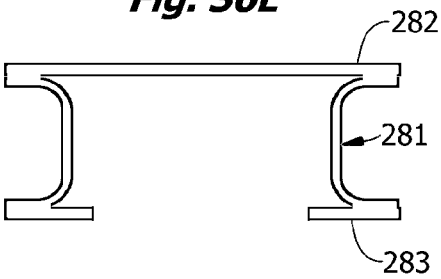
Figure 36F:
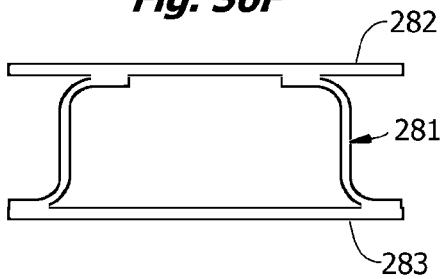
Figure 36G:
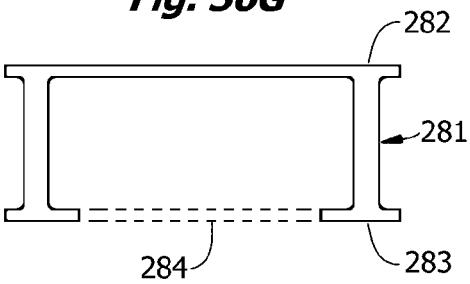
Figure 36H:
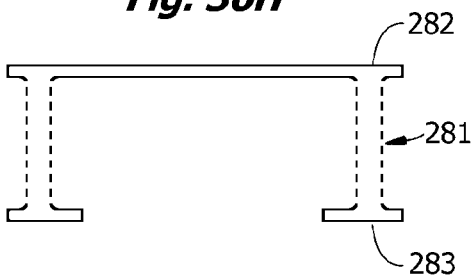

In the second of this series, turning now to FIGS. 35A and 35B, a bottom plate and medial and lateral web elements are formed as a single-piece bottom piece (272) or layer, with bottom plate member 275, where the webs (276*a*, 276*b*) are consolidated as projections of the bottom plate 275, generally having been formed by machining or by injection molding, although not limited thereto, and a top piece (271) or layer, which is assembled to the bottom piece to form a complete variform box girder (270), the web elements in between. The two parts, pieces or layers (271,272) may be joined together by welding, brazing, screwing, riveting, gluing, laminating, adhering, bolting, pressing, or otherwise fastening. Endstop (183) and heel rest is formed as an integral part of the composite bottom plate/web sub-member. Provision for a snow vent (185) is made at the heel end of the box channel formed by internal flanges (10). Bottom surface 5*b* of bottom plate 275 is generally planar and configured for close contact with a mating snowboard in snowboard riding mode. The top side rails (6), and toe riser (25) of top plate (274) can be made by folding the metal plate, illustrating that fabrication by combinations of milling, machining, folding, and fastening result in improved functionality of the pieces. Provision is made for fabricating these boot bindings from metal or plastic, or for combinations thereof.

More generally, web constructs forming a box girder are shown schematically in FIGS. 36A-36H. The box girder consists of a top plate or upper surface (282) and a bottom plate or bottom surface (283) joined by medial and lateral web elements (281), which may take various forms. Included are straight walled, double walled, inwardly canted, outwardly canted, curved, thickened, perforated, honeycombed, and recessed web elements 281, including a modified "pi" girder with crosspiece 284 shown in FIG. 36G. While not limited thereto, these figures illustrate the versatility of web girder construction. As used here, the web elements are generally thickened at the toe end of the box girder to better support the toe pivot means.

As shown schematically, the aspect ratio of the web elements is varied independently from the aspect ratio of the top and bottom plates. The aspect ratio of the two plates may also be varied independently. This results in a variform box girder which serves as a platform for a boot, where the shape, outline and contours of the top surface of the platform are optimized for supporting and securing the boot. The dimensions of the underside channel, however, are unchanged. Increasing the width allows the bottom plate flanges (at the mediolateral outside edges of the bottom plate) to contact the face of the board. As discussed with respect to FIGS. 39 and 40, this increases the torsional stiffness of the boot binding platform so that the overall spring constant of the boot binding lower, accessory uppers, and rider's boots can be adjusted to fall within a preferred range.

Figure 37A:
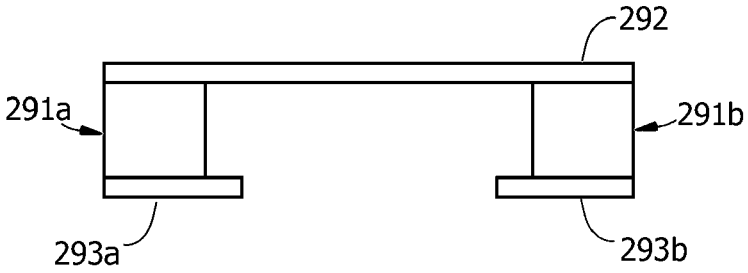
FIGS. 37A-E are schematic representations of sandwich and monolithic box girder construction.
Figure 37B:
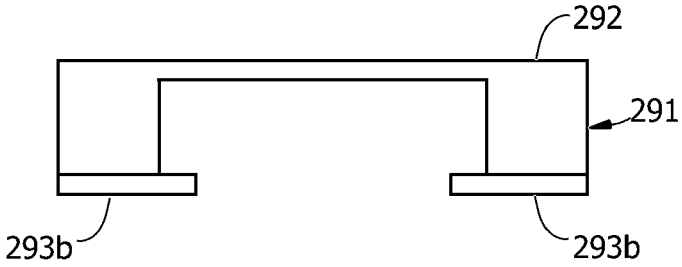
Figure 37C:
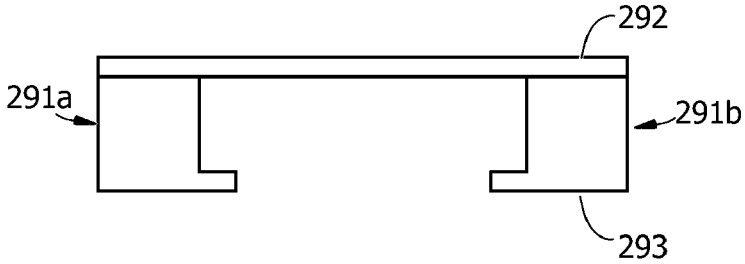
Figure 37D:
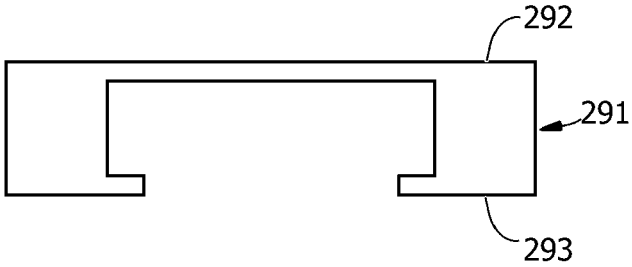
Figure 37E:
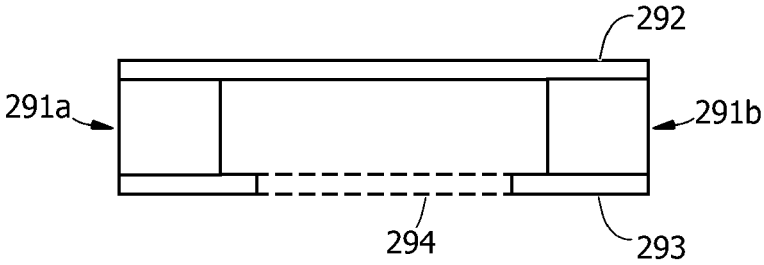

FIGS. 37A-E describe various boot binding combinations of top plate member (292), bottom plate member (293), and web elements (291). As shown in FIG. 37A, the boot binding may be a sandwich with three layers, where the web elements (291*a*, 291*b*) are sandwiched between a top plate member (292) and a bottom plate member, shown here as formed of a medial flange member (293*a*) and a lateral flange member (293*b*), the two flanges forming the bottom plate member. As shown in FIG. 37B, the bottom plate member is again divided as two bottom flanges (293*a*, 293*b*); the top plate member (292) is consolidated with the medial and lateral web elements (291) which are formed as projections from the top plate member. This is a modified sandwich construction. In a third instance, FIG. 37C depicts a boot binding in which the web layer is divided into two elements, a medial web (291*a*) and a lateral web (291*b*), where the web elements are consolidated as projections of the bottom plate member (293). In FIG. 37D, a monolithic construct is shown, where all three layers, top plate member, web spacer members, and bottom plate member are formed of a single piece. In FIG. 37E, a sandwich construction is again shown, but the bottom plate member (293) is shown (dotted line) to be continuous across the width of the base of the boot binding, as by a crosspiece (294) formed at the heel. And while the web elements (291*a*, 291*b*) are shown as two separate spacer members, the web may also be formed as a single piece or "layer" having a medial aspect and a lateral aspect, but joined by a structural crossmember.

Conceptually, a representation of a variform box girder (300) for use as a boot binding lower is drawn in FIGS. 38A-E. In FIG. 38A, a plan view of the top plate (301) is shown. The outline of the box girder may be tapered and complex if desired so as to more closely fit the rider's boot. The drawings are not to scale. The width of the boot binding is typically greater than the width of the rider's boot sole in outline (dotted line, 315). That is, the mediolateral edges of the boot binding are broader than the mediolateral edges of the boot sole. The boot, however, may extend past the heel and toe ends (307, 308) of the box girder if desired, as shown. In FIG. 38B, a plan view of the bottom plate (302) is shown. An open-ended box channel (305) extends from the toe end (307) to the heel end (308). The channel is closed at the heel end, forming a box-ended channel (305). The channel is bounded laterally by parallel inside flanges (310). The box-ended channel with inside flanges grips and conjoins mounting blocks affixed to the splitboard. While the lateral dimensions and length of the channel are generally fixed, the top plate is dimensioned to suit the rider's boot. Inside flanges (310) and open channel (305) are again shown in section in FIG. 38C. Also shown are lateral and medial web elements (303,304), which are configured with an aspect ratio independent of the aspect ratio of the top and bottom plates. The bottom surfaces of the medial and lateral flanges (302*a*, 302*b*) of the bottom plate contact the top face of the splitboard during certain maneuvers. FIG. 38D shows a view from the heel end (308) with snow vent (313), optional endstop (312), and optional crosspiece (311). A side view in elevation is shown in FIG. 38E. Shown is the lateral web (304) with transverse mounting hole (309) for the toe pivot pin and a representative slot (306) for mounting the boot binding straps or other hardware (not shown) used to secure a boot to the top surface (301) of the box girder (300).

Figure 39A:
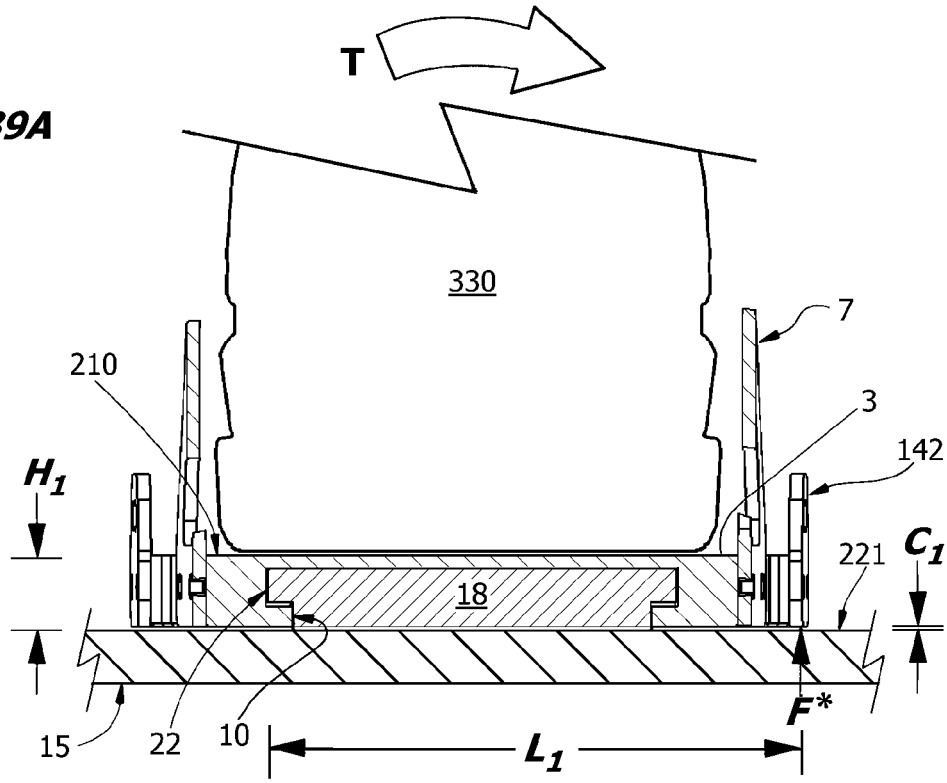
FIGS. 39A and 39B compare the position and action of a rider's boot on a boot binding of the invention with a boot binding assembly of the prior art (FIG. 39B).

FIG. 39A analyzes the transmission of forces from the rider's boot (330) to the splitboard for controlling the ride. Although shifting center of mass from one foot to another or from one side of the board to the other is one method for controlling the ride, another method is to apply a bending force through the ankles, which is illustrated here by a clockwise torque T. This technique of controlling the ride at the ankles is known as "foot roll" and is most efficacious when a requisite level of torsional stiffness in the linkage (or "coupling") between the boot and the board is provided. The rider proficient in use of foot roll to control the ride is able to comfortably and stably position their center of mass on the board and weight distribution between front and back feet; whereas a rider who must rely solely on shifting center of mass to control the board can be caught off balance and unable to recover. As can be seen in FIG. 39A, the rider's boot is in direct contact with the upper surface (3*a*) of an integral boot binding lower of the present invention, here shown as a monolithic modified box girder (210) with bottomside internal flanges (10) for engaging the corresponding external flanges (22) of a mounting block (18). Boot binding uppers such as heel cup (7) and toe straps attached to mounting clip (142) are used to secure the rider's boot to the box girder with an adjustable level of torsional stiffness. The boot worn by the rider also has a selectable level of torsional stiffness. The bending force exerted by the rider is thus effectively transmitted to the box girder by virtue of the adjustable torsional stiffness of the boot binding uppers; similarly, any torsional looseness between the box girder and the board weakens this linkage.

Torsional looseness also arises from excess clearances. The clearance $C_1$ between the bottom surface of the box girder and the top face of the splitboard (221), shown here in cross-section (FIG. 39A), is sufficient so that the boot bindings can be slid on and off the mounting blocks, but no more. Under dynamic load, the bottom flange edges are in intimate contact with the underlying surface of the snowboard in snowboard riding mode and serve to communicate foot roll to the board, thereby providing for efficacious torsional stiffness during the ride. This clearance is optionally adjustable with shims, spacers, or feet (163) as shown in FIG. 33B. The tighter clearance ensures that the bottom surface of the box girder reversibly (i.e., dynamically) contacts the face of the splitboard only if torque is applied to the bindings. Because of the reduced clearances, firm control is experienced when shifting foot roll from clockwise torque to counterclockwise torque. Direct contact under load suppresses torsional "wobble" or "floppiness" in the linkage between the box girder and the board, and the resulting torsional stiffness experienced by the rider is predominantly the spring stiffness K of the boot binding uppers and the boot itself. The linkage between the boot and the board under dynamic load becomes a single rigid member. To the rider, the shift required to operatively contact the binding bottom surface with the board is almost unnoticeable. Upon contact, torque T is applied directly to the board, the bending (twisting) force having a lever arm $L_1$ (FIG. 39A). The length of the lever arm $L_1$ is taken as a radius from the fulcrum F* or pivot point to the outside pair of interlocking flanges (10, 22), where deformation of the mounting block assembly is greatest. Because of the long lever arm, the deformation is reduced or suppressed. The fulcrum F* is the point at which one of the bottom mediolateral edges of the girder touches the splitboard face 221 when torque is applied. Torque T (clockwise) as shown here rotates the board at its axis of rotation relative to the foot of the rider; inside flange (10) of the boot binding lifts external flange (22) of the rising edge of the mounting block (18), which is a stiff but elastically deformable solid, and forces down on the board to the right. Deformation of the mounting block is perceptible, imparting a certain level of "give" to the feel of control, but excess deformation is avoided. To control the ride, the rider reversibly contacts one or the other of the bottom mediolateral edges of the box girder against the splitboard face by applying a torque through the boot sole; that reversible contact effectively increases the torsional stiffness of the boot binding by reducing the applied forces and deformation or flexural compliance of the mounting blocks to an efficacious level, thus allowing the rider's bending motion to aid in control of the splitboard rather than excessively deforming the mounting block. While not bound by theory, the longer lever arm $L_1$ results in less deformation of the mounting block, resulting in better control and balance for the rider. By efficacious level of flexural compliance is meant a perception of control without "wobbliness" or "floppiness" in standing on the board while riding. This can be quantitated by mounting any boot binding on a splitboard in a jig and measuring the rotational angle θ under an applied torque T. The torsional spring stiffness constant K is determined by finding the slope of theta versus torque (Equation 1). By using a longer lever arm $L_1$ as shown in FIG. 39A, sufficient torsional stiffness to control the ride is readily achieved within acceptable levels of flexural deformation of the mounting blocks, as is discussed further in Example 3 with reference to FIG. 40A. Acceptable levels are generally greater than 150 in-lbs/degree.

Similarly, any looseness in the play of the boot binding makes it difficult to recover from a sudden loss of balance, for example a rider who jumps and finds himself coming down on the tail of the board. In this case, the spring constant K in the boot bindings will help propel the rider back into an upright position relative to the board as the tail bottoms out. The feeling of being "tied in" to the board is lost if the boot binding stiffness is insufficient. Without sufficient stiffness in the boot binding, the board will seek its own level and the rider will be unable to regain balance. To solve this problem, excess torsional play in the coupling between the box girder and the board is eliminated and the rider is then free to select a preferred torsional stiffness in the boot binding uppers and by selection of soft boots with a desired composite stiffness coefficient.

Thus in another embodiment, the invention includes methods for controlling the ride of a splitboard by optimizing the torsional stiffness of the boot bindings. The torsional stiffness may be controlled dynamically by reversibly contacting either of the bottom lateral edges of the box girder with the board face. The steps of a method for controlling the ride may include a) mounting a boot binding of the present invention on a splitboard, where the splitboard is provided with paired mounting blocks for mounting the boot binding on the top face of the board, and the boot binding comprises a modified monolithic box girder or modified sandwich box girder having a top surface and top mediolateral edges configured for contactingly supporting and securing a rider's boot sole thereinbetween, and a bottom surface, the bottom surface having a pair of internal flanges forming a box-ended channel and a pair of bottom mediolateral edges, wherein the bottom surface and the top surface are joined as a single rigid member, and the bottom surface and box channel are configured with a clearance or clearances for slidingly engaging the paired mounting blocks; and b) while riding the splitboard, a step for reversibly contacting either one of the bottom lateral edges against the splitboard face by operatively applying a clockwise or counterclockwise torque through the boot sole, whereby the rider's boot sole and the board face are dynamically coupled by a single rigid member for the duration of the contact step. Preferably, the single rigid member has a lever arm $L_1$ that extends from the fulcrum F* to the furthermost interlocking flanges of the mounting blocks. This single rigid member is the box girder and the lever arm for purposes of analyzing the torque is a radius drawn through the box girder from the fulcrum or pivot point at the bottom mediolateral edge contacting the board to the outside edge of the mounting blocks where deformation is maximal. This extended lever arm and single rigid member construction, in contrast to the short lever arm $L_2$ and mechanical stack of FIG. 39B, dynamically suppresses the flexural compliance of the mounting blocks and eliminates compliances and tolerances associated with the complex mechanical stack of the prior art. The boot binding is operatively reduced upon dynamic application of torque to a single rigid member between the sole of the rider's boot and the splitboard, the single rigid member comprising a monolithic modified box girder or a modified sandwich box girder of the present invention.

Also conceived is a method for promoting splitboarding, which may comprise a) supplying a pair of boot bindings to a rider, each boot binding of the pair comprising a modified monolithic box girder or a modified sandwich box girder having i) a top surface with top mediolateral edges, wherein the top surface is configured for contactingly supporting the rider's boot sole and the top mediolateral edges are configured for securing the rider's boot sole thereinbetween, ii) a bottom surface, the bottom surface having bottom mediolateral edges and parallel internal flanges forming a bottom channel and wherein the bottom surface and the bottom channel are configured with a clearance for receiving and grippingly conjoining a mounting block assembly affixed to a top face of a splitboard, and iii) a medial web spacer member and a lateral web spacer member for joining the top surface and the bottom surface as a single rigid member; and b) configuring the boot bindings to reversibly form a fulcrum F* contacting a first opposing edge of the bottom mediolateral edges to the top face of the splitboard in response to a clockwise torque applied by the rider and to reversibly form a fulcrum F* contacting a second opposing edge to the top face of the splitboard in response to a counterclockwise torque applied by the rider, thereby dynamically coupling the rider's boot sole and the top face of the splitboard via the single rigid member with a mechanical advantage when a torque is applied by the rider. While not limited thereto, a method for promoting splitboarding may further comprise one or more of the following steps: a) configuring the modified monolithic box girder or a modified sandwich box girder to rotate with a torsional stiffness coefficient K greater than 150 in-lb/degree when mounted on the mounting block assembly and K is measured with respect to rotation at the fulcrum; b) broadening the design of the bottom surface of the box girder so that the bottom mediolateral edges extend to or beyond the mediolateral edges of the rider's boot sole, i.e., so that the flanges (302*a*, 302*b*) of the bottom surface of the box girder are as broad or broader than the corresponding width of the rider's boot sole; c) adjusting in a design the clearance $C_1$ or clearances between the bottom surface and the top face, optionally by inserting feet or shims; d) optionally providing a boot binding fitted to a size range of the rider's boot sole, or individually if desired as a custom-fitted box girder; or, e) providing at least one element of a boot binding upper attachable to the top surface of the modified monolithic box girder or the modified sandwich box girder, wherein the at least one element of the boot binding upper is configured for adjusting a composite torsional stiffness of each of the boot bindings.

Figure 39B:
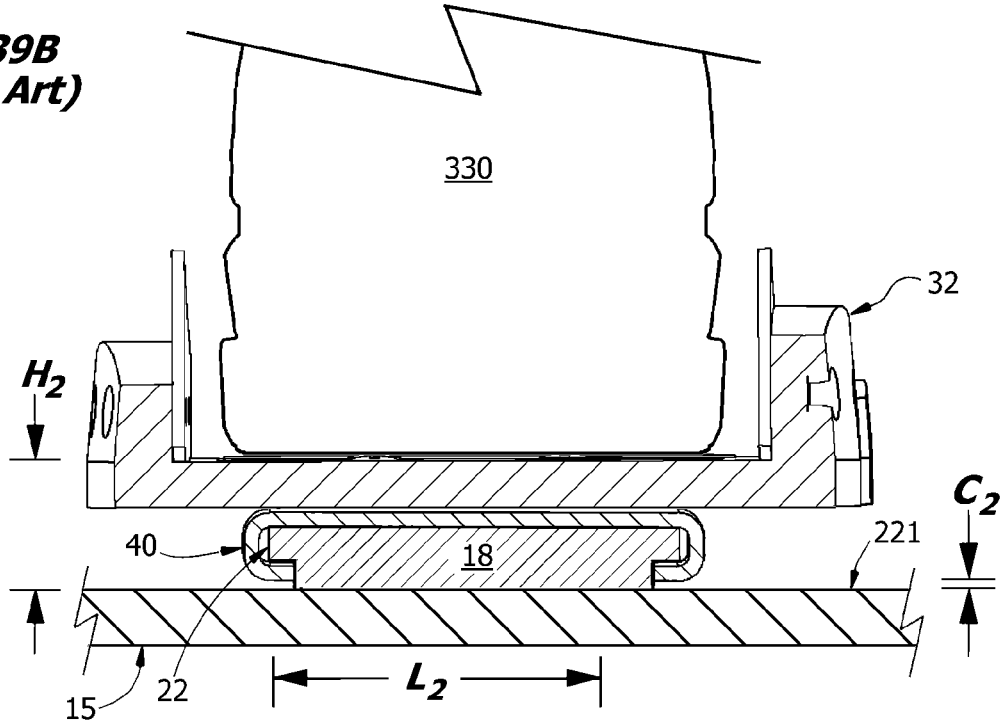
Fig. 39B (Prior Art)

In contrast, in the prior art boot binding of FIG. 39B, shown here for comparison, multiple members of a mechanical stack with additive compliances and clearances separate the boot sole from the board. These additive compliances and clearances result in both an inelastic flexural compliance and an elastic flexural compliance that is excessive and undesirable. The rider experiences an unacceptable loss of control due to the wobbliness and floppiness of the mechanical stack. As can be seen, the adaptor mounting plate (40) cannot readily contact the board due to the excessive clearance between the lower edges of the adaptor mounting plate and the top face of the board (221) and due to the narrow width of the mediolateral bottom edges of the plate. As the adaptor mounting plate 40 rotates, the mounting blocks 18 are deformed by a combination of bending and compression, with a center of rotation within the mass of the mounting block. While difficult to be precise, the rotation under torque can be analyzed as a shorter lever arm $L_2$ rotating around a point laterally disposed in the mounting block. This shorter lever arm $L_2$ increases the amount of rotational deformation required to achieve a requisite torque T for control of the ride and may require displacing the rider to a point where the center of mass is not in the desired location, i.e. to lose balance, further reducing control. While the clearance $C_2$ is thought to protect the aesthetic appearance of the splitboard face, the clearance also increases the side-to-side play in the mechanical stack. Furthermore, the increased height $H_2$ of the boot sole above the board combines with the play in the mechanical stack to increase the feeling of instability. Contrastingly, the reduced height $H_1$ shown in FIG. 39A improves the sense of control achieved by the invention.

In another embodiment, the invention is an improvement of a splitboard boot binding assembly, comprising a variform girder constructed with a top plate member with raised platform, a bottom plate member with lower aspect and bottom channel with parallel inside flanges for receiving and grippingly conjoining the boot bindings to a snowboard mounting block assembly affixed to a splitboard, and medial and lateral webs formed as spacer members between the top and bottom plate members. The bottom flanges are provided with mediolateral edges broader than the mediolateral edges of the sole of the rider's boot. The heel end optionally comprises an endstop or crosspiece and snow vent; and the toe end is provided with one or more means for pivoting at the toe in ski touring mode. The top plate member has medial and lateral edges and the medial and lateral edges are configured for securing the boot to the top platform, generally with detachable fasteners.

A boot binding of the present invention is further characterized in that the variform box girder is either a) fabricated as a single monolithic piece; b) formed of a first part or layer and a second part or layer, where the first part comprises the top plate member and the second part comprises the bottom plate member, and the lateral and medial webs elements are consolidated in the parts as projections of the top plate member or of the bottom plate member, and the top part and the bottom part are attached together with the spacer members therebetween; or c) formed as three layers or parts, the first layer including top plate member, the third layer including the bottom plate member, and the second layer including the web "spacers" joining the top and bottom plate members.

In sandwich construction, the box girder may be fabricated from multiple pieces selected from top plate, bottom plate, lateral web, medial web, or combinations of top plate with projecting webs, bottom plates with projecting webs, and lateral web with medial web (the lateral web may be joined to the medial web for example by a crosspiece) and assembled as a sandwich using fasteners, adhesives, rivets, spot welds, or other joining technique such as ultrasonic welding. Similarly, the bottom plate may consist of a medial plate or flange and a lateral plate or flange. The bottom plates may be joined at the heel by a crosspiece.

For monolithic construction, the box girder is fabricated from a single piece, either by molding, casting, machining, or a combination thereof, typically from a metal or a plastic.

The web elements are either made of a structural "spacer" material, including "honeycomb", "truss", "standoff", or "core" elements, and is laminated, molded, glued, solvent welded, or otherwise affixed between the top plate member and bottom plate member—or made as a consolidated part of the material of the top plate or bottom plate, as by injection molding, extrusion, welding, solvent welding, thermal fusion, casting, or by machining from a single piece. The webs are formed with an aspect ratio that is independently varied from the top and bottom plates, and optionally from heel to toe. The resulting variform girder more fully supports and secures a rider's boot to an upper surface of the boot binding. Optionally, the web materials are selected independently from the materials used to form the top or bottom plate members. Both sandwich and monolithic construction result in fitted boot bindings having an integral bottom channel with parallel inside flanges for gripping and conjoining the mounting blocks of a splitboard. The bottom plate comprises parallel inside flanges formed around a channel between the medial and lateral webs; the channel is optionally box-ended. Using complex structural webs as described, the boot-supporting surface may be contoured, shaped, and widened while preserving the dimensions, planarity, and parallel flanged edges of the underside channel. This results in a variform box girder which serves to join the halves of a splitboard and as a platform for a boot, where the shape, outline and contours of the top surface of the platform are optimized for supporting and securing the boot.

Embodiments of FIGS. 1, 3, 22, 23, 24, 25, 26, 27, 33, 34, and 35 illustrate sandwich box girder construction. The embodiments of FIGS. 20, 21, 28, 31, and 32 employ a monolithic or single-piece box girder construction. Representative embodiments are further illustrated in the examples below.

EXAMPLES

Example 1

A Drake F-60 snowboard binding with integral heel cup and highback was modified in a shop by removing the upper binding baseplate (32) and 4-hole disk and substituting in their place a sheet of 2.5 mm aluminum with side rails folded up to form a shallow channel for the boot.

A three dimensional CAD design was sent to a local sheet metal house that used a CNC (computer numerically controlled) laser cutter to cut the outline and holes for the aluminum parts necessary for the bindings. Sheetmetal press brakes were then used to bend the channels of the bindings. Similarly, a CNC milling machine cut out the UHMW polyethylene spacers from a sheet of 16 mm thick plastic. This machine provided all holes, the outline, and contoured surfaces.

Using mounting bolts, the heel and toe straps and highback were secured in place. A total of 10 screws, countersunk, were placed at the circumference of the base along each side of the sandwich to secure the plastic spacer materials (webs) in position between the aluminum plates.

A milled hole accommodates a longer pivot pin than used in the prior art, and a second smaller hole was placed in the aluminum side rails to secure a braided cable loop to protect against loss of the snap fasteners. Note that the inner dimensions of the channel formed by the plastic spacers is wide enough to snugly fit over the ski mounting tabs and that the transverse pivot axis lines up with the hole in the ski mounting bracket. UHMWPE lubricates the pin and spares wear on the pivot pin cradle mount.

Right and left boot bindings were made in this manner. To assemble the snowboard, the boot bindings are securely slid over the snowboard mounting blocks and locked in place with a transverse pin and snap fasteners. To switch to ski mode, the boot bindings are slipped off the snowboard mounting block assemblies and positioned at the toe over the ski mounting brackets so that the pivot pin can be aligned through the pivot holes and secured in place with snap fasteners.

Example 2

Mechanical comparisons were made using a splitboard and boot binding assembly of the prior art versus that of Example 1. A Voile "Splitdecision 166" splitboard was used for the comparisons, and for the prior art testing, Drake F-60 snowboard bindings were mounted as recommended by the manufacturer on the Voile mounting hardware. The boot bindings were assembled in snowboard riding configuration for these comparisons.

Physical measurements of the two boot bindings were also made and are recorded in Table I.

TABLE I

| | Prior Art | Example 1 |
|---|---|---|
| Distance from plane of board to bottom of boot | 26 mm | 14 mm |
| Width in contact with board under lateral load | 80 mm | 120 mm |
| Weight per boot binding | 1182 g | 1015 g |

To measure deformation under lateral strain, which is related to spring constant K of the boot bindings, the snowboard was clamped to a vertical surface so that the highback of the boot bindings were mounted parallel to the floor. An 11.3 kg weight was then clipped onto the top of the highback, and the angle of shear for the two assemblies was compared. Deformation under modest lateral loading was approximately 36% greater with the prior art boot binding, indicating an unacceptably low torsional stiffness. The degree of torsional stiffness in a boot binding is indicated by the degree of deformation under increasing lateral strain applied at the top of the boot. Ideally, the "spring constant" of the torsional stiffness relationship is relatively constant and linear through the required range of flexural deformation. "Torsional weakness" or "looseness" can result from excessive compliance in elastic parts, both with respect to materials selection and with respect to design, from excess tolerances when parts stack up, and from excess height of a parts stack.

The binding system of this example was noted to substantially increase lateral stiffness of the boot and to lower the center of gravity on the boot. In snowboarding tests undertaken during winter conditions on mountainous terrain, the increased lateral rigidity of the inventive bindings was found to result in immediately noticeable increases in control and responsiveness of the board in downhill ride mode.

Improvements were also noted in telemark and ski touring mode, which were attributed to the improved toe contact made by the boot with the board, particularly for kick turning, and the wider lever arm on the bracket.

Weight is reduced by 6 ounces (170 g) on each foot, a 15% weight savings. This weight savings noticeably decreases the effort required to ascend a slope because the weight on each foot must be repeatedly lifted and pushed forward. Each kilogram removed from the foot decreases energy expenditure 7% to 10%. Weight on the feet requires roughly four times the exertion to move as the same weight carried in a backpack. The weight savings is obtained by combining structures such as the upper binding baseplate (or "tray) and the adaptor mounting plate. This savings is also had by eliminating unnecessary structures like the four-hole disk (shown in FIGS. 4 and 17, item 31). The four-hole disk adds the ability to adjust the stance angle on a conventional snowboard and is the principal component that determines the thickness of the tray. However, with a splitboard, the plastic pucks also allow rotation of stance during setup, making the adjustability of the 4-hole disk redundant. Voile (Salt Lake City, Utah), manufacturer of the snowboard mounting block assemblies used in these tests, states that the binding should always be connected to the slider at zero degrees. This prototype fuses these structures at zero degrees without the added weight and thickness of a four-hole disk.

Example 3

Figures 40A, 40B:
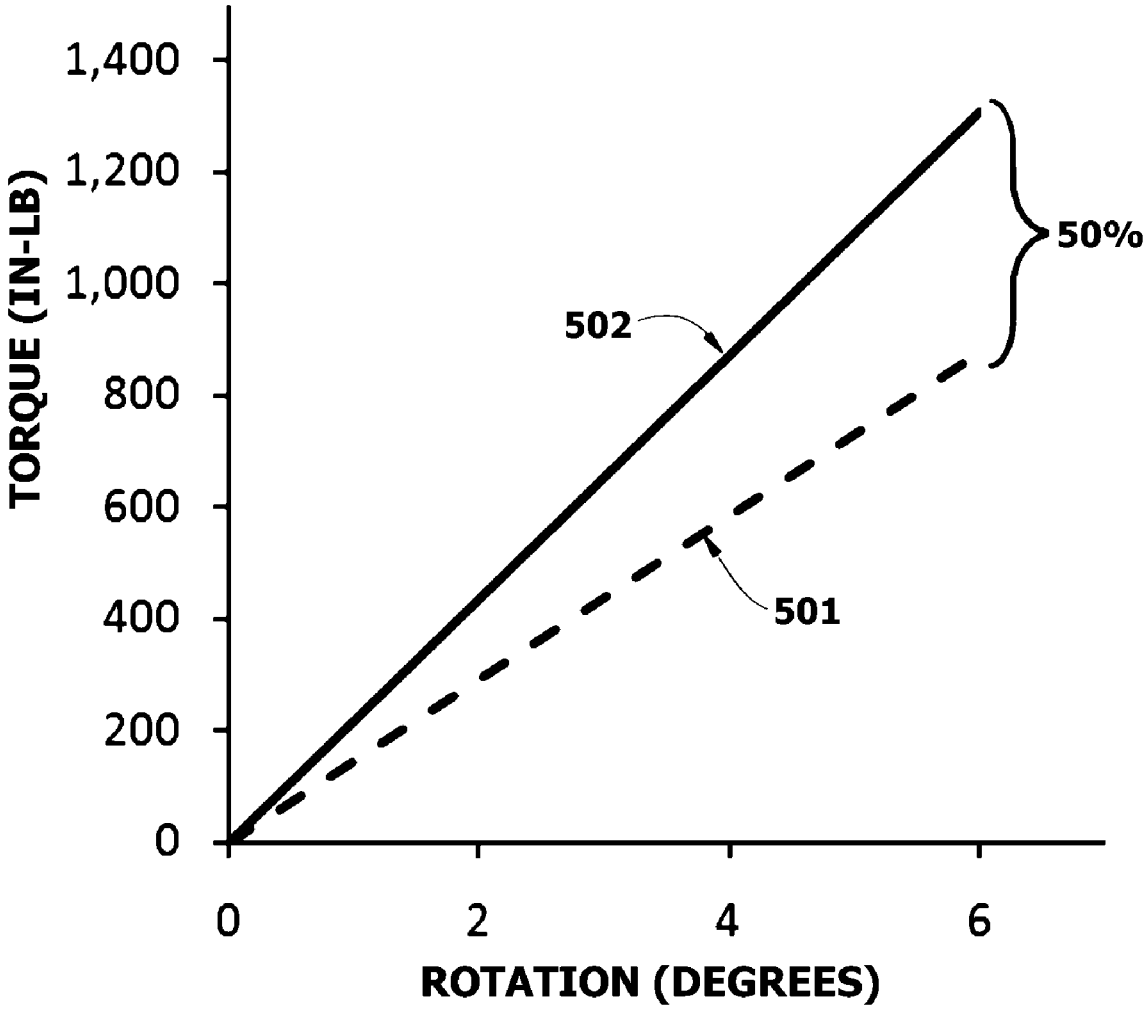
FIGS. 40A and 40B depict data for torsional stiffness of Example 3.

A torsional stiffness coefficient was measured for the boot binding of FIG. 33 and compared to an equivalent measurement for a binding of the prior art (FIG. 4B). However, in order to eliminate the contribution of the upper baseplate 32, four hole disk 31 and gasket 39, these were eliminated from the test setup. To make the measurement, a lever arm consisting of a block of aluminum 7.7 inches long by 2.5 inches by 2.5 inches wide was bolted to the slider track 40 of the prior art setup or to the top plate member 3 of the inventive article of FIG. 33. A block and tackle was used to apply a force on the lever arm, which generated a torque on the binding. An angle gauge was mounted on the aluminum block to measure theta. Both boot bindings were mounted on identical mounting blocks (17-FIG. 2) which had been affixed to a splitboard for the test. The splitboard was clamped to a solid support. Deformation (as torsional rotation) versus torque was then measured. The data is plotted in FIG. 40A and summarized in Table II (FIG. 40B).

As expected, torsional stiffness was not equivalent. The slope of the datapoints is the torsional stiffness spring constant K. A slope (502) of about 220 inch-pounds/degree was observed for the inventive article of FIG. 33. About 1400 inch-pounds of torque was required to achieve 6 degrees of rotation of the binding. In contrast, the torsional stiffness of the prior art article (501) was about 145 in-lbs/degree. A torque of 870 in-lbs resulted in 6 degrees of rotation of the binding; 1400 in-lbs resulted in a deformation of almost 10 degrees of rotation. The data are tabulated in FIG. 40B. The inventive design thus achieves about a 50% increase in torsional stiffness at the level of the mounting blocks. The increase is attributed not to any difference in the mounting blocks, which are identical, but due to the increased width of the bottom plate flanges of the boot binding. In the case of the inventive article, the bottom plate flanges actually touch the board whenever torque is applied. The lower edges of the article of the prior art was never seen to touch the board. The extended base width can be analyzed as moving the fulcrum (see FIG. 39A) for rotation away from the applied force, thus stiffening the binding.

In the prior art article (see FIG. 39B) the fulcrum is seen to be closer to the applied force, and an equivalent force results in a much greater rotational deformation of the mounting blocks. During the testing, the bottom edges of the prior art slider track were not observed to touch down on the face of the board.

A stiffer boot binding lower is achieved by the inventive variform box girders. The torsional stiffness of the overall boot binding is a combination of the K factor for the boot binding lower and corresponding K factors for the boot binding upper and the boot itself. Thus a boot binding lower that lacks sufficient torsional stiffness undermines the stiffness of the boot binding as a whole.

Torsional deformation is a form of stored energy: i.e., the boot binding functions as a spring. During an elastic recovery phase, the rider is returned to an upright position. Thus the spring constant of the binding is directly perceptible by the rider as "too much", "not enough", or in "the right range". The rider can adjust the spring constant by selecting a boot and boot binding uppers such as heel cup, riser, and ankle strap, but only within limits. However, when the upper baseplate 32, gasket 39, and four-hole disk 31 of the prior art are also included with the prior art binding, and K is again measured, K can quickly fall below 70 in-lb/degree. Compliance or "play" in this range is experienced as "wobbliness". With typical setups currently available, K's of 32-70 in-lb/degree were measured—too low for good performance. Through a long process of trial and error, I have discovered that a preferred range of stiffness K (as a composite K, including boots, boot binding uppers, and boot binding lower) is in the range of 70 to 130 in-lbs/degree.

Example 4

A block of UHMWPE, 25 mm thick by 100 mm by 75 mm, is trimmed to fit between the lateral and medial spacers of an integral boot binding lower of FIG. 10. The rear height of the block is trimmed and rounded to fit easily under the toe riser. A thin rectangular pad is formed from the front of the block to protect the board surface from abrasion by the toe riser and serve as a shim during telemark ski touring. Using the boot bindings toe pivot holes of Example 1 as a drill guide, a transverse hole through the block is made. This hole is dimensioned to accept a captive bushing for use with the longer toe pivot pins. Board mounting holes are also drilled and countersunk, so that the new toe mounting assembly can be fitted onto the existing inserts of the board. A second block is shaped for the other board. These components go into a boot binding interface "conversion kit", or "split kit", for use with the integral boot binding lower of the invention. Components of the kit are shown in Table III.

TABLE III

| Splitboard Boot Binding Interface Conversion Kit * | |
|---|---|
| Fusion boot binding (with integral boot binding lower of Example 1) | pair |
| Ski 3-Hole Mounting Bracket w/captive bushing (shims available in 2 mm increments) | 2 ea |
| 20 mm stainless steel screws | 6 ea |
| Heel rest with climbing bar | 2 ea |
| Pivot pin and easy-snap retainer ring with runaway cable | 2 ea |
| 30 mm stainless steel screws | 8 ea |
| Crampons with fasteners | 2 ea |
| Allen wrench | 1 ea |

* Table Note: Conversion kits are optionally compatible with Voile "slider mounting blocks" (Voile-USA: Salt Lake City, UT). Mounting block assemblies are optional in the kit or may be customized by the user. Other boot bindings such as the Restraint from Bent Metal (Park City, UT) may be substituted, for example.

While the above is a complete description of the presently preferred embodiments of the present invention, it is possible to use various alternatives, modifications and equivalents. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

I claim:

1. A pair of splitboard boot bindings, each boot binding for securing a rider's boot to a splitboard, the splitboard having a pair of conjoinable ski members, the ski members when conjoined together defining a snowboard riding configuration and when used separately defining a ski touring configuration, each boot binding for engaging a snowboard mounting block assembly affixed crosswise to the top face of the splitboard in snowboard riding configuration and for engaging a ski mounting assembly affixed to one of the ski members in ski touring configuration, each boot binding of said pair comprising, a box girder having a top plate member with a top surface, a bottom plate member with a bottom surface, a medial web member, a lateral web member, a heel end and a toe end; wherein, a) said top surface is proportioned for contactingly receiving an applied torque from the sole of the rider's boot, said box girder having means for detachably securing the rider's boot to said top surface;

b) said bottom plate member comprises parallel inside flange edges forming an underside channel for receiving and grippingly conjoining said box girder to the snowboard mounting block assembly affixed to a top face of the splitboard, and is proportioned with widened bottom outside mediolateral flange edges for dynamically transmitting torque from the sole of the rider's boot to the top face of the splitboard;

c) said medial and lateral web members underlie said top plate and join said top plate to said bottom plate, forming a rigid mechanical linkage therebetween;

d) said medial and lateral web members each comprise a transverse coaxial hole on a pivot axis proximate to said toe end, said transverse coaxial hole for receiving an insertable toe pivot pin; and, e) said medial and lateral web members have each a lateral face and a medial face dimensionally separated by a lateral-to-medial width, said lateral-to-medial width having a maximum proximate to said transverse coaxial pivot hole and tapered to a minimum posteriorly therefrom.

2. The pair of boot bindings of claim 1, wherein said box girder is a monolithic box girder or a sandwich box girder, and further wherein said box girder comprises, disposed within the lateral-to-medial width of said web member or members, a honeycomb structure, a truss structure, a composite structure, a standoff structure, or a combination thereof.

3. The pair of boot bindings of claim 1, wherein said means for detachably securing include a hole, a slot, a snap for receiving one or more fasteners or straps, a peripherally disposed side rail, a heel cup, a bracket, a heel riser, a toe riser, a toe strap, a heel strap, or a combination thereof for use with a soft boot.

4. The pair of boot bindings of claim 1, each binding of said pair further comprising a highback, a boot pocket, a base plate, a brace, an arch support, an anti-slip plate, an exterior shell, a cushion, an ankle strap, or a step-in binding for use with a soft boot.

5. The pair of boot bindings of claim 1, wherein the heel end comprises a snow vent formed between said medial and lateral webs.

6. A boot bindings kit which comprises said pair of boot bindings of claim 1, a pair of toe pivot mounting cradles, and a pair of insertable toe pivot pins.

7. The kit of claim 6, further comprising a pair of snowboard mounting block assemblies formed of a plastic, a metal, or a combination thereof.

8. The kit of claim 7, wherein said snowboard mounting block assemblies comprise mounting blocks formed of a stiff but elastically deformable solid.

9. The kit of claim 6, wherein said insertable toe pivot pins are self-locking toe pivot pins that are formed with an L-shaped extension arm having an elbow bend.

10. The pair of boot bindings of claim 1, wherein said box girder is a metal girder, a plastic girder, or a composite thereof.

11. A combination of a splitboard and a pair of boot bindings, said splitboard comprising:

a) a pair of ski members, said ski members when joined together having a snowboard riding configuration and when used separately having a ski touring configuration;

b) a pair of snowboard mounting block assemblies for use in said snowboard riding configuration;

c) a pair of ski mounting assemblies for use in said ski touring configuration;

each boot binding of said pair of said combination comprising a box girder having a top plate member with a top surface, a bottom plate member with a bottom surface, a medial web member, a lateral web member, a heel end and a toe end; wherein i) said top surface is proportioned for contactingly receiving an applied torque from the sole of a rider's boot, said top surface having means for securing the rider's boot to said top surface;

ii) said bottom plate member comprises parallel inside flange edges forming an underside channel for receiving and grippingly conjoining said box girder to a snowboard mounting block assembly affixed to the top face of the splitboard, and is proportioned with widened bottom outside mediolateral flange edges for dynamically transmitting said torque to said top face of said splitboard;

iii) said medial and lateral web members underlie said top plate and join said top plate to said bottom plate, forming a rigid mechanical linkage therebetween;

iv) said medial and lateral web members each comprise a transverse coaxial hole defined on a pivot axis proximate to said toe end, said transverse coaxial hole for receiving an insertable toe pivot pin;

v) said medial and lateral web members have each a lateral face and a medial face dimensionally separated by a lateral-to-medial width, said lateral-to-medial width having a maximum proximate to said transverse coaxial pivot hole and tapered to a minimum posteriorly therefrom.

12. The combination of claim 11, wherein said box girder is a monolithic box girder or a sandwich box girder, and further wherein said box girder comprises, disposed within the lateral-to-medial width of said web member or members, a honeycomb structure, a truss structure, a composite structure, a standoff structure, or a combination thereof.

13. A splitboard combination comprising:

a) a first ski member having at least one nonlinear longitudinal edge;

b) a second ski member having at least one nonlinear longitudinal edge;

c) conjoining apparatus for securing said first ski member to said second ski member to form a snowboard having nonlinear longitudinal edges;

d) a ski mounting assembly secured to said first ski member and a ski mounting assembly secured to said second ski member;

e) a first snowboard mounting block assembly positioned to extend a first boot binding between said first ski member and said second ski member, said first snowboard binding block assembly having at least one snowboard mounting block element secured to said first ski member and at least one snowboard mounting block element secured to said second ski member;

f) a second snowboard mounting block assembly positioned to extend a second boot binding between said first ski member and said second ski member, said second snowboard mounting block assembly having at least one snowboard mounting block element secured to said first ski member and at least one snowboard mounting block element secured to said second ski member;

wherein said first and second boot binding comprises each a box girder having a top plate member with a top surface, a bottom plate member with a bottom surface, a medial web member, a lateral web member, a heel end and a toe end; wherein i) said top surface is proportioned for contactingly receiving a torque from the sole of a rider's boot, said top surface having means for securing said boot to said top surface;

ii) said bottom plate member comprises parallel inside flange edges forming a channel for receiving and grippingly conjoining said box girder to a mounting block assembly affixed to a top face of a splitboard, and is proportioned with widened bottom outside mediolateral flange edges for dynamically transmitting said torque to said top face of said splitboard;

iii) said medial and lateral web members underlie said top plate and join said top plate to said bottom plate, forming a rigid mechanical therebetween;

iv) said medial and lateral web members each comprise a transverse coaxial hole on a pivot axis proximate to said toe end, said transverse coaxial hole for receiving an insertable toe pivot pin;

v) said medial and lateral web members have each a lateral face and a medial face dimensionally separated by a lateral-to-medial width, said width having a maximum proximate to said transverse coaxial pivot hole and tapered to a minimum posteriorly therefrom.

14. The combination of claim 13, wherein said box girder is a monolithic box girder or a sandwich box girder, and further wherein said box girder comprises, disposed within the lateral-to-medial width of said web member or members, a honeycomb structure, a truss structure, a composite structure, a standoff structure, or a combination thereof.

15. A method for promoting splitboarding to a rider, the rider having soft boots, which comprises a) providing a splitboard to the rider, said splitboard comprising i) a pair of conjoinable ski members, said ski members when conjoined together defining a snowboard riding configuration and when used separately defining a ski touring configuration;

ii) a pair of snowboard mounting block assemblies affixed crosswise to the top face of said splitboard, wherein said snowboard mounting block assemblies are each comprised of stiff but elastically deformable solid members having outside flanges disposed thereon for use in said snowboard riding configuration;

iii) a pair of ski mounting assemblies affixed to the top face of said ski members, wherein said ski mounting assemblies comprise each a toe pivot cradle and insertable toe pivot pin for use in said ski touring configuration;

b) providing a pair of boot bindings to the rider, each boot binding of said pair comprising a box girder having a top plate member with a top surface, a bottom plate member with a bottom surface, a medial web member, a lateral web member, a heel end and a toe end; wherein, i) said top surface is proportioned for contactingly receiving an applied torque from the sole of the rider's boot, said top surface having means for securing the rider's boot to said top surface;

ii) said bottom plate member comprises parallel inside flange edges forming an underside channel for receiving and flangedly interlocking said box girder to a snowboard mounting block assembly of said pair, and is proportioned with widened bottom outside mediolateral flange edges for dynamically transmitting an applied torque from the sole of the rider's boot to the top face of the splitboard;

iii) said medial and lateral web members underlie said top plate and join said top plate to said bottom plate, forming a rigid mechanical linkage therebetween;

iv) said medial and lateral web members each comprise a transverse coaxial hole defined on a pivot axis proximate to said toe end, said transverse coaxial hole for receiving said toe pivot pin;

v) said medial and lateral web members have each a lateral face and a medial face dimensionally separated by a lateral-to-medial width, said lateral-to-medial width of said web members having each a maximum proximate to said transverse coaxial pivot hole and tapered to a minimum posteriorly therefrom; and, c) affixing said boot bindings to said splitboard; and d) riding said splitboard.

16. The method of claim 15, further comprising a step for providing said splitboard and said each boot binding with a clearance ($C_1$) between said outside mediolateral edges of said bottom surface of said box girder and said top face of said splitboard when said box girder is flangedly interlocked to said mounting block assembly, wherein said clearance is configured so that, i) in the absence of an applied torque, said bottom surface and said top face are separated by said clearance, thereby aiding the rider in sliding said boot bindings on and off said mounting block assemblies; and ii) in the presence of an applied torque from the sole of the rider's boot, wherein said torque may be clockwise or counterclockwise, said bottom surface and said top face contact one said outside mediolateral edge of said box girder to form a fulcrum (F*) with lever arm defined as the distance ($L_1$) between the fulcrum and the underside channel flange where deformation of the elastically deformable mounting blocks is greatest, thereby operatively transmitting applied torque according to the rider's control and direction.

* * * * *